US009905965B2

(12) United States Patent
Tanaka et al.

(10) Patent No.: US 9,905,965 B2
(45) Date of Patent: Feb. 27, 2018

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventors: Yukitaka Tanaka, Tokyo (JP); Akira Kimura, Tokyo (JP); Yoshihide Kuroki, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/210,371

(22) Filed: Jul. 14, 2016

(65) Prior Publication Data

US 2017/0093086 A1 Mar. 30, 2017

(30) Foreign Application Priority Data

Sep. 29, 2015 (JP) ..... 2015-190812

(51) Int. Cl.
*H01R 13/621* (2006.01)
*H01R 13/516* (2006.01)
(Continued)

(52) U.S. Cl.
CPC ..... *H01R 13/621* (2013.01); *H01R 13/516* (2013.01); *H01R 13/6215* (2013.01);
(Continued)

(58) Field of Classification Search
CPC ..... H01R 13/6215
(Continued)

(56) References Cited

U.S. PATENT DOCUMENTS 7,044,752 B2 * 5/2006 Olson ..... H01R 13/41 439/79
7,134,899 B1 * 11/2006 Huang ..... H01R 13/6215 439/352

(Continued)

FOREIGN PATENT DOCUMENTS

JP 3113056 U 9/2005

*Primary Examiner* — Tulsidas C Patel
*Assistant Examiner* — Marcus Harcum
(74) *Attorney, Agent, or Firm* — Holtz, Holtz & Volek PC

(57) ABSTRACT

A connector is mountable on a mount object in an up-down direction and connectable with a mating connector along a predetermined direction perpendicular to the up-down direction. The mating connector comprises a mating fitting portion and a male screw member. The connector comprises a fitting portion and a screw end accommodation portion. The fitting portion is mateable with the mating fitting portion. The screw end accommodation portion defines an accommodation space which accommodates an end of the male screw member when the connector is connected with the mating connector. The screw end accommodation portion has at least a front surface portion, an upper surface portion, a rear surface portion and an outer surface portion. The front surface portion is provided with a female screw portion which is connectable with the male screw member. The accommodation space is positioned between the front surface portion and the rear surface portion in the predetermined direction.

37 Claims, 38 Drawing Sheets

(51) Int. Cl.
*H01R 13/73* (2006.01)
*H01R 13/74* (2006.01)
*H01R 12/71* (2011.01)

(52) U.S. Cl.
CPC ..... *H01R 13/73* (2013.01); *H01R 13/748* (2013.01); *H01R 12/712* (2013.01)

(58) Field of Classification Search
USPC ..... 439/359, 362
See application file for complete search history.

(56) References Cited

U.S. PATENT DOCUMENTS 7,544,084 B1 * 6/2009 Dutton ..... G02B 6/387 439/465
7,731,532 B2 * 6/2010 Masumoto ..... H01R 13/648 439/564
7,789,702 B1 * 9/2010 Xiang ..... H01R 12/7064 439/567
8,475,211 B2 * 7/2013 Wang ..... H01R 12/724 439/607.38
2004/0214469 A1 * 10/2004 Wu ..... H01R 13/6335 439/483
2005/0070145 A1 * 3/2005 Huang ..... H01R 13/639 439/246
2010/0068932 A1 * 3/2010 Tsai ..... H01R 13/6215 439/607.01
2011/0059653 A1 * 3/2011 Yang ..... H01R 13/6594 439/607.35
2011/0097922 A1 * 4/2011 Katayanagi ..... H01R 12/724 439/345
2013/0040499 A1 * 2/2013 Wang ..... H01R 13/6658 439/660
2014/0220810 A1 * 8/2014 Lappoehn ..... H01R 12/7064 439/359

* cited by examiner

CONNECTOR AND CONNECTOR ASSEMBLY

CROSS REFERENCE TO RELATED APPLICATIONS

This application is based on and claims priority under 35 U.S.C. §119 to Japanese Patent Application No. JP2015-190812 filed Sep. 29, 2015, the contents of which are incorporated herein in their entirety by reference.

BACKGROUND OF THE INVENTION

This invention relates to a connector having a female screw. In addition, this invention relates to a connector assembly comprising the aforementioned connector and a mating connector having a male screw member.

As shown in FIGS. 67 and 68, a connector 900 of JPU 3113056 (Patent Document 1) comprises contacts 910, a holding member 920 and a shell 930. Specifically, the holding member 920 holds the contacts 910, and the shell 930 covers the holding member 920. The shell 930 is provided with three plate-like portions 940. Each of the plate-like portions 940 is formed with a female screw portion 950.

When the connector 900 is actually used, the connector 900 having the female screw portions 950 is arranged in a housing of an electronic equipment. In the actual use of the connector 900, foreign bodies might enter into the housing from the female screw portions 950.

SUMMARY OF THE INVENTION

It is therefore an object of the present invention to provide a connector which has a female screw portion and which can prevent foreign bodies from entering into a housing when the connector is actually used.

One aspect (first aspect) of the present invention provides a connector mountable on a mount object in an up-down direction and connectable with a mating connector along a predetermined direction perpendicular to the up-down direction. The mating connector comprises a mating fitting portion and a male screw member. The mating fitting portion has a mating contact. The connector comprises a fitting portion and a screw end accommodation portion. The fitting portion is mateable with the mating fitting portion. The fitting portion has a contact which is brought into contact with the mating contact when the fitting portion is mated with the mating fitting portion. The male screw member has an end in the predetermined direction. The screw end accommodation portion defines an accommodation space which accommodates the end of the male screw member when the connector is connected with the mating connector. The screw end accommodation portion has at least a front surface portion, an upper surface portion, a rear surface portion and an outer surface portion. The front surface portion is provided with a female screw portion which is connectable with the male screw member. The rear surface portion faces the front surface portion in the predetermined direction. The accommodation space is positioned between the front surface portion and the rear surface portion in the predetermined direction. The upper surface portion faces an upper side of the accommodation space in the up-down direction. The outer surface portion faces outward in a lateral direction perpendicular to both the predetermined direction and the up-down direction.

Another aspect (second aspect) of the present invention provides a connector assembly comprising the connector of the first aspect and the mating connector. The front surface portion of the screw end accommodation portion functions as a female screw seat. In the predetermined direction, the mating connector is connectable with the connector along a first predetermined orientation and is removable from the connector along a second predetermined orientation opposite to the first predetermined orientation. The mating connector comprises a mating connector main, a male screw member and a screw holding member. The mating connector main is mateable with the fitting portion along the first predetermined orientation. The mating connector main has a mating contact which is brought into contact with the contact when the connector and the mating connector are connected with each other. The screw holding member holds the male screw member. The screw holding member has a male screw seat which is brought into contact with the female screw seat when the male screw member is connected with the female screw portion. The male screw seat faces in the first predetermined orientation. The screw holding member is attached to the mating connector main. The screw holding member is relatively movable with respect to the mating connector main in the predetermined direction.

The connector of the present invention comprises the screw end accommodation portion which accommodates the end of the male screw member when the male screw member is connected with the female screw portion. The screw end accommodation portion has the front surface portion, the rear surface portion and the outer surface portion. In addition, the screw end accommodation portion is positioned above the mount object such as a circuit board, or above a shell. In other words, either of the mount object and the shell is positioned below the screw end accommodation portion. Accordingly, foreign bodies can be prevented from entering into a housing through the female screw portion.

An appreciation of the objectives of the present invention and a more complete understanding of its structure may be had by studying the following description of the preferred embodiment and by referring to the accompanying drawings.

Figure 1:
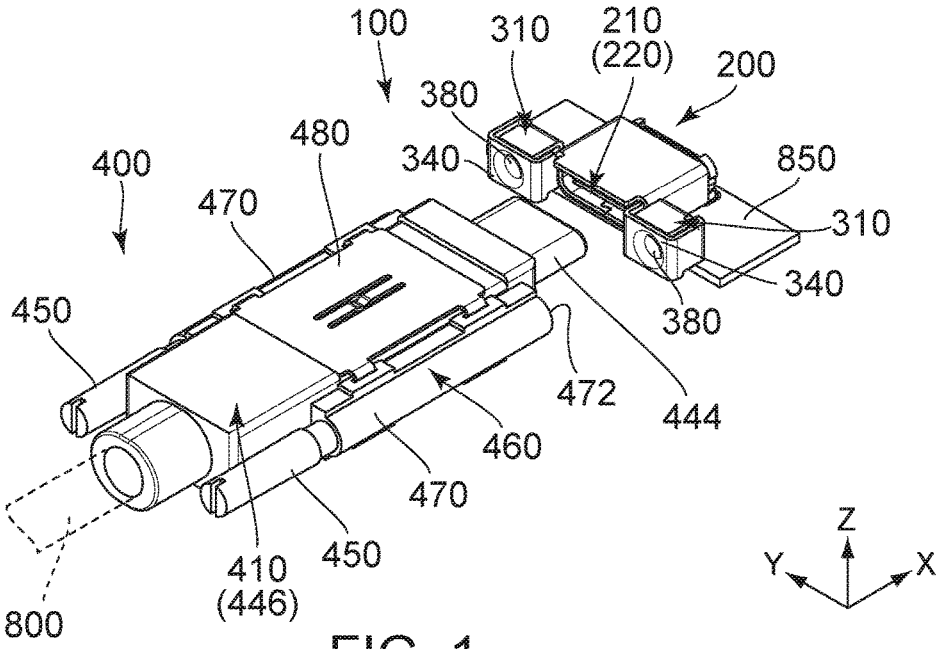
FIG. 1 is a top, perspective view showing a connector assembly which comprises a connector and a mating connector according to a first embodiment of the present invention. The illustrated connector and the illustrated mating connector are not connected with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS (First Embodiment)

Figure 2:
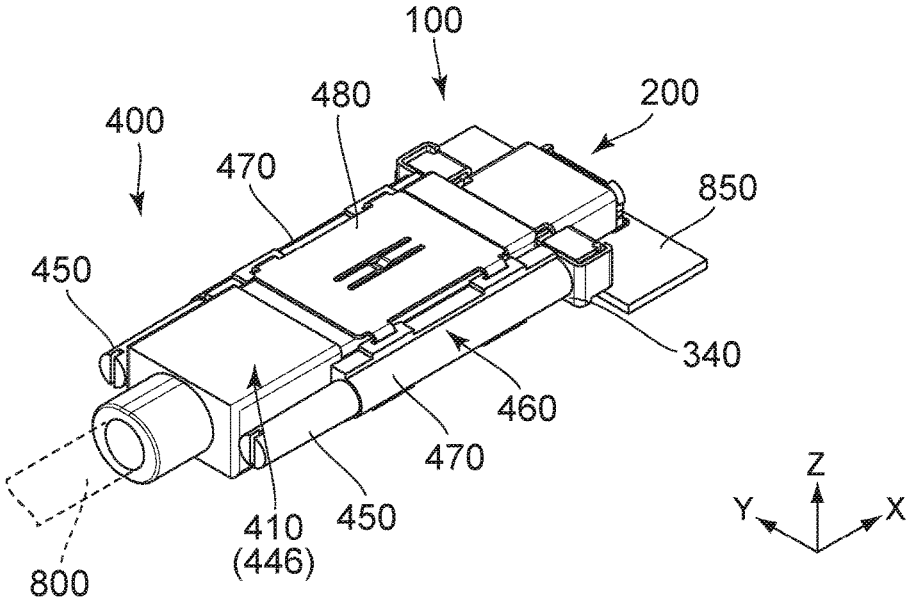
FIG. 2 is another top, perspective view showing the connector assembly of FIG. 1. The illustrated connector and the illustrated mating connector are connected with each other.

As shown in FIGS. 1 and 2, a connector assembly 100 according to a first embodiment of the present invention comprises a connector 200 and a mating connector 400. The connector 200 is a receptacle in accordance with a USB (Universal Serial Bus) Type-C standard. When the connector 200 is used, the connector 200 is mounted on a circuit board 850 as a mount object in an up-down direction. In the present embodiment, the up-down direction is a Z-direction. Specifically, a positive Z-direction is upward, and a negative Z-direction is downward. The mating connector 400 is a plug in accordance with the USB Type-C standard. As described later, the mating connector 400 comprises a mating fitting portion and male screw members 450, and the mating fitting portion has mating contacts 440. The mating fitting portion is described later. The mating connector 400 is connectable with the connector 200 along a first predetermined orientation in a predetermined direction perpendicular to the up-down direction. In addition, the mating connector 400 is removable from the connector 200 along a second predetermined orientation opposite to the first predetermined orientation in the predetermined direction. In the present embodiment, the predetermined direction is an X-direction. Specifically, the first predetermined orientation is a positive X-direction, and the second predetermined orientation is a negative X-direction. Furthermore, the positive X-direction is rearward of the connector 200, and the negative X-direction is forward of the connector 200. In other words, the first predetermined orientation is rearward of the connector 200, and the second predetermined orientation is forward of the connector 200.

Figure 5:
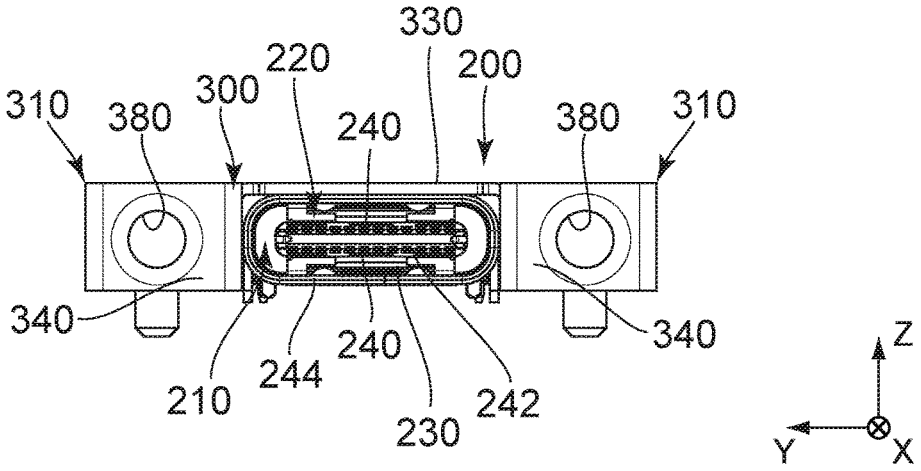
FIG. 5 is a front view showing the connector of FIG. 3.
Figure 6:
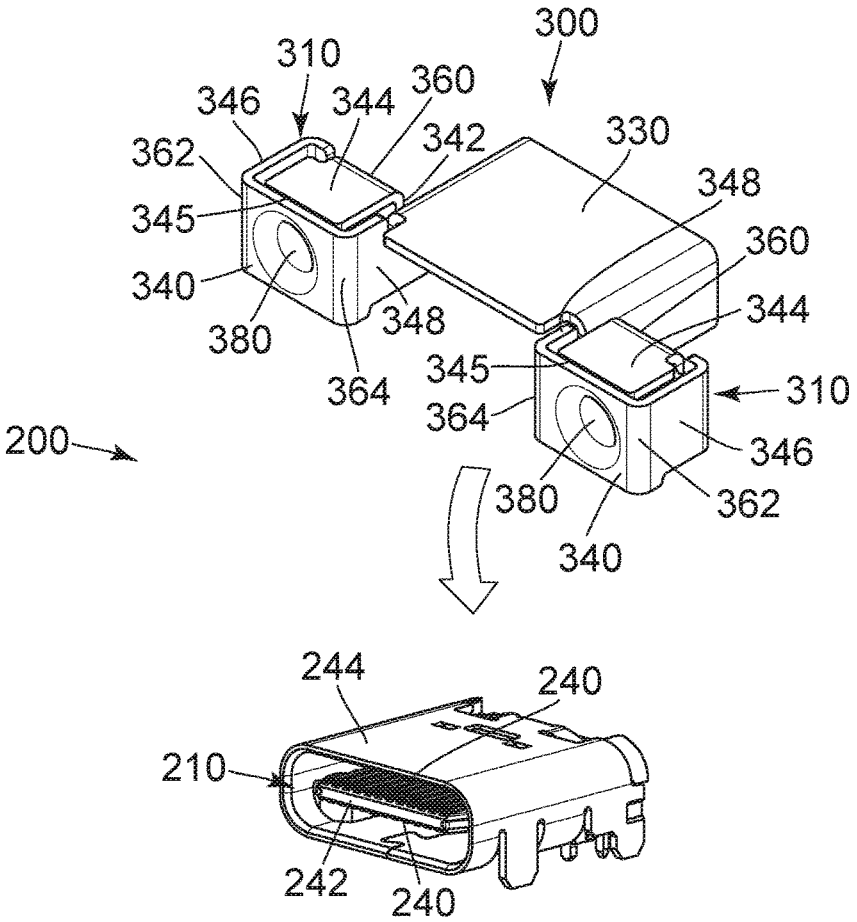
FIG. 6 is an exploded view showing the connector of FIG. 3.

As shown in FIGS. 5 and 6, the connector 200 comprises contacts 240, a holding member 242, a shell 244 and a screw fixing member 300. The contacts 240, the holding member 242 and the shell 244 form a fitting portion 210 which is mateable with the mating fitting portion. In other words, the connector 200 comprises the fitting portion 210. The fitting portion 210 of the present embodiment has a receiving portion 220 which receives the mating fitting portion in the predetermined direction. As shown in FIG. 5, the receiving portion 220 has an inner wall 230 in the predetermined direction. When the connector 200 is connected with the mating connector 400, the contacts 240 are brought into contact with the mating contacts 440, respectively. Specifically, when the fitting portion 210 is mated with the mating fitting portion, each of the contacts 240 is brought into contact with the corresponding mating contacts 440. The holding member 242 holds the contacts 240. The shell 244 surrounds the holding member 242 in a direction perpendicular to the predetermined direction.

As shown in FIG. 6, the screw fixing member 300 of the present embodiment is distinct and separated from the shell 244. The screw fixing member 300 of the present embodiment comprises two screw end accommodation portions 310 and a coupling portion 330. In other words, each of the screw end accommodation portions 310 of the present embodiment is formed as a part of the screw fixing member 300. However, the present invention is not limited thereto. Each of the screw end accommodation portions 310 may be formed as a part of the shell 244. The aforementioned fitting portion 210 is positioned between the two screw end accommodation portions 310 in a lateral direction perpendicular to both the up-down direction and the predetermined direction. In the present embodiment, the lateral direction is a Y-direction.

Figure 7:
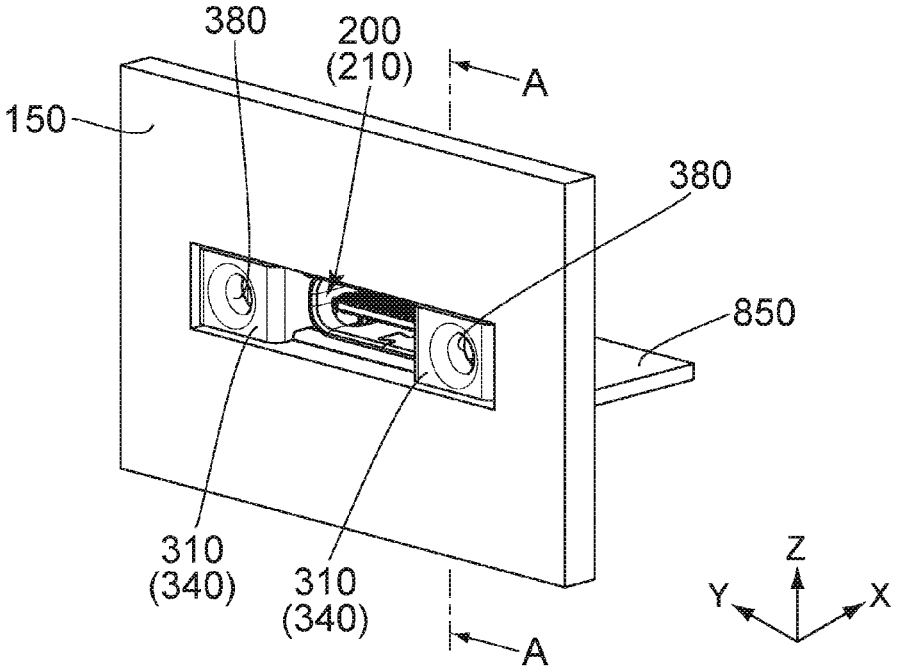
FIG. 7 is a view showing a state where the connector of FIG. 3 is arranged in a housing.
Figure 8:
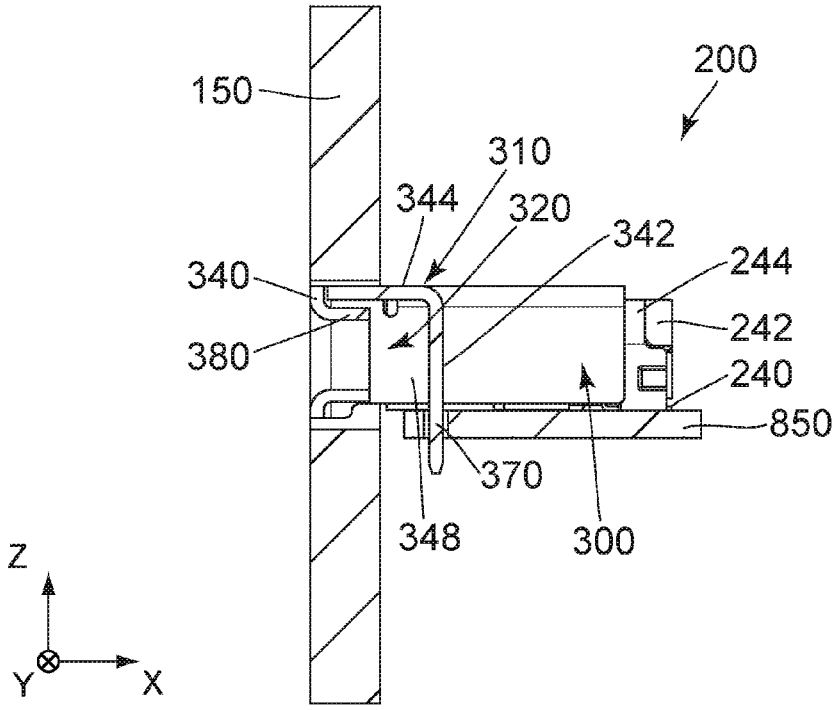
FIG. 8 is a cross-sectional view showing the state of FIG. 7, taken along line A-A.

As understood from FIGS. 7 and 8, the screw end accommodation portions 310 define accommodation spaces 320 which accommodate ends of the male screw members 450, respectively, when the connector 200 is connected with the mating connector 400. As understood from FIGS. 3 to 8, each of the screw end accommodation portions 310 has a front surface portion 340, an upper surface portion 344, a rear surface portion 342, an outer surface portion 346, an inner surface portion 348, a rear upper bent portion 360, a front outside bent portion 362 and a front inside bent portion 364.

As understood from FIGS. 3, 5, 6 and 8, the front surface portion 340 is provided with a female screw portion 380 which is connectable with the male screw member 450. The front surface portion 340 functions as a female screw seat when the connector 200 and the mating connector 400 are connected with each other.

As shown in FIG. 8, the rear surface portion 342 faces the front surface portion 340 in the predetermined direction. The rear surface portion 342 has a fixed portion 370 which is soldered to be fixed to the circuit board 850 when the connector 200 is mounted on the circuit board 850. The accommodation space 320 is positioned between the front surface portion 340 and the rear surface portion 342 in the predetermined direction.

Figure 4:
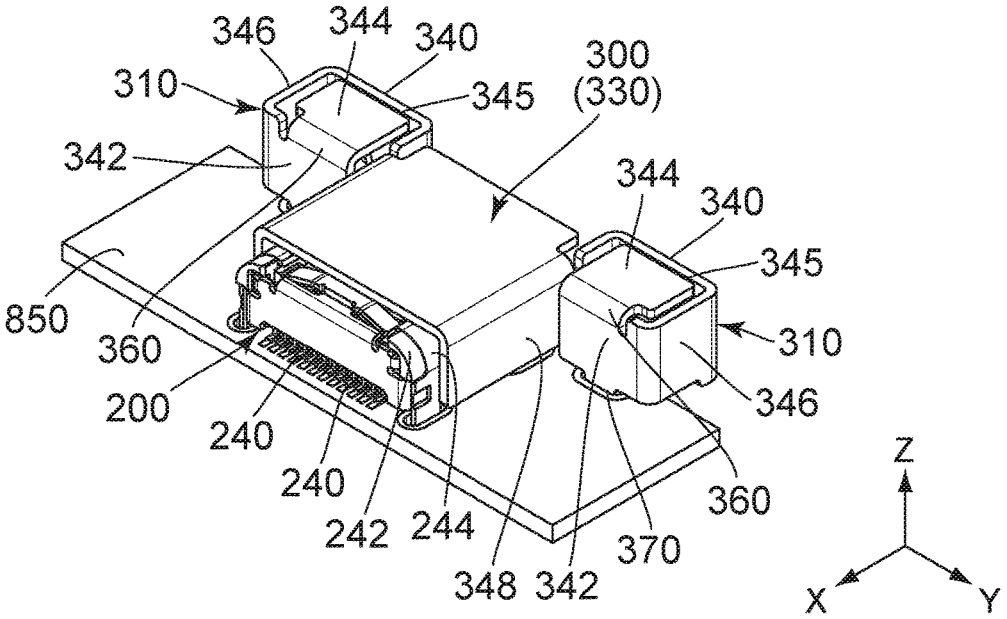
FIG. 4 is a rear, perspective view showing the connector of FIG. 3.

The upper surface portion 344 is positioned above the accommodation space 320 in the up-down direction. As shown in FIG. 4, the upper surface portion 344 is connected with the rear surface portion 342 by the rear upper bent portion 360. In the predetermined direction, a front edge 345 of the upper surface portion 344 faces the front surface portion 340 and is positioned slightly away from the front surface portion 340. Accordingly, when a force is applied to the front surface portion 340, the upper surface portion 344 can receive the force. In other words, the upper surface portion 344 reinforces the front surface portion 340. In addition, the rear surface portion 342, which is connected with the upper surface portion 344, is fixed to the circuit board 850 by the fixed portion 370. Thus, the front surface portion 340 is rigidly reinforced by the upper surface portion 344.

Figure 3:
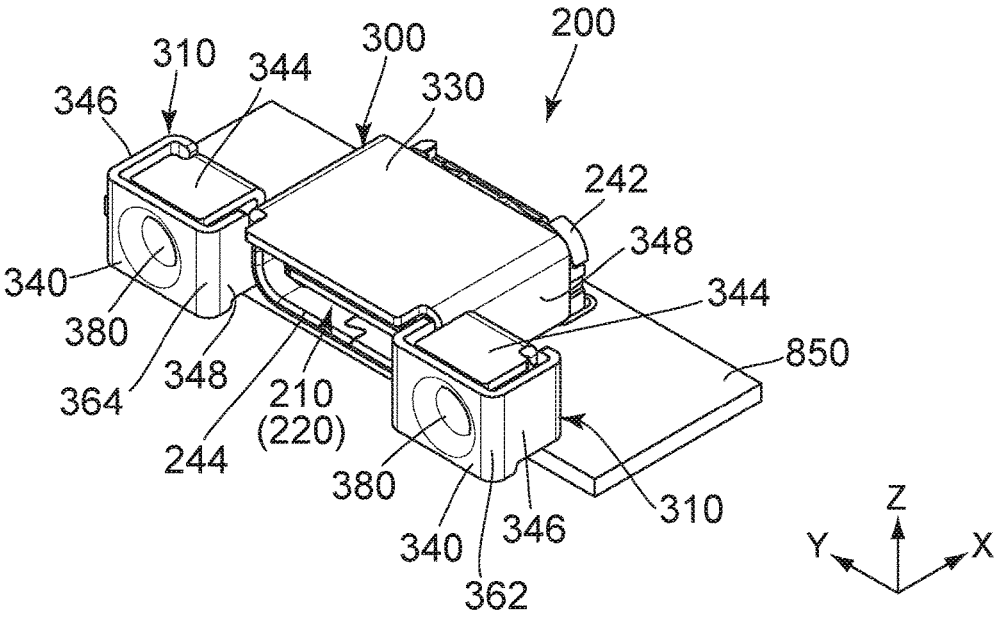
FIG. 3 is a front, perspective view showing the connector of FIG. 1.

As understood from FIGS. 3, 6 and 8, the outer surface portion 346 is positioned outside the accommodation space 320 in the lateral direction and faces outward in the lateral direction. The front outside bent portion 362 connects the front surface portion 340 and the outer surface portion 346 with each other. In the up-down direction, the front outside bent portion 362 has a size same as a size of the front surface portion 340. Accordingly, the front outside bent portion 362 has a resistance to a force which rotates the outer surface portion 346 in a plane perpendicular to the lateral direction. However, the present invention is not limited thereto. In the up-down direction, the front outside bent portion 362 may have a size same as a size of the outer surface portion 346 instead of having a size same as the size of the front surface portion 340.

The inner surface portion 348 is positioned outside the accommodation space 320 in the lateral direction and faces the outer surface portion 346 in the lateral direction. The front inside bent portion 364 connects the inner surface portion 348 and the front surface portion 340 with each other. In the up-down direction, the front inside bent portion 364 has a size same as a size of the front surface portion 340. Accordingly, the front inside bent portion 364 has a resistance to a force which rotates the inner surface portion 348 in a plane perpendicular to the lateral direction. However, the present invention is not limited thereto. In the up-down direction, the front inside bent portion 364 may have a size same as a size of the inner surface portion 348 instead of having a size same as the size of the front surface portion 340.

As shown in FIGS. 3, 4 and 6, the coupling portion 330 is positioned above the shell 244 in the up-down direction and couples the screw end accommodation portions 310 with each other in the lateral direction. Specifically, the coupling portion 330 of the present embodiment couples upper ends of the inner surface portions 348 with each other in the lateral direction.

As described above, the accommodation space 320 shown in FIG. 8 is surrounded by the screw end accommodation portion 310 except for a lower part thereof. In addition, under a state where the connector 200 is mounted on the circuit board 850, the circuit board 850 is partially positioned below each of the accommodation spaces 320. Accordingly, even if foreign bodies enter into the connector 200 from the female screw portions 380 under a state where the connector 200 is not connected with the mating connector 400, the foreign bodies have high probability to stay in the accommodation spaces 320. Thus, foreign bodies can be prevented from entering into an inside of a housing 150 of an electronic equipment (not shown) in which the connector 200 is installed.

Figure 13:
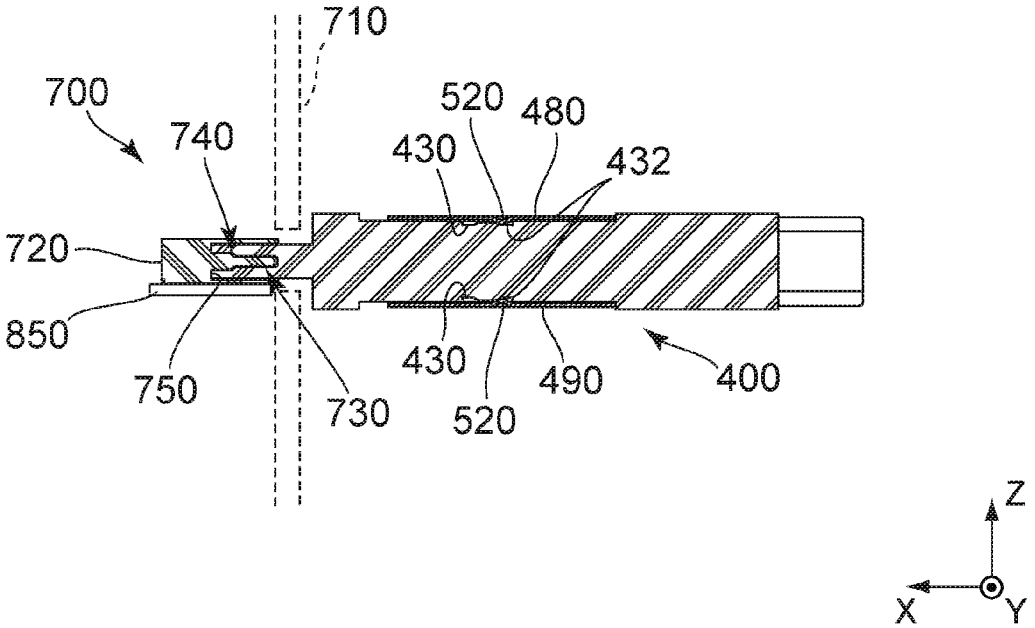
FIG. 13 is a cross-sectional view showing the mating connector and the alternative connecting object of FIG. 12. In order to easily recognize outlines of the mating connector and the alternative connecting object, detailed illustration is omitted in the figure.
Figure 14:
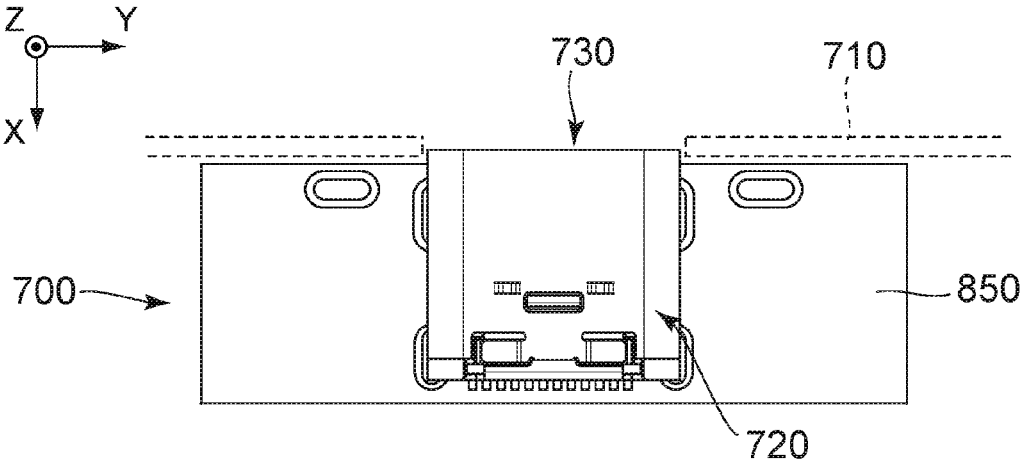
FIG. 14 is a top view showing the alternative connecting object of FIG. 12.
Figure 15:
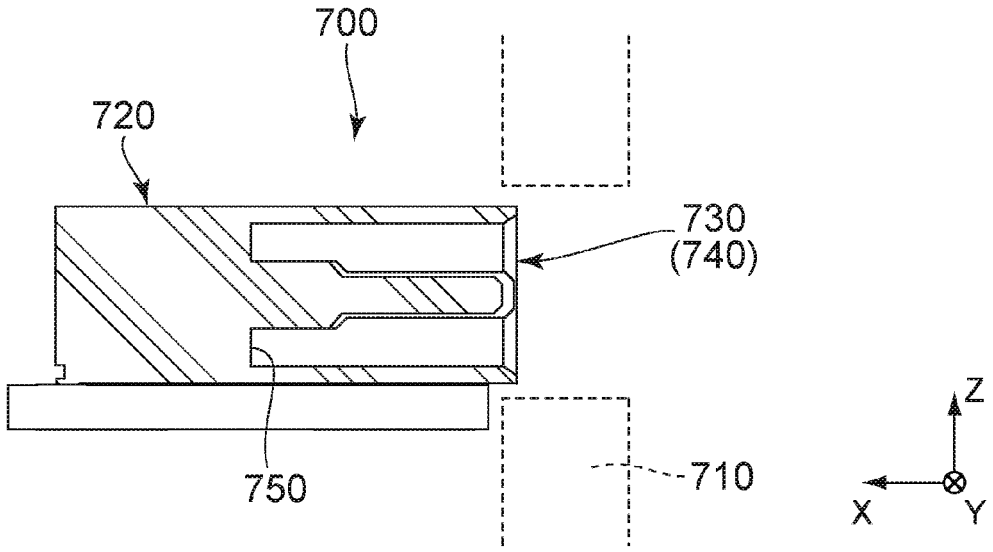
FIG. 15 is a cross-sectional view showing the alternative connecting object of FIG. 14. In order to easily recognize the outline of the alternative connecting object, detailed illustration is omitted in the figure.
Figure 16:
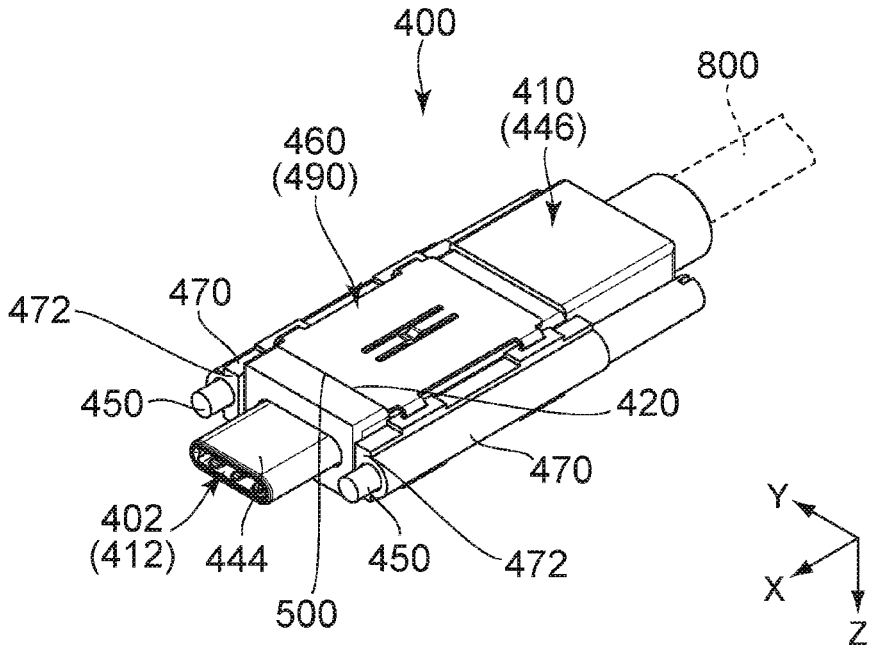
FIG. 16 is a bottom, perspective view showing the mating connector of FIG. 9.

As understood from FIGS. 1, 2, 12 and 13, the mating connector 400 of the present embodiment is connectable not only with the connector 200 of the present embodiment but also with a connecting object having a connector which does not have the female screw portions 380. Hereinafter, the connecting object is referred to as "alternative connecting object 700". Specifically, the alternative connecting object 700 is configured that an alternative connector 720 which corresponds to the connector 200 is arranged in a housing 710 of an electronic equipment (not shown). The alternative connector 720 is a receptacle which is in accordance with the USB Type-C standard and which does not have the female screw portion 380. As shown in FIGS. 13 to 15, the alternative connector 720 comprises an alternative fitting portion 730 having a structure which corresponds to the fitting portion 210 of the connector 200. As shown in FIG. 15, the alternative fitting portion 730 has a receiving portion 740 which has an inner wall 750 in the predetermined direction.

Figure 9:
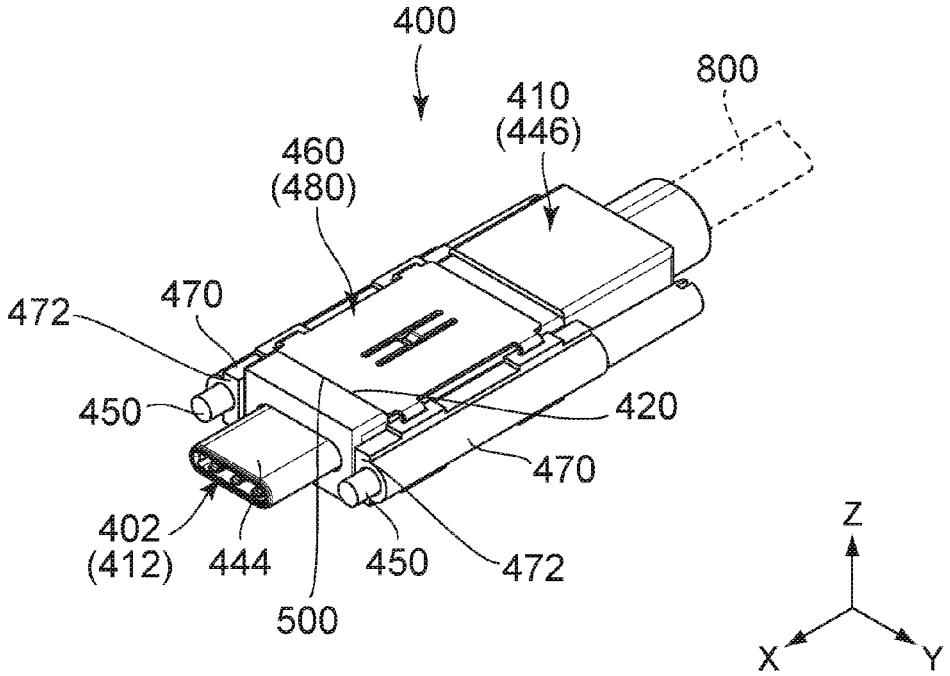
FIG. 9 is a top, perspective view showing the mating connector of FIG. 1.
Figure 10:
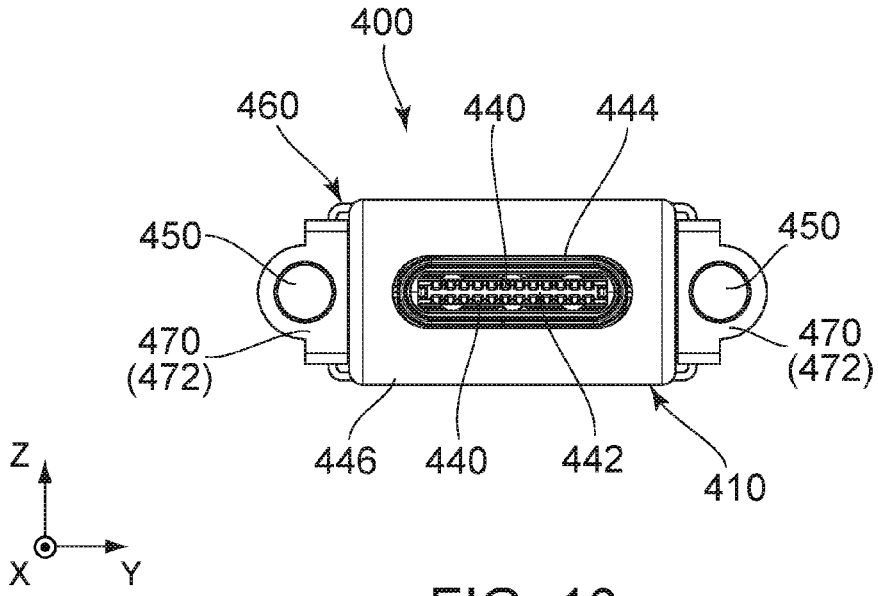
FIG. 10 is a front view showing the mating connector of FIG. 9.
Figure 11:
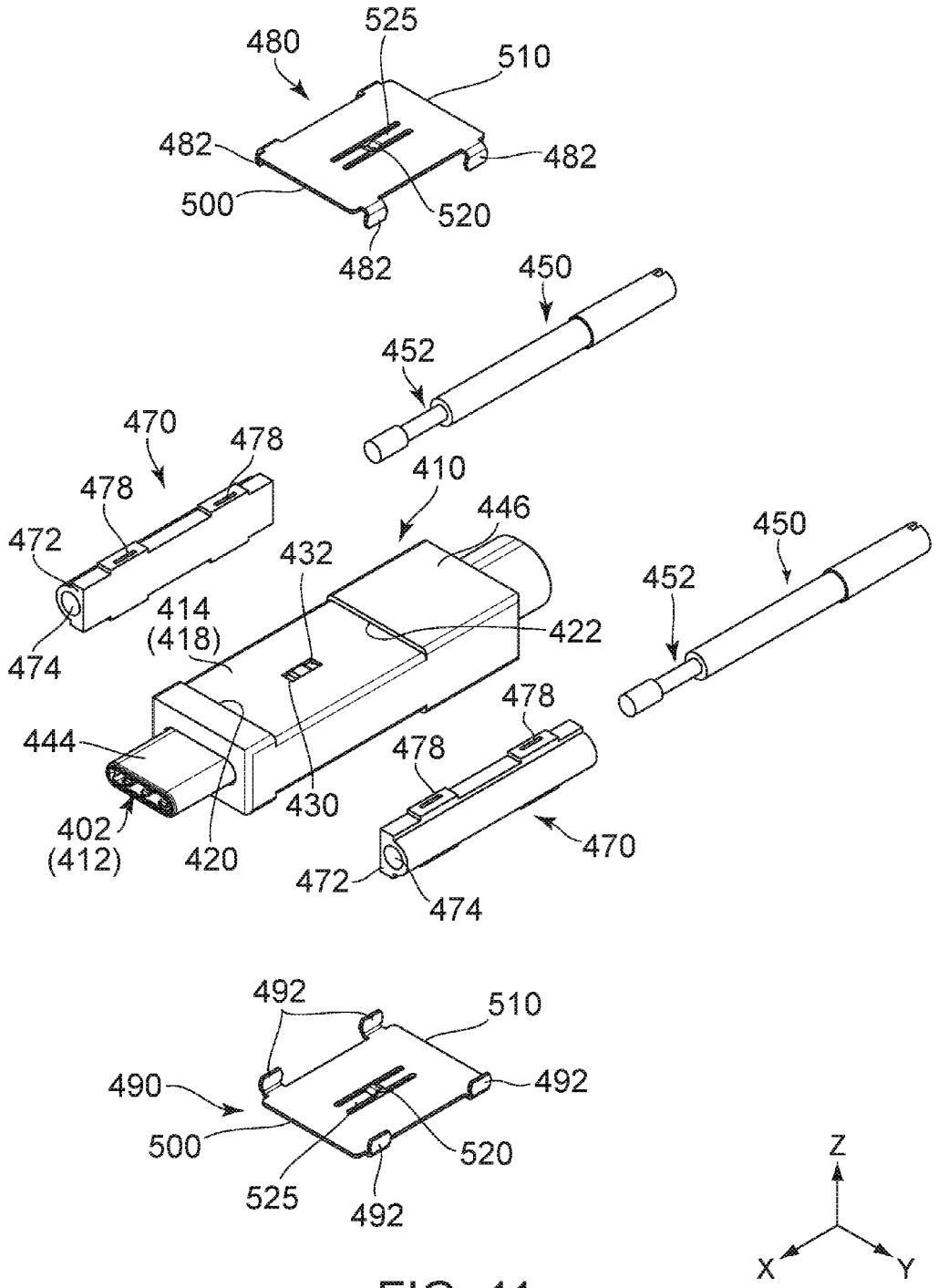
FIG. 11 is an exploded, perspective view showing the mating connector of FIG. 9.
Figure 12:
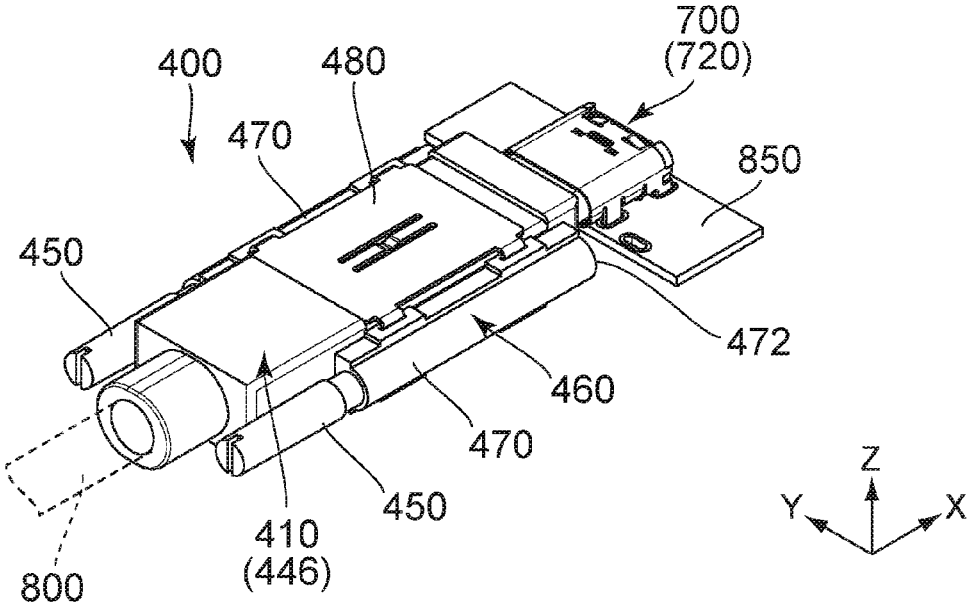
FIG. 12 is a top, perspective view showing the mating connector of FIG. 9 and an alternative connecting object (alternative connector). The illustrated mating connector is connected with the alternative connector.

As shown in FIGS. 9 to 11, the mating connector 400 comprises a mating connector main 410, two male screw members 450 and a screw holding member 460. The mating connector main 410 functions as the mating fitting portion as described above.

As shown in FIG. 10, the mating connector main 410 of the present embodiment is positioned between the two male screw members 450 in the lateral direction. The mating connector main 410 comprises mating contacts 440, a mating holding member 442, a mating shell 444 and a hood 446. As understood from FIGS. 5 and 10, when the mating connector 400 and the connector 200 are connected with each other, the mating contacts 440 are brought into contact with the contacts 240, respectively. As shown in FIG. 10, the mating holding member 442 holds the mating contacts 440. The mating shell 444 surrounds the mating holding member 442. As understood from FIG. 9, an end of the mating shell 444 in the second predetermined orientation is positioned inside the hood 446. A relay board (not shown) or the like, which connects a cable 800 with the mating contacts 440, is accommodated in the hood 446. The cable 800, which is connected to the relay board (not shown), extends from the hood 446 in the second predetermined orientation.

As shown in FIG. 9, an end 412 of the mating connector main 410 forms an end portion 402 of the mating connector 400 in the first predetermined orientation. As understood from FIGS. 1, 12 and 14, the mating connector main 410 is selectively mateable with any of the fitting portion 210 and the alternative fitting portion 730 along the predetermined direction. As understood from FIG. 1, when the mating connector 400 is connected with the connector 200, the mating connector main 410 is partially received in the receiving portion 220 of the fitting portion 210.

Figure 20:
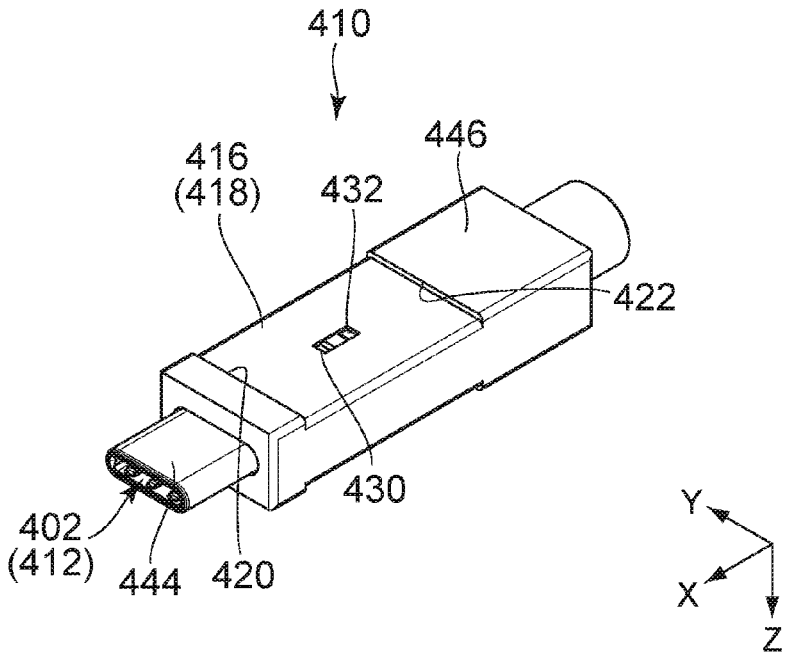
FIG. 20 is a bottom, perspective view showing a mating connector main which is included in the mating connector of FIG. 9.

As shown in FIGS. 11 and 20, each of an upper surface 414 and a lower surface 416 of the mating connector main 410 is provided with a slide surface 418, a first facing portion (facing portion) 420 and a second facing portion 422. The first facing portion 420 is positioned beyond the second facing portion 422 in the first predetermined orientation. The second facing portion 422 is positioned beyond the first facing portion 420 in the second predetermined orientation. However, the present invention is not limited thereto. The slide surface 418, the first facing portion 420 and the second facing portion 422 may be provided on only one of the upper surface 414 and the lower surface 416 of the mating connector main 410. The slide surface 418 is positioned between the first facing portion 420 and the second facing portion 422 in the predetermined direction. The first facing portion 420 is a wall which is positioned at a side of the slide surface 418 in the first predetermined orientation and which stands in the up-down direction. The second facing portion 422 is a wall which is positioned at another side of the slide surface 418 in the second predetermined orientation and which stands in the up-down direction. In the present embodiment, each of the slide surfaces 418, the first facing portions 420 and the second facing portions 422 is formed on the hood 446. In addition, each of the first facing portions 420 functions as a regulated portion as described later.

Each of the upper surface 414 and the lower surface 416 of the mating connector main 410 is provided with a first recess 430 and a second recess 432 which are positioned away from each other in the predetermined direction. The first recess 430 is positioned beyond the second recess 432 in the first predetermined orientation. The second recess 432 is positioned beyond the first recess 430 in the second predetermined orientation. However, the present invention is not limited thereto. The first recess 430 and the second recess 432 may be provided on only one of the upper surface 414 and the lower surface 416 of the mating connector main 410. In the present embodiment, the first recesses 430 and the second recesses 432 are formed on the slide surfaces 418, respectively, of the hood 446.

As understood from FIGS. 9 and 11, the screw holding member 460 is attached to the mating connector main 410. As shown in FIGS. 9 and 16 to 19, the screw holding member 460 is relatively movable with respect to the mating connector main 410 along the predetermined direction between a first predetermined position and a second predetermined position. The first predetermined position is positioned beyond the second predetermined position in the first predetermined orientation. The second predetermined position is positioned beyond the first predetermined position in the second predetermined orientation.

In detail, as shown in FIG. 11, the screw holding member 460 of the present embodiment comprises two screw accommodation members 470, an upper movable member 480 and a lower movable member 490. As understood from FIGS. 9 and 11, each of the upper movable member 480 and the lower movable member 490 couples the two screw accommodation members 470 with each other in the lateral direction. Each of the upper movable member 480 and the lower movable member 490 of the present embodiment principally has a plate-like shape. The upper movable member 480 of the present embodiment is provided with press-fit pieces 482 at opposite ends thereof in the lateral direction. The lower movable member 490 of the present embodiment is provided with press-fit pieces 492 at opposite ends thereof in the lateral direction. Each of the screw accommodation members 470 is provided with press-fit ditches 478. The press-fit pieces 482, 492 are press-fit into the press-fit ditches 478, respectively. Accordingly, the two screw accommodation members 470 are coupled by each of the upper movable member 480 and the lower movable member 490. As understood from FIGS. 1 and 16, the upper movable member 480 and the lower movable member 490 sandwich the mating connector main 410 in the up-down direction. The upper movable member 480 is movable on the upper surface 414 of the mating connector main 410 in the predetermined direction. The lower movable member 490 is movable on the lower surface 416 of the mating connector main 410 in the predetermined direction. As understood from FIGS. 9, 11, 16 and 20, specifically, the upper movable member 480 is slidable in the predetermined direction on the slide surface 418 which is positioned on an upper side of the mating connector main 410 in the up-down direction, and the lower movable member 490 is slidable in the predetermined direction on the slide surface 418 which is positioned on a lower side of the mating connector main 410 in the up-down direction.

As shown in FIG. 11, each of the upper movable member 480 and the lower movable member 490 has a first abutment portion (abutment portion) 500 and a second abutment portion 510. The first abutment portion 500 is positioned beyond the second abutment portion 510 in the first predetermined orientation. The second abutment portion 510 is positioned beyond the first abutment portion 500 in the second predetermined orientation. However, the present invention is not limited thereto. The first abutment portion (abutment portion) 500 and the second abutment portion 510 may be provided on only one of the upper movable member 480 and the lower movable member 490. As understood from FIGS. 9 and 16 to 19, in the present embodiment, the first abutment portions (abutment portions) 500 face the first facing portions 420, respectively, in the predetermined direction. Each of the first abutment portions (abutment portions) 500 is positioned beyond the corresponding first facing portion 420 in the second predetermined orientation. The second abutment portions 510 face the second facing portions 422, respectively, in the predetermined direction. Each of the second abutment portions 510 is positioned beyond the corresponding second facing portion 422 in the first predetermined orientation. Accordingly, each of the first facing portions 420 regulates a movement of the corresponding first abutment portion (abutment portion) 500 beyond the first facing portion 420 in the first predetermined orientation of the predetermined direction. Similarly, each of the second facing portions 422 regulates a movement of the corresponding second abutment portion 510 beyond the second facing portion 422 in the second predetermined orientation of the predetermined direction.

As understood from above, the first abutment portions (abutment portions) 500 of the present embodiment function as regulating portions which correspond to the first facing portions (regulated portions) 420, respectively. In detail, each of the first abutment portions (abutment portions) 500 is arranged to be positioned beyond the corresponding first facing portion (regulated portion) 420 in the second predetermined orientation and faces the corresponding first facing portion (regulated portion) 420 in the predetermined direction. Accordingly, each of the first abutment portions (abutment portions) 500 regulates a movement of the corresponding first facing portion (regulated portion) 420 beyond the regulating portion in the second predetermined orientation of the predetermined direction. In other words, the screw holding member 460 of the present embodiment is provided with the regulating portions each of which is arranged to be positioned beyond the corresponding regulated portion in the second predetermined orientation of the predetermined direction and each of which faces the corresponding regulated portion in the predetermined direction. Each of the regulating portions regulates a movement of the corresponding regulated portion beyond the regulating portion in the second predetermined orientation of the predetermined direction.

Figure 21:
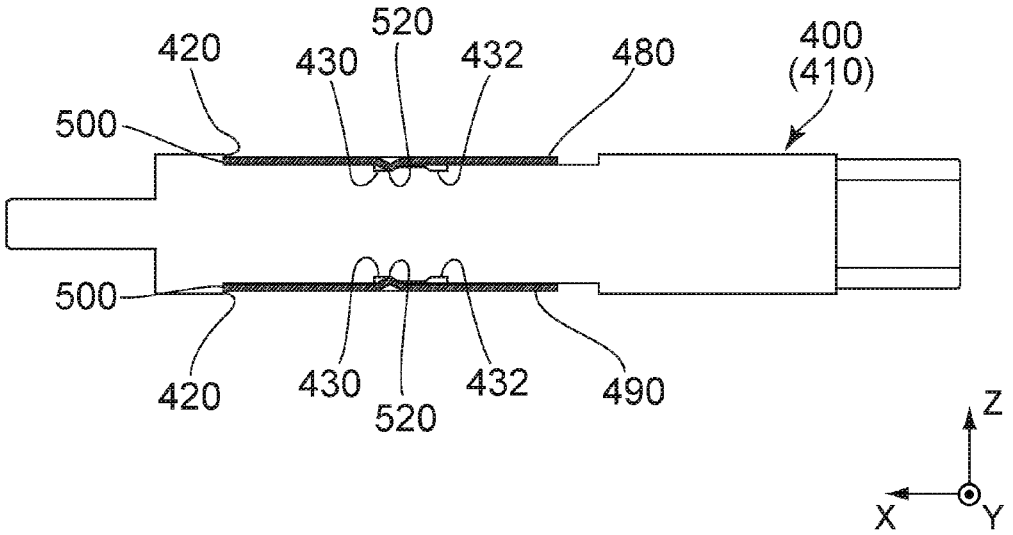
FIG. 21 is a view showing a positional relationship among each of first recesses, each of second recesses and each of positioning projections which are included in the mating connector of FIG. 9. The positioning projections are accommodated in the first recesses, respectively.

As shown in FIG. 11, each of the upper movable member 480 and the lower movable member 490 has a spring portion 525 and a positioning projection 520. However, the present invention is not limited thereto. the spring portion 525 and the positioning projection 520 may be provided on only one of the upper movable member 480 and the lower movable member 490. The spring portion 525 is resiliently deformable and supports the positioning projection 520. The positioning projection 520 projects inward in the up-down direction. The positioning projection 520 is movable in the up-down direction by using resilience of the spring portion 525. As understood from FIGS. 21 and 22, the positioning projections 520 correspond to the first recesses 430 and the second recesses 432, respectively, and each of the positioning projections 520 of the present embodiment rides over a section between the corresponding first recess 430 and the corresponding second recess 432 by using resilience of the spring portion 525 to be accommodated in any of the corresponding first recess 430 and the corresponding second recess 432. Accordingly, each of the positioning projections 520 relatively positions the screw holding member 460 with respect to the mating connector main 410 in the predetermined direction.

As understood from FIGS. 9, 16, 17 and 21, in the present embodiment, when the screw holding member 460 is positioned at the first predetermined position, each of the first abutment portions (abutment portions) 500 abuts against the corresponding first facing portion 420 while each of the positioning projections 520 is accommodated in the corresponding first recess 430. In other words, pairs, each consisting of the first abutment portion (abutment portion) 500 and the first facing portion 420, and pairs each consisting of the positioning projection 520 and the first recess 430 define the first predetermined position. However, the present invention is not limited thereto. The first predetermined position may be defined only by the pairs of the first abutment portion (abutment portion) 500 and the first facing portion 420. In addition the first predetermined position may be defined only by the pairs of the positioning projection 520 and the first recess 430. Furthermore, the first predetermined position may be defined by other means.

Figure 18:
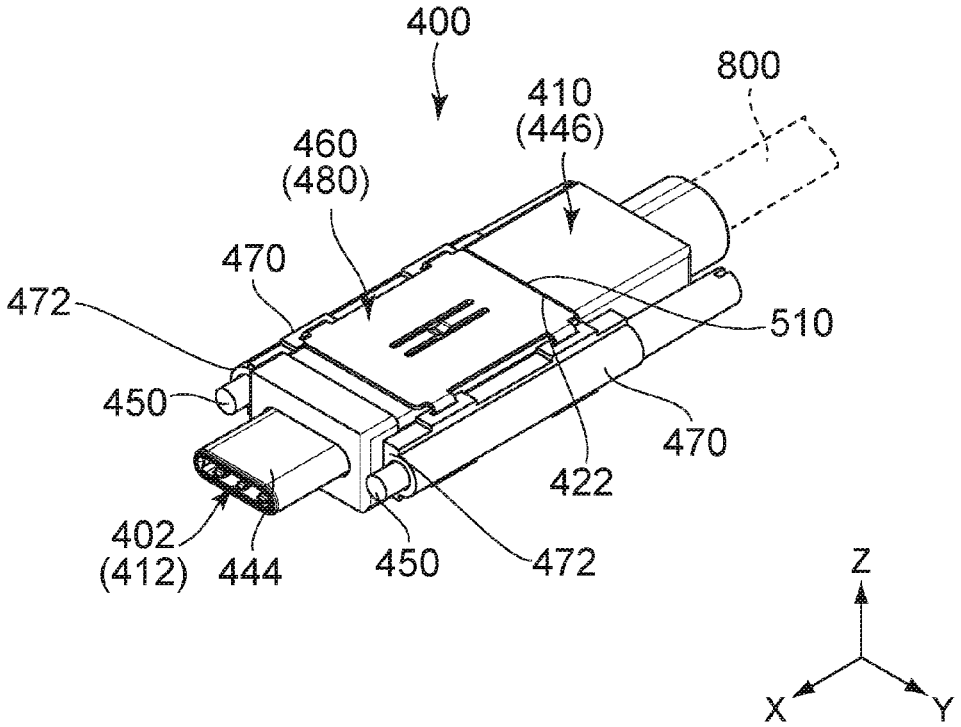
FIG. 18 is yet another top, perspective view showing the mating connector of FIG. 9.
Figure 19:
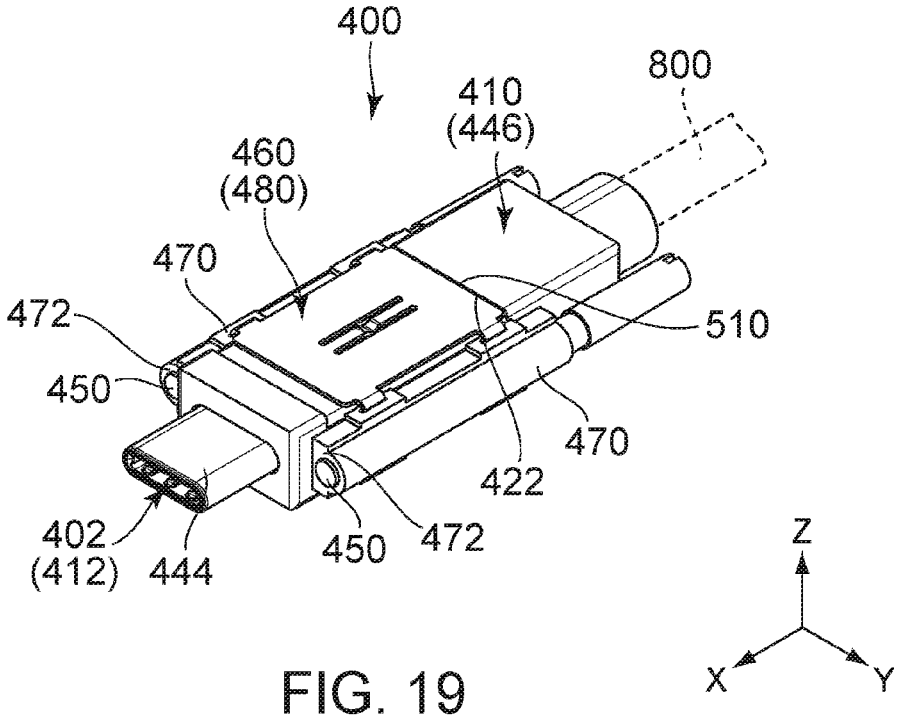
FIG. 19 is still another top, perspective view showing the mating connector of FIG. 9.
Figure 22:
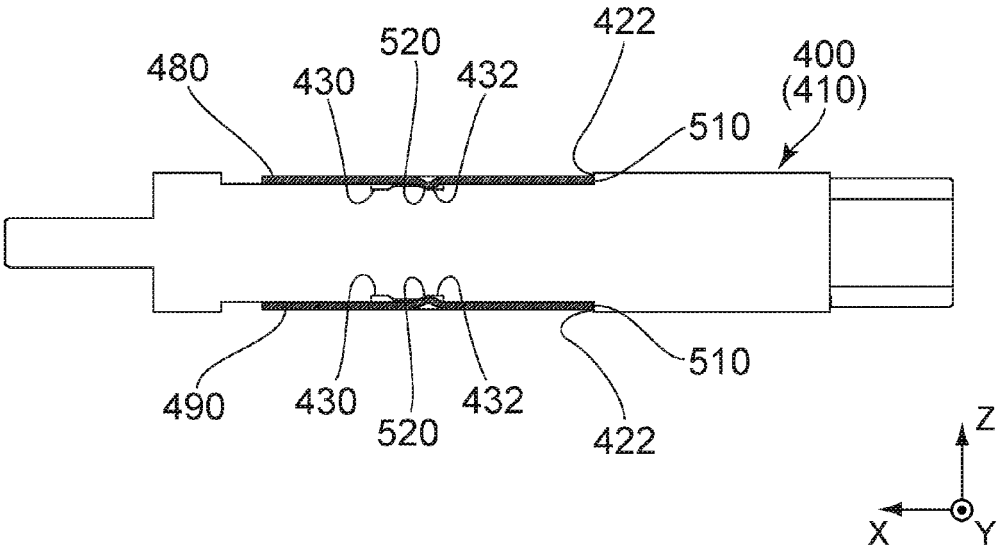
FIG. 22 is a view showing another positional relationship among each of the first recesses, each of the second recesses and each of the positioning projections which are included in the mating connector of FIG. 9. The positioning projections are accommodated in the second recesses, respectively.

As understood from FIGS. 18, 19 and 22, in the present embodiment, when the screw holding member 460 is positioned at the second predetermined position, each of the second abutment portions 510 abuts against the corresponding second facing portion 422 while each of the positioning projections 520 is accommodated in the corresponding second recess 432. In other words, pairs, each consisting of the second abutment portion 510 and the second facing portion 422, and pairs each consisting of the positioning projection 520 and the second recess 432 define the second predetermined position. However, the present invention is not limited thereto. The second predetermined position may be defined only by the pairs of the second abutment portion 510 and the second facing portion 422. In addition, the second predetermined position may be defined only by the pairs of the positioning projection 520 and the second recess 432. Furthermore, the second predetermined position may be defined by other means.

Figure 23:
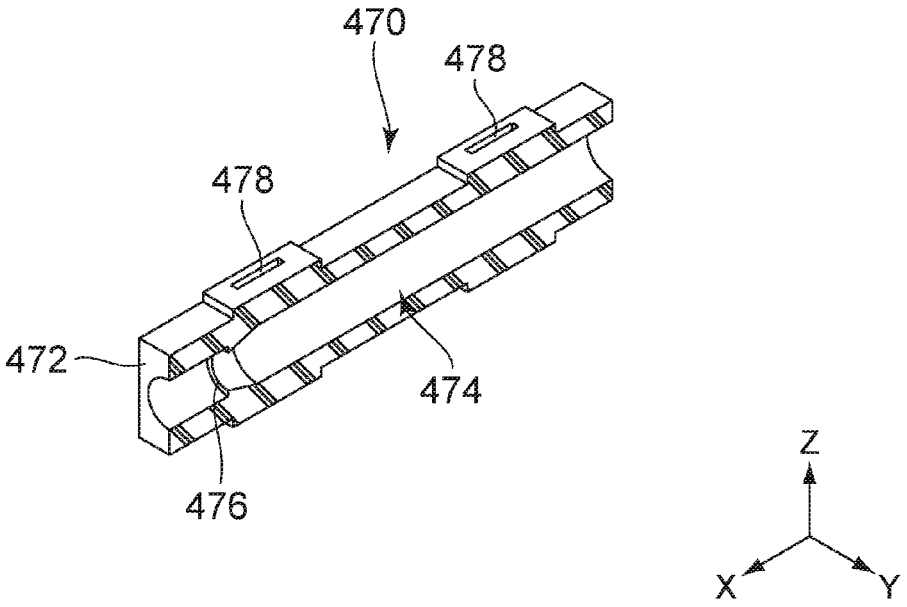
FIG. 23 is a cross-sectional, perspective view showing a screw accommodation member which is included in the mating connector of FIG. 9.

As understood from FIGS. 9, 11, 24 and 25, the screw accommodation members 470 partially accommodate the male screw members 450, respectively, and each of the screw accommodation members 470 holds the corresponding male screw member 450. As shown in FIG. 23, in detail, each of the screw accommodation members 470 is provided with a male screw seat 472, an accommodation portion 474 and a projection 476. As understood from FIGS. 1 and 2, the male screw seat 472 is a surface which is brought into contact with the female screw seat when the male screw member 450 is connected with the female screw portion 380. As shown in FIG. 23, each of the male screw seats 472 of the present embodiment is an end surface of the screw holding member 460 which faces in the first predetermined orientation. The accommodation portion 474 extends in the predetermined direction and partially accommodates the male screw member 450. The projection 476 projects into the accommodation portion 474 in a plane perpendicular to the predetermined direction.

Figure 17:
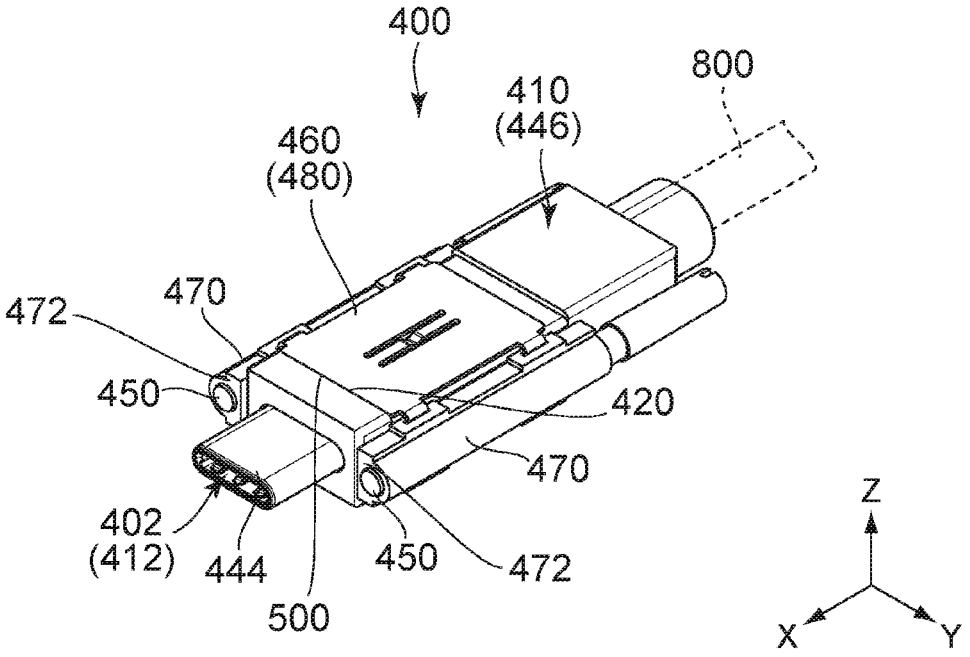
FIG. 17 is another top, perspective view showing the mating connector of FIG. 9.
Figure 24:
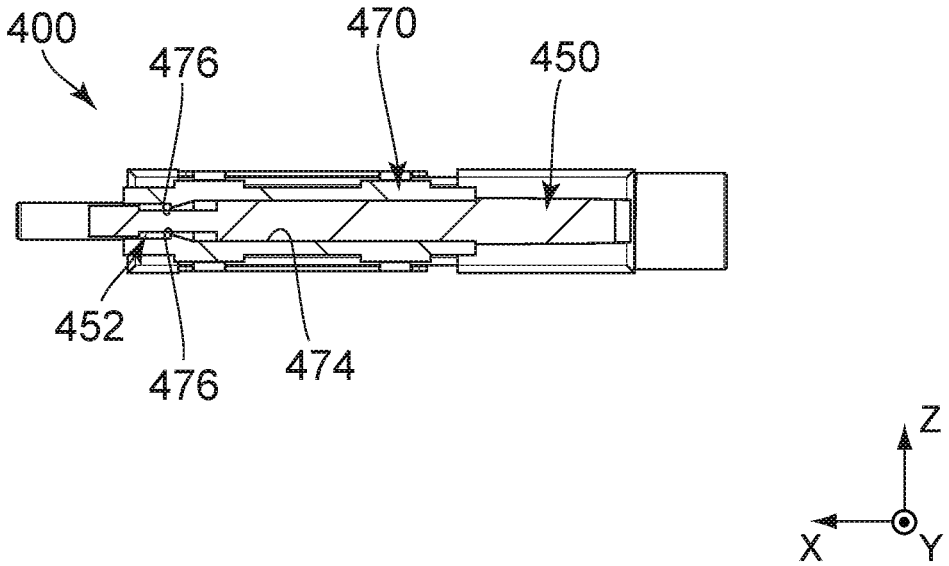
FIG. 24 is a view showing a positional relationship between a male screw member and the screw accommodation member which are included in the mating connector of FIG. 9.
Figure 25:
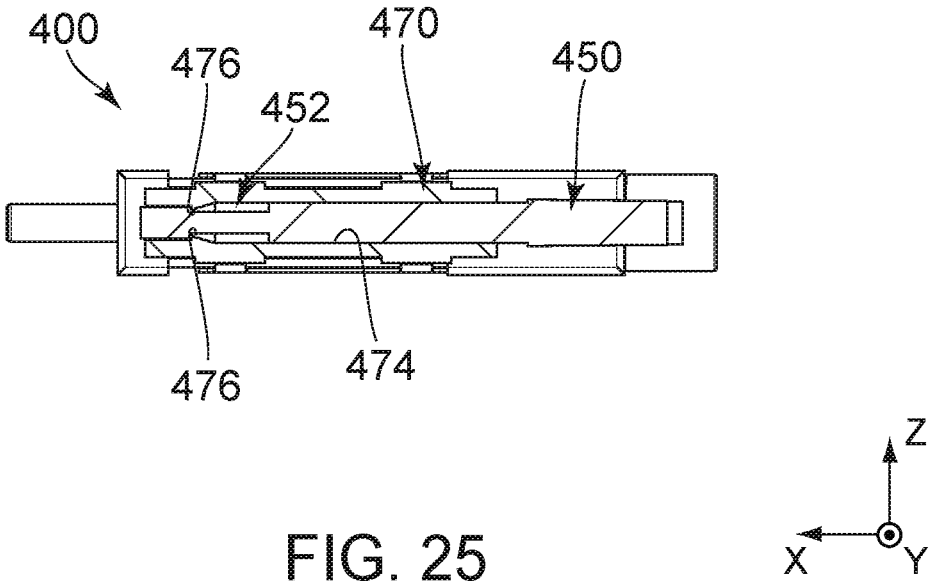
FIG. 25 is a view showing another positional relationship between the male screw member and the screw accommodation member which are included in the mating connector of FIG. 9.

As understood from FIGS. 9 and 17, in the present embodiment, each of the male screw members 450 is relatively movable with respect to the screw holding member 460 along the predetermined direction. As shown in FIG. 11, in detail, each of the male screw members 450 is formed with a recess 452 which is recessed in a direction perpendicular to the predetermined direction. As shown in FIGS. 24 and 25, the projection 476 is accommodated in the recess 452 under a state where the male screw member 450 is partially accommodated in the accommodation portion 474. In the predetermined direction, the recess 452 has a size far greater than a size of the projection 476. Accordingly, as shown in FIGS. 9 and 17, each of the male screw members 450 is relatively movable with respect to the screw holding member 460 along the predetermined direction. Thus, a distance by which the male screw member 450 is movable can be totally increased.

In the present embodiment, the first predetermined position and the second predetermined position are arranged to satisfy the following conditions: [condition 1] when the screw holding member 460 is positioned at the first predetermined position, the end 412 of the mating connector main 410 faces the inner wall 230 of the fitting portion 210 of the connector 200 but does not reach the inner wall 230 under a state where the male screw member 450 is connected with the female screw portion 380 and where the male screw seat 472 is brought into contact with the female screw seat; and [condition 2] when the screw holding member 460 is positioned at the second predetermined position, the end 412 of the mating connector main 410 is able to reach the inner wall 750 of the alternative fitting portion 730 under a state where the mating connector 400 is connected with the alternative connecting object 700. In other words, when the end 412 of the mating connector main 410 reaches the inner wall 750 of the alternative fitting portion 730 under the state where the mating connector 400 is connected with the alternative connecting object 700, the screw holding member 460 may be positioned at the second predetermined position or may be positioned beyond the second predetermined position in the first predetermined orientation while not reaching the second predetermined position.

Under the condition 1, a distance between the end 412 of the mating connector main 410 and the inner wall 230 of the fitting portion 210 of the connector 200 is arranged so that the end 412 of the mating connector main 410 does not just reach the inner wall 230 of the fitting portion 210 of the connector 200 under a state where each of the mating connector 400 and the connector 200 has maximum tolerance. Accordingly, even if each of the mating connector 400 and the connector 200 has maximum tolerance, the end 412 of the mating connector main 410 can be prevented from applying unnecessary stress to the inner wall 230 of the fitting portion 210 of the connector 200.

The condition 2 enables the end 412 of the mating connector main 410 to securely reach the inner wall 750 of the alternative fitting portion 730. In other words, the mating connector 400 and the alternative connector (receptacle) 720 which is included in the alternative connecting object 700 can be properly connected with each other.

As described above, the mating connector 400 of the present embodiment is provided with the regulating portions and the regulated portions. Accordingly, even if the cable 800 connected to the mating connector 400 is pulled in the second predetermined orientation under a state where the male screw members 450 are connected with the female screw portions 380, respectively, the mating connector main 410 can be prevented from being removed from the screw holding member 460.

The structure of the mating connector 400 is not limited thereto. For example, the mating connector 400 can be modified as described below.

Figure 28:
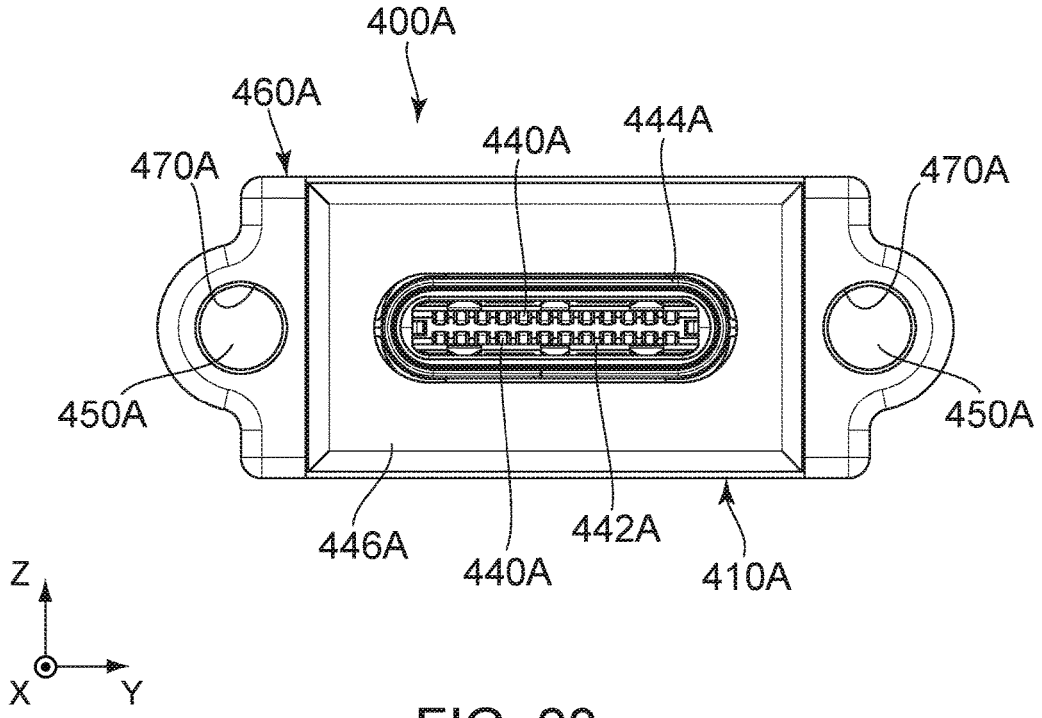
FIG. 28 is a front view showing the mating connector of FIG. 26.

As shown in FIGS. 26 to 30, the mating connector 400A according to a first modification comprises a mating connector main 410A, two male screw members 450A and a screw holding member 460A. The mating connector main 410A of the present modification is positioned between the two male screw members 450A in the lateral direction. As shown in FIG. 28, the mating connector main 410A comprises mating contacts 440A, a mating holding member 442A, a mating shell 444A and a hood 446A similar to the first embodiment. Specifically, the mating holding member 442A holds the mating contacts 440A, and the mating shell 444A covers the mating holding member 442A. Explanation about those components is omitted.

Figure 29:
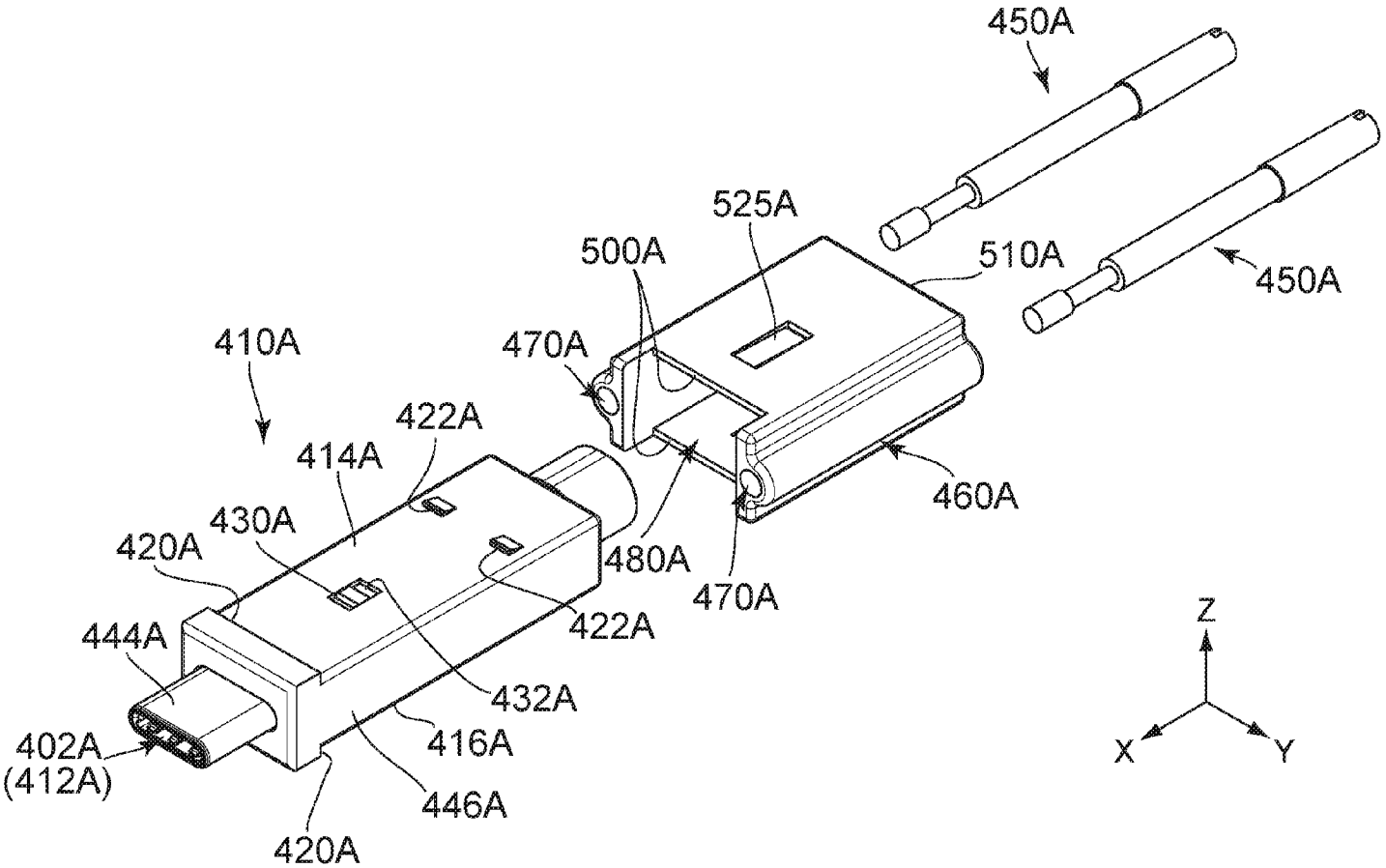
FIG. 29 is an exploded, perspective view showing the mating connector of FIG. 26.
Figure 30:
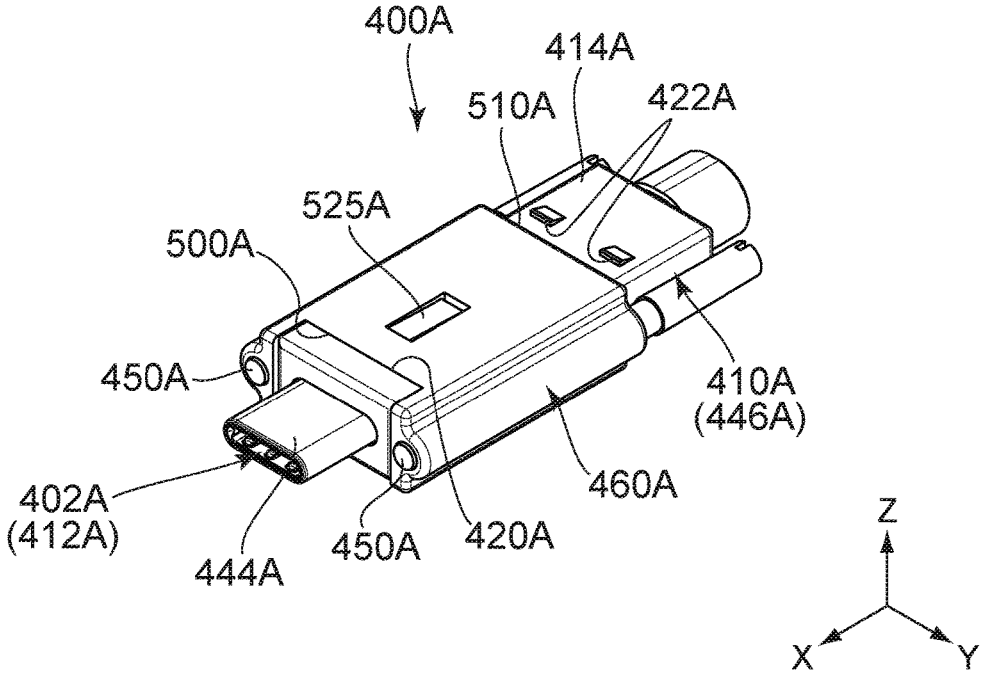
FIG. 30 is another top, perspective view showing the mating connector of FIG. 26.
Figure 31:
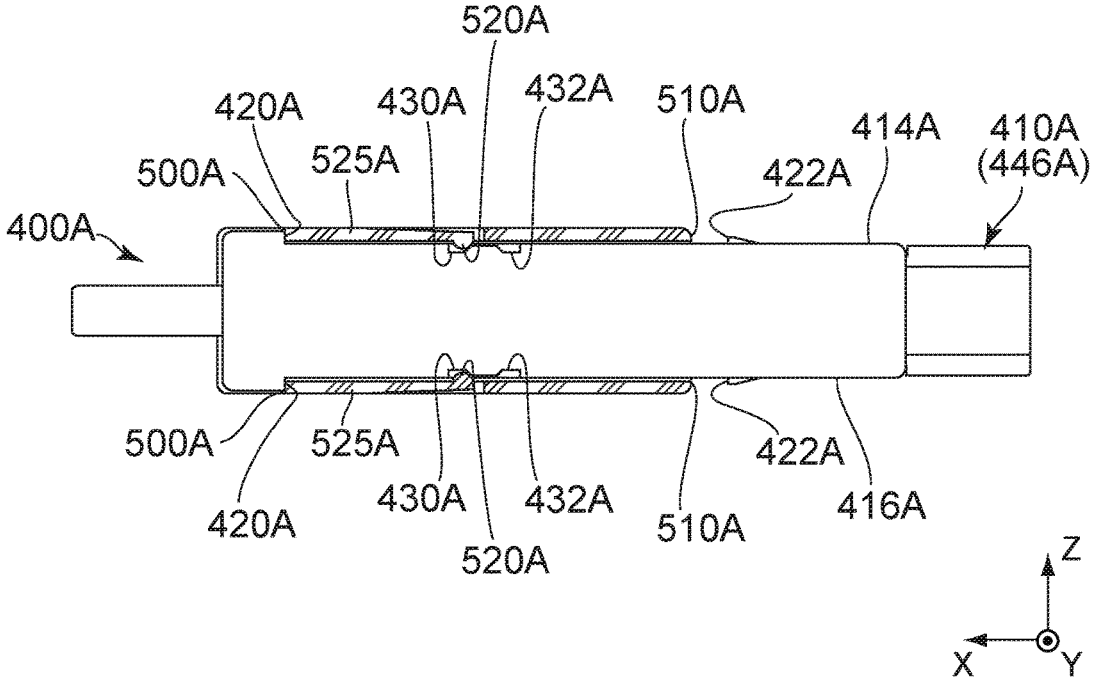
FIG. 31 is a view showing a positional relationship among each of first recesses, each of second recesses and each of positioning projections which are included in the mating connector of FIG. 30. The positioning projections are accommodated in the first recesses, respectively.
Figure 33:
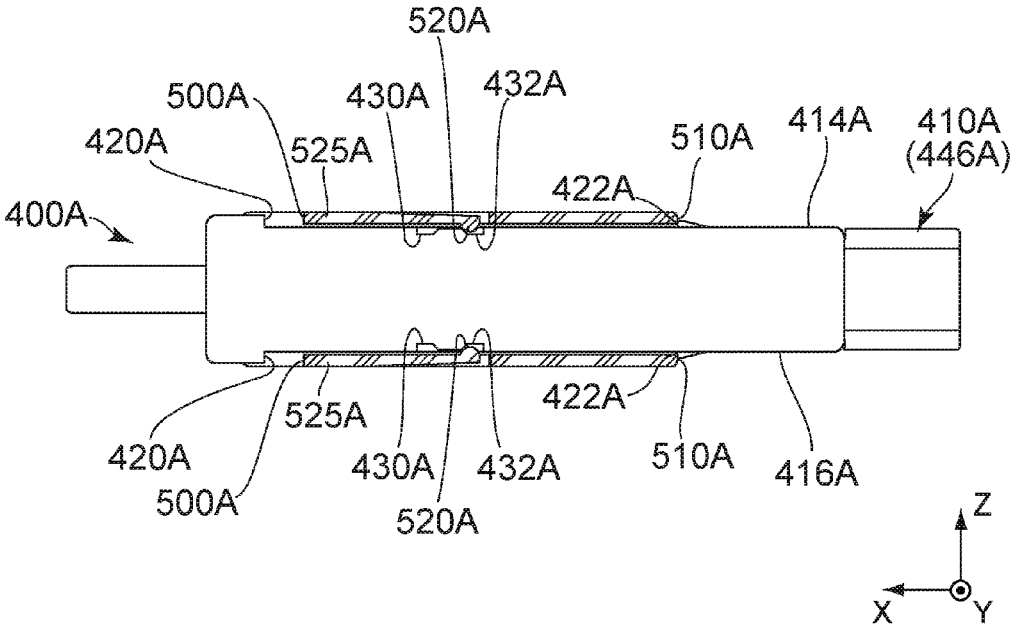
FIG. 33 is a view showing another positional relationship among each of the first recesses, each of the second recesses and each of the positioning projections which are included in the mating connector of FIG. 32. The positioning projections are accommodated in the second recesses, respectively.

As understood from FIGS. 29, 31 and 33, each of an upper surface 414A and a lower surface 416A of the mating connector main 410A is provided with a first facing portion 420A and second facing portions 422A. The first facing portion 420A is positioned beyond the second facing portions 422A in the first predetermined orientation. Each of the second facing portions 422A is positioned beyond the first facing portion 420A in the second predetermined orientation. However, the present invention is not limited thereto. The first facing portion 420A and the second facing portions 422A may be provided on only one of the upper surface 414A and the lower surface 416A of the mating connector main 410A. In the present modification, each of the first facing portions 420A and the second facing portions 422A is formed on the hood 446A. In the present embodiment, each of the first facing portions 420A is a wall which is positioned at a side of the hood 446A in the first predetermined orientation and which stands in the up-down direction, and each of the second facing portions 422A is a projection which projects in the up-down direction. Each of the first facing portions 420A functions as a regulated portion as described later.

Furthermore, each of the upper surface 414A and the lower surface 416A of the mating connector main 410A is provided with a first recess 430A and a second recess 432A which are positioned away from each other in the predetermined direction. The first recess 430A is positioned beyond the second recess 432A in the first predetermined orientation, and the second recess 432A is positioned beyond the first recess 430A in the second predetermined orientation. However, the present invention is not limited thereto. The first recess 430A and the second recess 432A may be provided on only one of the upper surface 414A and the lower surface 416A of the mating connector main 410A. In the present modification, each of the first recesses 430A and the second recesses 432A is formed on the hood 446A.

The screw holding member 460A is attached to the mating connector main 410A and is relatively movable with respect to the mating connector main 410A along the predetermined direction between a first predetermined position and a second predetermined position. The first predetermined position is positioned beyond the second predetermined position in the first predetermined orientation, and the second predetermined position is positioned beyond the first predetermined position in the second predetermined orientation.

Figure 26:
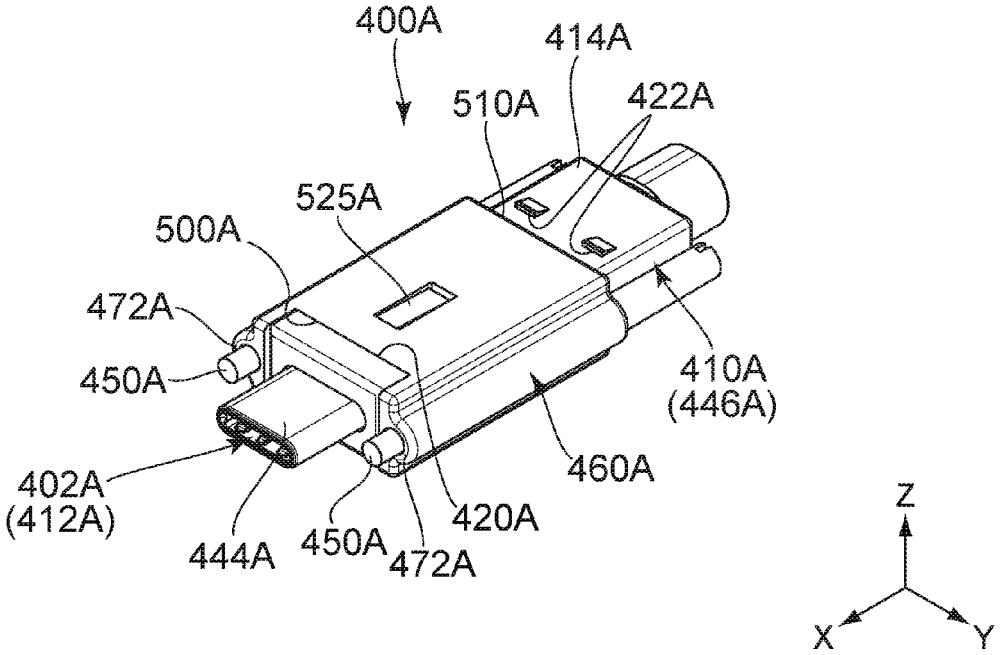
FIG. 26 is a top, perspective view showing a mating connector according to a first modification.
Figure 27:
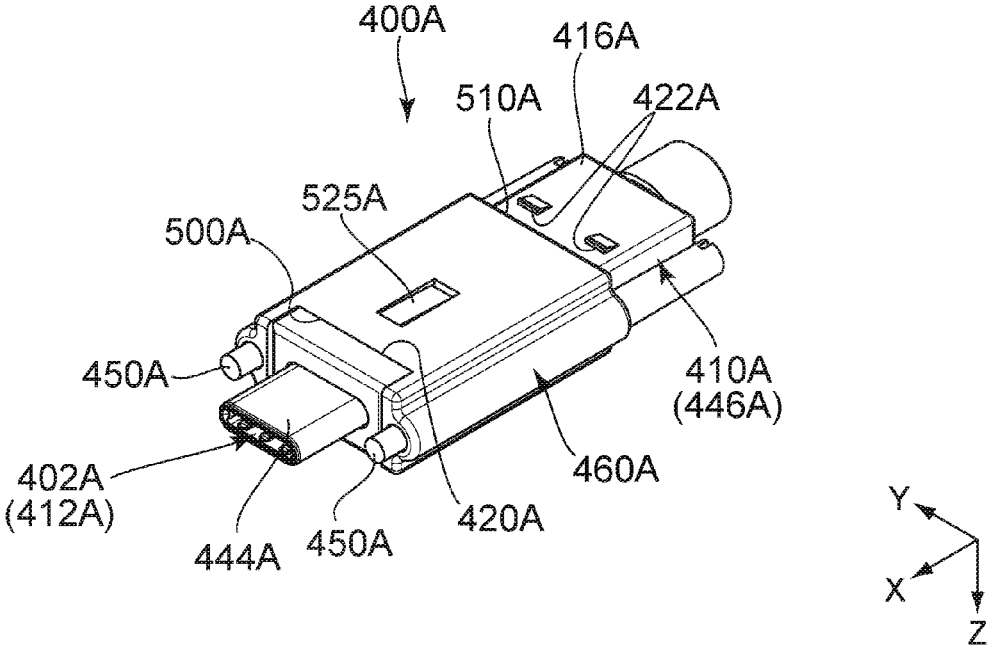
FIG. 27 is a bottom, perspective view showing the mating connector of FIG. 26.

As shown in FIG. 29, in detail, the screw holding member 460A of the present modification is formed with two side accommodation portions 470A and a center accommodation portion 480A. Each of the side accommodation portions 470A and the center accommodation portion 480A pierces the screw holding member 460A in the predetermined direction. As shown in FIG. 26, each of the side accommodation portions 470A is provided with a male screw seat 472A. As understood from FIGS. 1, 2 and 26, the male screw seat 472A is a surface which is brought into contact with the female screw seat when the male screw member 450A is connected with the female screw portion 380. As shown in FIG. 26, the male screw seat 472A of the present embodiment is an end surface of the screw holding member 460A which faces in the first predetermined orientation. As understood from FIGS. 26 and 29, the side accommodation portions 470A partially accommodate the male screw members 450A, respectively. Each of the side accommodation portions 470A accommodates the corresponding male screw member 450A in a manner similar to a manner in which the screw accommodation member 470 of the aforementioned first embodiment accommodates the male screw member 450. The center accommodation portion 480A is positioned between the side accommodation portions 470A in the lateral direction and partially accommodates the mating connector main 410A so as to be movable in the predetermined direction.

As understood from FIGS. 29, 31 and 33, the screw holding member 460A is provided with two pairs each consisting of the first abutment portion (abutment portion) 500A and the second abutment portion 510A. Each of the first abutment portions 500A is positioned beyond the second abutment portion 510A paired therewith in the first predetermined orientation, and each of the second abutment portions 510A is positioned beyond the first abutment portion 500A paired therewith in the second predetermined orientation. The first abutment portion (abutment portion) 500A and the second abutment portion 510A of each pair are edge portions of the center accommodation portion 480A. The first abutment portion (abutment portion) 500A of each pair is an edge portion of the screw holding member 460A in the first predetermined orientation. The second abutment portion 510A of each pair is another edge portion of the screw holding member 460A in the second predetermined orientation. The first abutment portions (abutment portions) 500A are positioned at opposite sides, respectively, of the screw holding member 460A in the up-down direction. The second abutment portions 510A are positioned at opposite sides, respectively, of the screw holding member 460A in the up-down direction. However, the present invention is not limited thereto. The first abutment portion (abutment portion) 500A and the second abutment portion 510A may be provided on only one of an upper side and a lower side of the center accommodation portion 480A. The first abutment portions (abutment portions) 500A face the first facing portions 420A, respectively, in the predetermined direction. Each of the first abutment portions (abutment portions) 500A is positioned beyond the corresponding first facing portion 420A in the second predetermined orientation. The second abutment portions 510A face the second facing portions 422A, respectively, in the predetermined direction. Each of the second abutment portions 510A is positioned beyond the corresponding second facing portion 422A in the first predetermined orientation. Accordingly, each of the first facing portions 420A regulates a movement of the corresponding first abutment portion 500A in the first predetermined orientation of the predetermined direction beyond the first facing portion 420A, and each of the second facing portions 422 A regulates a movement of the corresponding second abutment portion 510A beyond the second facing portion 422A in the second predetermined orientation of the predetermined direction. As understood from above, the first abutment portions (abutment portions) 500A of the present modification function as regulating portions which correspond to the first facing portions (regulated portions) 420A, respectively.

Furthermore, the screw holding member 460A has two pairs each consisting of a spring portion 525A and a positioning projection 520A. The two pairs of the spring portion 525 and the positioning projection 520A are formed on opposite sides, respectively, of the screw holding member 460A in the up-down direction. However, the present invention is not limited thereto. The spring portion 525A and the positioning projection 520A may be provided on only one of an upper side and a lower side of the screw holding member 460A. Each of the spring portions 525A is resiliently deformable and supports the positioning projection 520A paired therewith. Each of the positioning projections 520A projects inside the center accommodation portion 480A in the up-down direction. Each of the positioning projections 520A is movable in the up-down direction by using resilience of the spring portion 525A paired therewith. The positioning projections 520A correspond to the first recesses 430A and the second recesses 432A, respectively. Each of the positioning projections 520A of the present modification rides over a section between the corresponding first recess 430A and the corresponding second recess 432A by using resilience of the spring portion 525A paired therewith to be accommodated in any of the corresponding first recess 430A and the corresponding second recess 432A. Accordingly, each of the positioning projections 520A relatively positions the screw holding member 460A with respect to the mating connector main 410A in the predetermined direction.

As understood from FIGS. 26, 27, 30 and 31, in the present modification, when the screw holding member 460A is positioned at the first predetermined position, each of the first abutment portions (abutment portions) 500A abuts against the corresponding first facing portion 420A while each of the positioning projections 520A is accommodated in the corresponding first recess 430A. In other words, pairs, each consisting of the first abutment portion (abutment portion) 500A and the first facing portion 420A, and pairs each consisting of the positioning projection 520A and the first recess 430A define the first predetermined position. However, the present invention is not limited thereto. The first predetermined position may be defined only by the pairs of the first abutment portion (abutment portion) 500A and the first facing portion 420A. In addition, the first predetermined position may be defined only by the pairs of the positioning projection 520A and the first recess 430A. Furthermore, the first predetermined position may be defined by other means.

Figure 32:
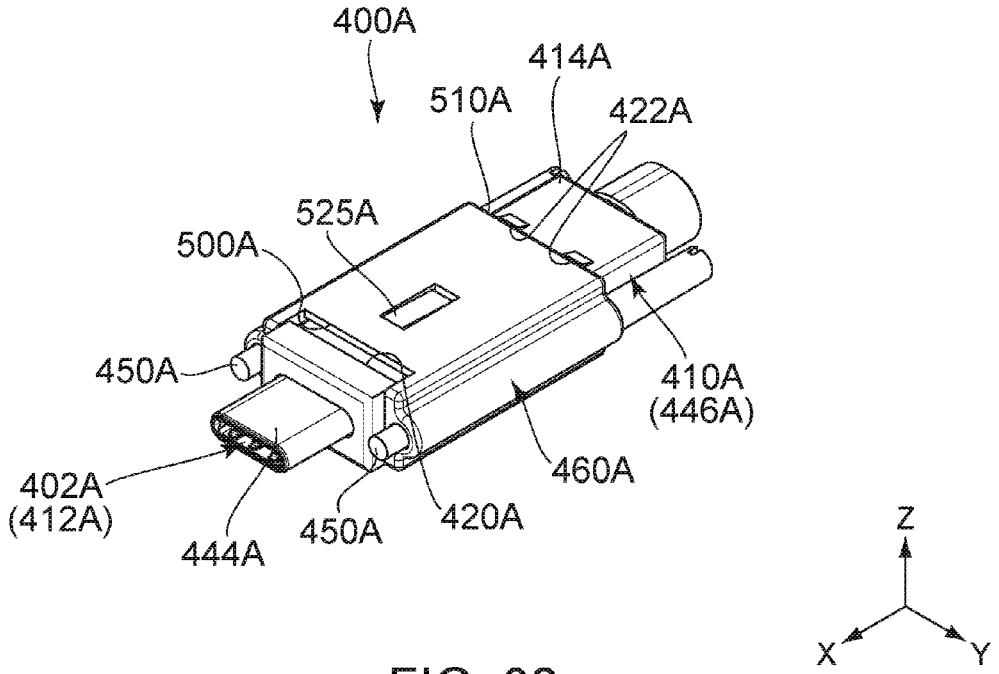
FIG. 32 is yet another top, perspective view showing the mating connector of FIG. 26.
Figure 34:
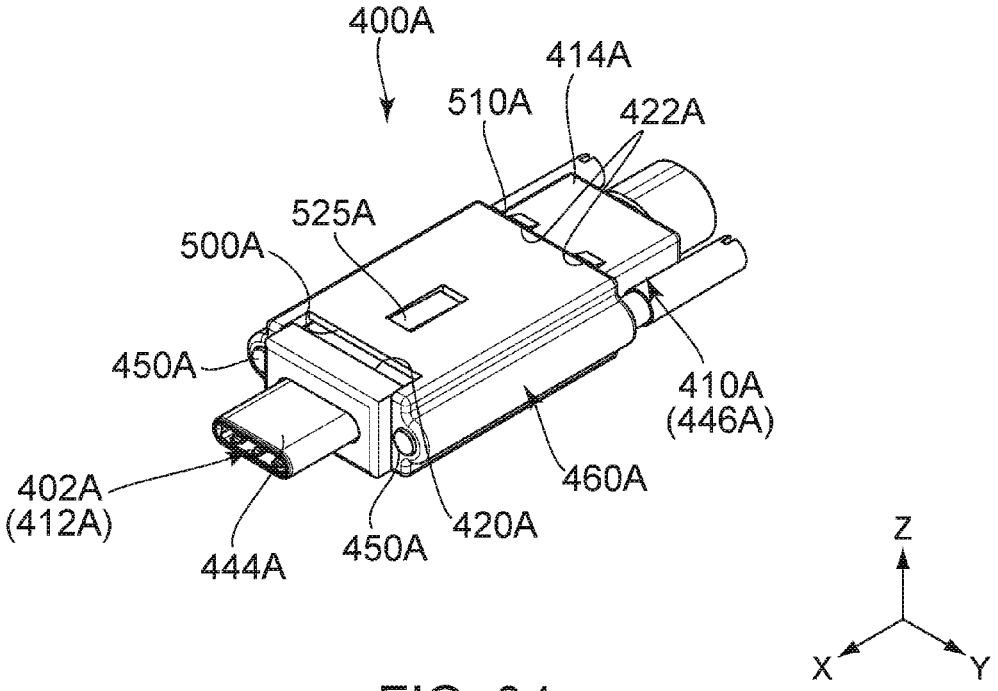
FIG. 34 is still another top, perspective view showing the mating connector of FIG. 26.

As understood from FIGS. 32 to 34, in the present modification, when the screw holding member 460A is positioned at the second predetermined position, each of the second abutment portions 510A abuts against the corresponding second facing portion 422A while each of the positioning projections 520A is accommodated in the corresponding second recess 432A. In other words, pairs, each consisting of the second abutment portion 510A and the second facing portion 422A, and pairs each consisting of the positioning projection 520A and the second recess 432A define the second predetermined position. However, the present invention is not limited thereto. The second predetermined position may be defined only by the pairs each consisting of the second abutment portion 510A and the second facing portion 422A. In addition, the second predetermined position may be defined only by the pairs each consisting of the positioning projection 520A and the second recess 432A. Furthermore, the second predetermined position may be defined by other means.

In the present modification, the first predetermined position is arranged to satisfy the condition 1 described in the first embodiment, and the second predetermined position is arranged to satisfy the condition 2 described in the first embodiment. Accordingly, the connector assembly 100 of the present modification also has an effect similar to that of the first embodiment.

Figure 35:
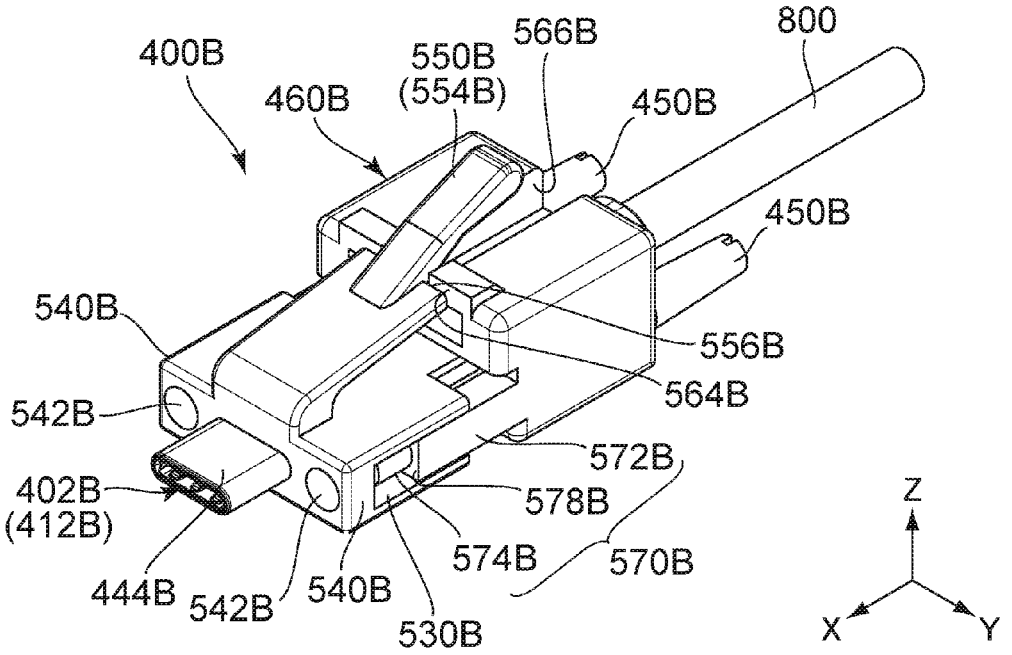
FIG. 35 is a top, perspective view showing a mating connector according to a second modification.
Figure 36:
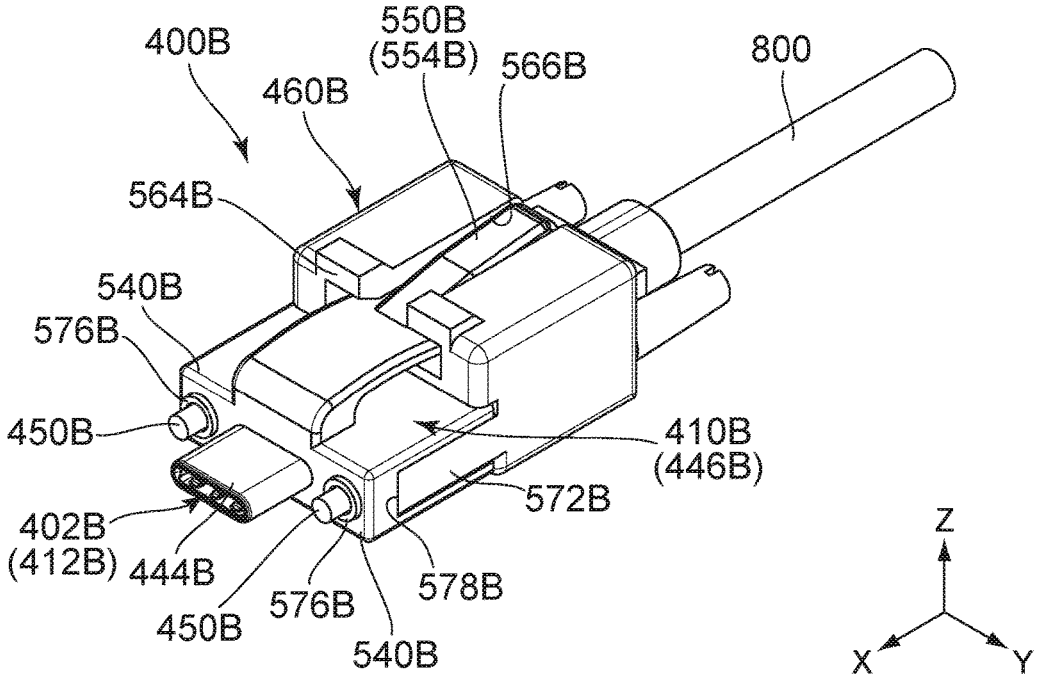
FIG. 36 is a top, perspective view showing the mating connector of FIG. 35.
Figure 37:
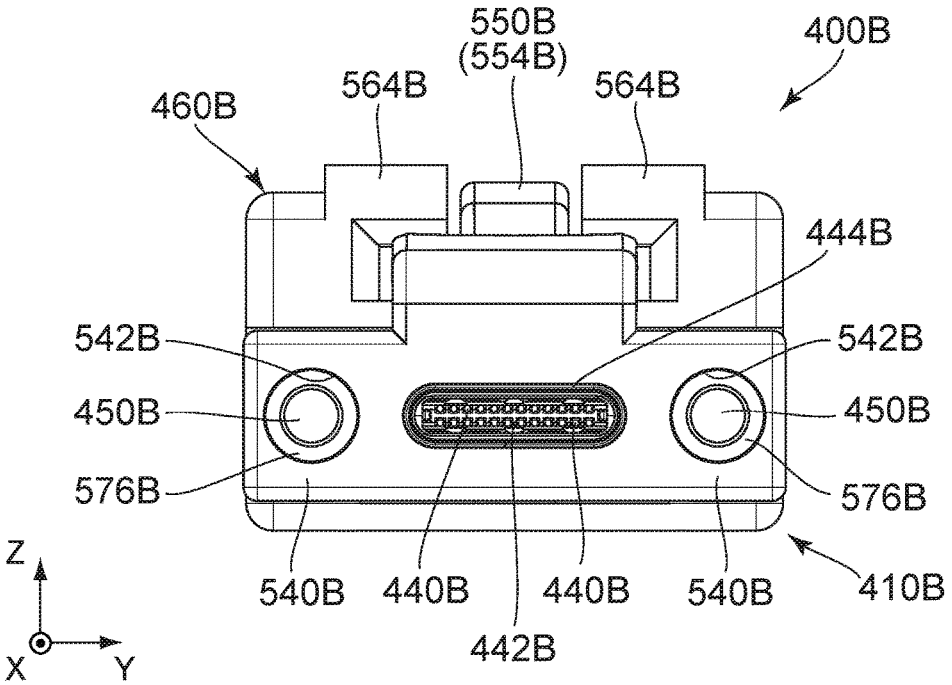
FIG. 37 is a front view showing the mating connector of FIG. 36.

As shown in FIGS. 35 to 39 and 41, a mating connector 400B according to a second modification comprises a mating connector main 410B, two male screw members 450B and a screw holding member 460B. The mating connector main 410B of the present modification is positioned between the two male screw members 450B in the lateral direction. As shown in FIGS. 36 and 37, the mating connector main 410B comprises mating contacts 440B, a mating holding member 442B, a mating shell 444B and a hood 446B similar to the first embodiment. Specifically, the mating holding member 442B holds the mating contacts 440B, and the mating shell 444B covers the mating holding member 442B. Explanation about those components is omitted.

As understood from FIGS. 35, 36, 38 and 39, the mating connector main 410B is provided with two guide portions 530B, two facing wall portions 540B, an operation portion (lever) 550B and a positioning recess 558B. The positioning recess 558B is formed on a lower surface of the hood 446B.

Each of the guide portions 530B extends in the predetermined direction. The guide portions 530B are positioned at opposite ends, respectively, of the mating connector main 410B in the lateral direction. In other words, the guide portions 530B are positioned away from each other in the lateral direction. The facing wall portions 540B correspond to the guide portions 530B, respectively. Each of the facing wall portions 540B is positioned beyond the corresponding guide portion 530B in the first predetermined orientation of the predetermined direction. The facing wall portions 540B are positioned away from each other in the lateral direction. Each of the facing wall portions 540B is formed with a through hole 542B which pierces the facing wall portion 540B in the predetermined direction. Each of the facing wall portions 540B functions as a regulated portion as described later.

Figure 38:
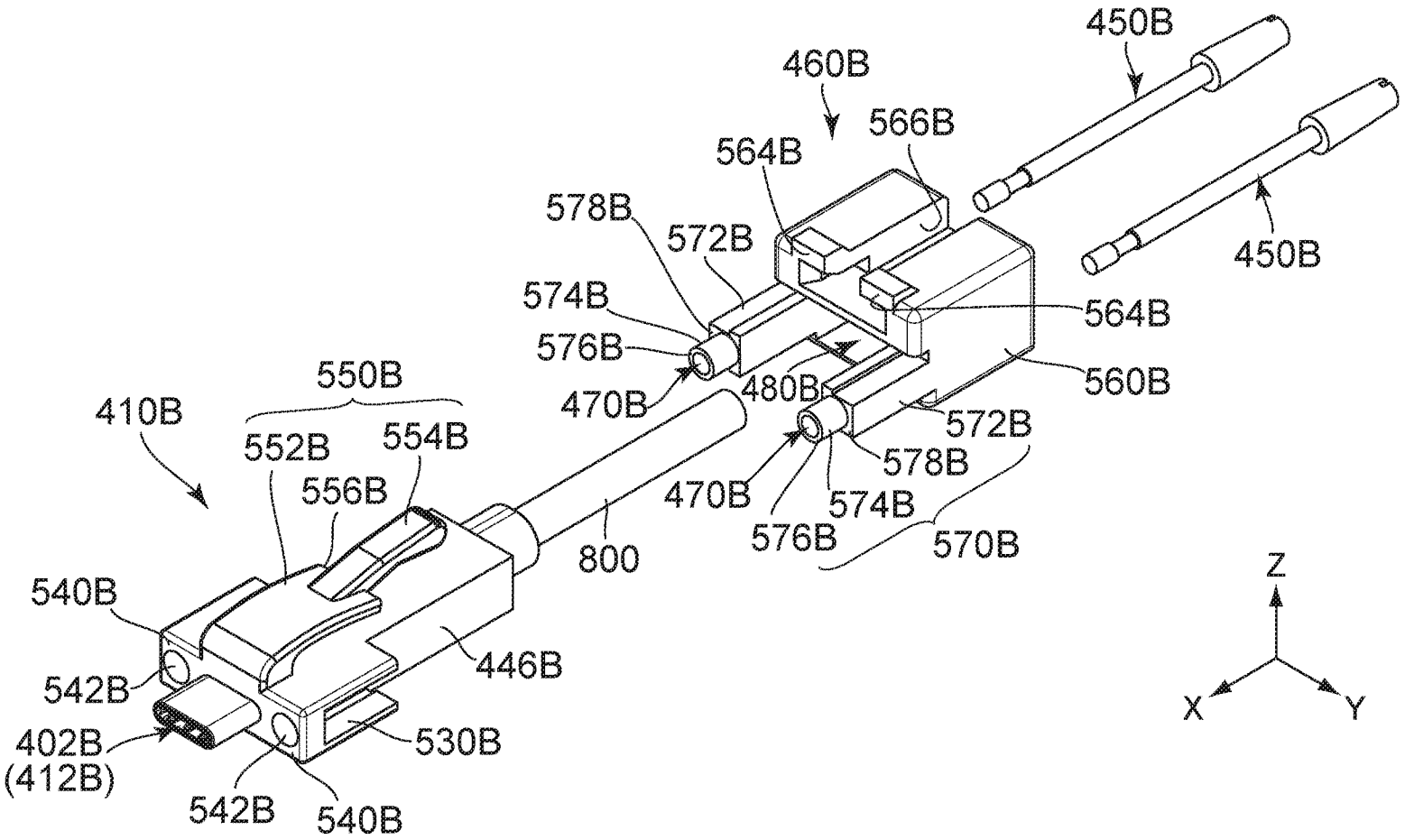
FIG. 38 is an exploded, top, perspective view showing the mating connector of FIG. 35.

As shown in FIGS. 35 to 38, the operation portion 550B extends upward from a vicinity of an end of the hood 446B in the first predetermined orientation. As shown in FIG. 38, the operation portion 550B of the mating connector main 410B is formed with a broad portion 552B and a narrow portion 554B. Specifically, the broad portion 552B extends from the vicinity of the end of the hood 446B in the first predetermined orientation, and the narrow portion 554B extends from the broad portion 552B. In the lateral direction, the narrow portion 554B has a size smaller than a size of the broad portion 552B. A boundary portion between the broad portion 552B and the narrow portion 554B is formed with stopped portions 556B.

As shown in FIGS. 35 and 36, the screw holding member 460B is attached to the mating connector main 410B and is relatively movable with respect to the mating connector main 410B along the predetermined direction between a first predetermined position and a second predetermined position. The first predetermined position is positioned beyond the second predetermined position in the first predetermined orientation, and the second predetermined position is positioned beyond the first predetermined position in the second predetermined orientation.

Figure 40:
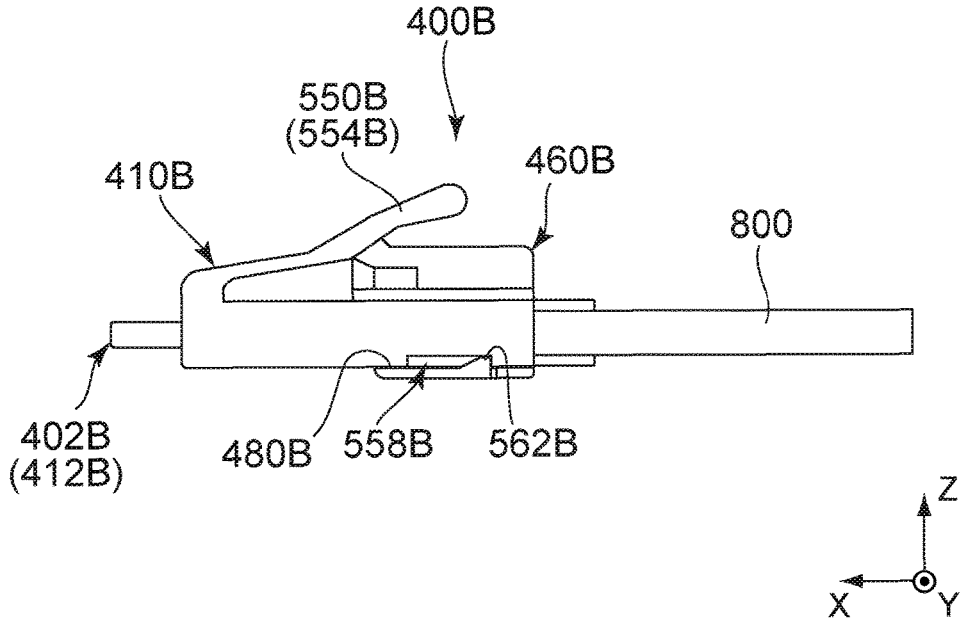
FIG. 40 is a view showing a positional relationship between a positioning projection and a positioning recess which are included in the mating connector of FIG. 35.
Figure 42:
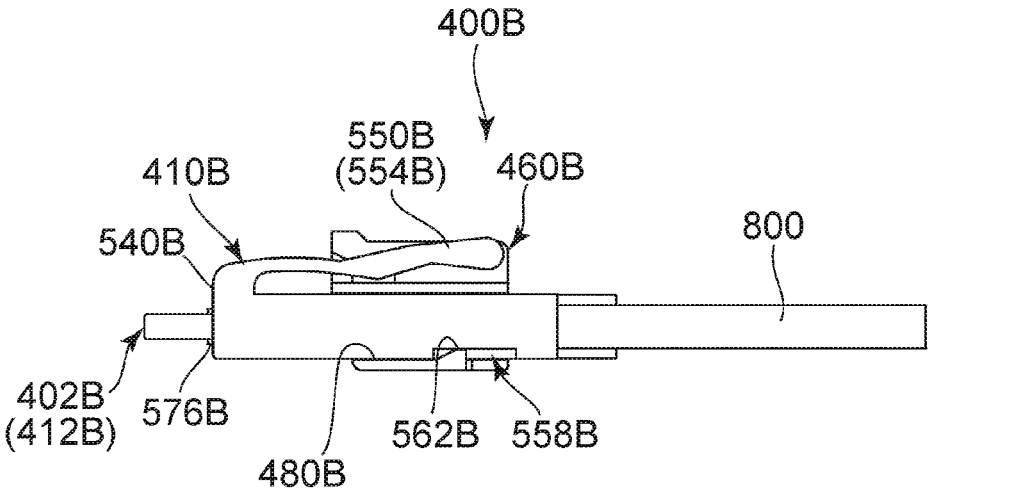
FIG. 42 is a view showing another positional relationship between the positioning projection and the positioning recess which are included in the mating connector of FIG. 41.
Figure 42:
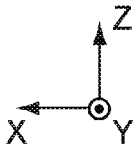

As shown in FIG. 38, the screw holding member 460B of the present modification is formed with two side accommodation portions 470B and a center accommodation portion 480B. Each of the side accommodation portions 470B and the center accommodation portion 480B pierces the screw holding member 460B in the predetermined direction. As understood from FIGS. 35, 36 and 38, the side accommodation portions 470B partially accommodate the male screw members 450B, respectively. Each of the side accommodation portions 470B accommodates the corresponding male screw member 450B in a manner similar to a manner in which the screw accommodation member 470 of the aforementioned first embodiment accommodates the male screw member 450. As shown in FIG. 38, the center accommodation portion 480B is positioned between the side accommodation portions 470B in the lateral direction. As shown in FIGS. 40 and 42, the center accommodation portion 480B partially accommodates the mating connector main 410B so as to be movable in the predetermined direction.

As shown in FIG. 38, in detail, the screw holding member 460B of the present modification is provided with a main portion 560B and two arm portions 570B. The center accommodation portion 480B is provided on the main portion 560B.

Figure 39:
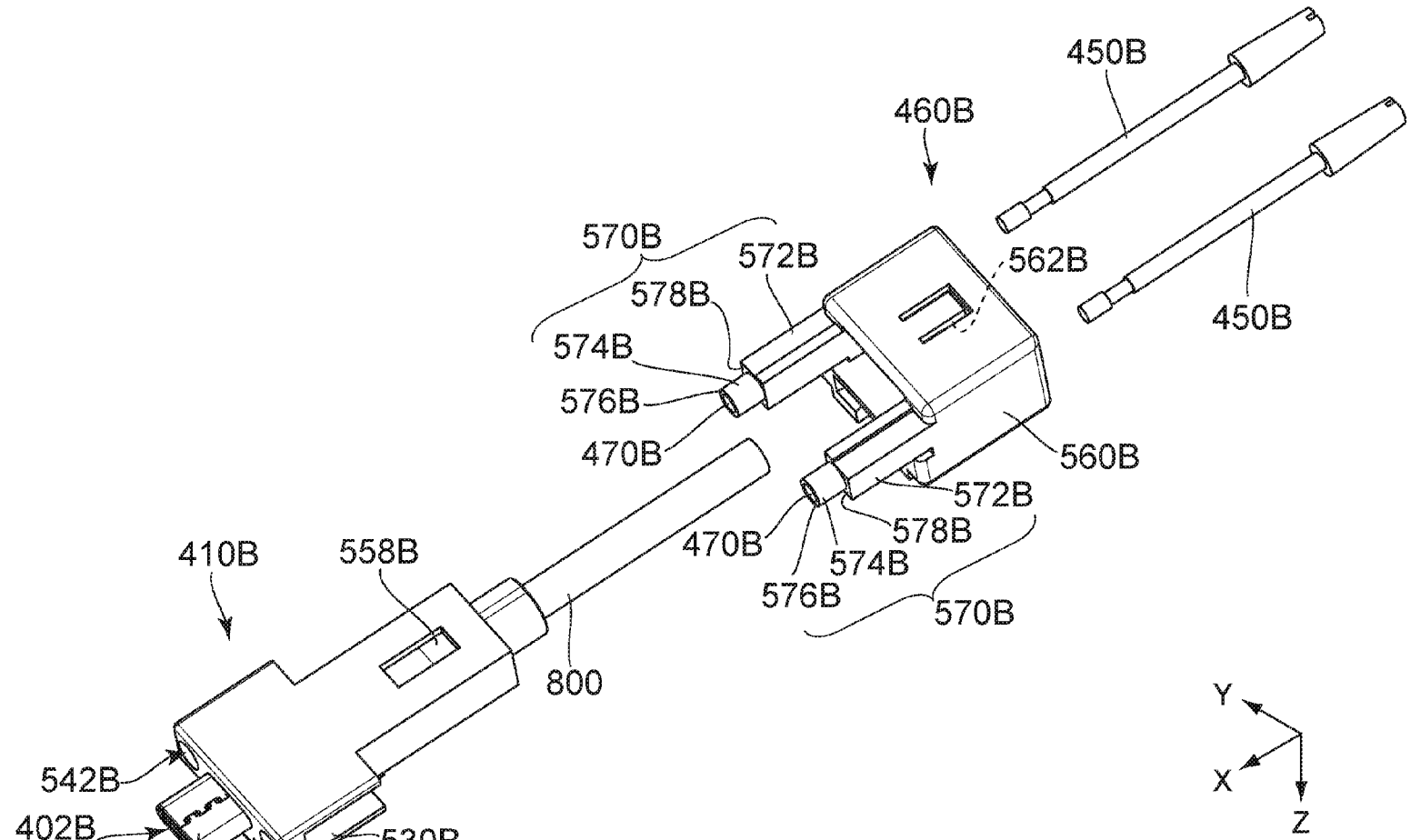
FIG. 39 is an exploded, bottom, perspective view showing the mating connector of FIG. 35.

As understood from FIGS. 39, 40 and 42, the main portion 560B is provided with a positioning projection 562B which is positioned at a lower side thereof and which projects inward of the center accommodation portion 480B. The positioning projection 562B is accommodated in the positioning recess 558B of the mating connector main 410B. In the predetermined direction, the positioning recess 558B has a size greater than a size of the positioning projection 562B. Accordingly, the positioning projection 562B is movable within the positioning recess 558B. Meanwhile, the positioning projection 562B cannot be moved beyond the positioning recess 558B in the second predetermined orientation. In other words, the positioning recess 558B regulates a movement of the positioning projection 562B beyond the positioning recess 558B in the second predetermined orientation of the predetermined direction.

As shown in FIG. 38, the main portion 560B of the screw holding member 460B is provided with stopping portions 564B and a slot 566B. Specifically, the slot 566B extends from the stopping portions 564B in the second predetermined orientation of the predetermined direction. As understood from FIGS. 35, 36 and 41, the slot 566B partially accommodates the narrow portion 554B of the operation portion 550B.

As shown in FIG. 38, under a state where the operation portion 550B is not operated, the stopped portions 556B are positioned beyond the stopping portions 564B, respectively, in the first predetermined orientation and regulate a movement of the screw holding member 460B in the first predetermined orientation. As understood from FIGS. 35, 36 and 41, when the operation portion 550B is operated so that the stopped portions 556B are moved in the up-down direction, each of the stopping portions 564B is released from the corresponding stopped portion 556B so that the screw holding member 460B is movable in the first predetermined orientation.

As shown in FIG. 38, the arm portions 570B are positioned away from each other in the lateral direction. Each of the arm portions 570B extends from the main portion 560B in the first predetermined orientation of the predetermined direction. The side accommodation portions 470B correspond to the arm portions 570B, respectively. Each of the side accommodation portions 470B is formed to continuously extend between the corresponding arm portion 570B and the main portion 560B.

Each of the arm portions 570B has a guided portion 572B and a projecting portion 574B which extends from the guided portion 572B in the first predetermined orientation. Specifically, a part of each of the side accommodation portions 470B is positioned in the corresponding projecting portion 574B. The guided portions 572B are received in the guide portions 530B, respectively, of the mating connector main 410, and each of the guided portions 572B is guided by the corresponding guide portion 530B during its movement along the predetermined direction. A boundary portion between the guided portion 572B and the projecting portion 574B is provided with an abutment portion 578B which faces in the first predetermined orientation of the predetermined direction. Specifically, the abutment portion 578B is positioned around an end of the projecting portion 574B in the second predetermined orientation. An end of the projecting portion 574B in the first predetermined orientation functions as a male screw seat 576B.

Figure 41:
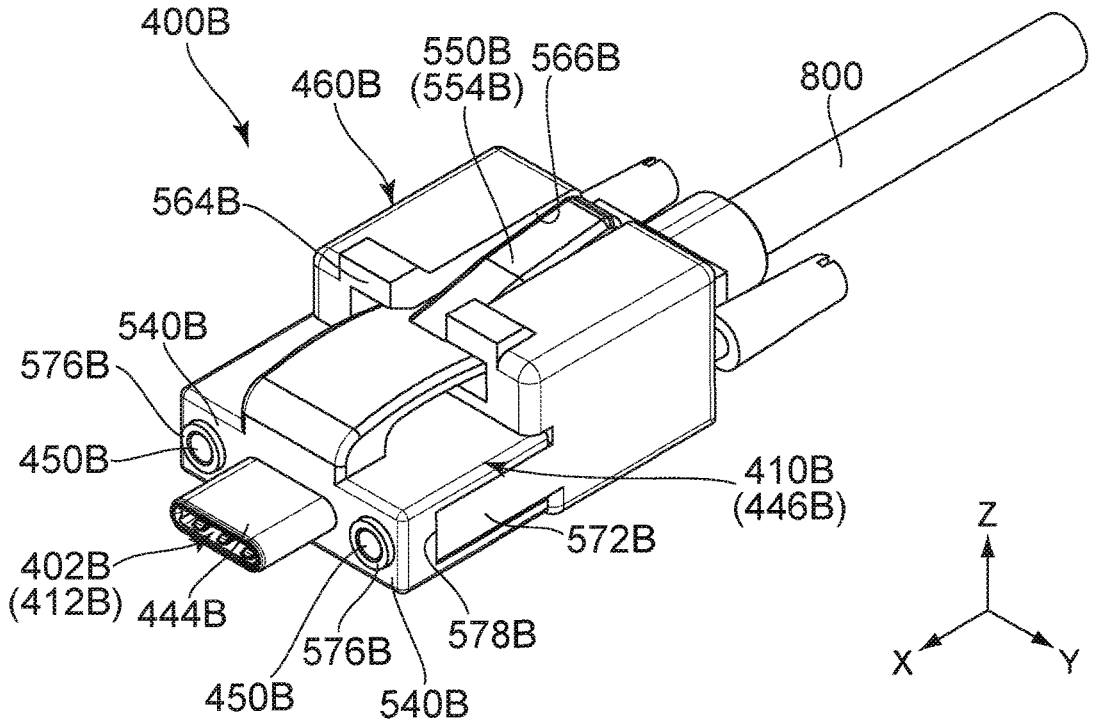
FIG. 41 is another top, perspective view showing the mating connector of FIG. 35.

As understood from FIGS. 35 and 36, the projecting portions 574B are projectable in the first predetermined orientation through the through holes 542B, respectively, by a relative movement of the screw holding member 460B with respect to the mating connector main 410B. As understood from FIGS. 35 and 38, the abutment portions 578B face the facing wall portions 540B, respectively, in the predetermined direction, and each of the abutment portions 578B is positioned beyond the corresponding facing wall portion 540B in the second predetermined orientation. As shown in FIGS. 36 and 41, a maximum amount of projection of each of the projecting portions 574B from the corresponding facing wall portion 540B is defined by each of the abutment portions 578B abutting against the corresponding facing wall portion 540B. As understood form above, the abutment portions 578B of the present modification function as regulating portions which correspond to the facing wall portions (regulated portions) 540B, respectively.

As understood from FIGS. 36, 41 and 42, in the present modification, when the screw holding member 460B is positioned at the first predetermined position, each of the abutment portions 578B abuts against the corresponding facing wall portion 540B. In other words, the abutment portions 578B and the facing wall portions 540B define the first predetermined position. However, the present invention is not limited thereto. The first predetermined position may be defined by other means.

As understood from FIGS. 35 and 40, in the present modification, when the screw holding member 460B is positioned at the second predetermined position, each of the stopped portions 556B is positioned beyond the corresponding stopping portion 564B in the first predetermined orientation while the positioning projection 562B is positioned within the positioning recess 558B. In other words, pairs, each consisting of the stopping portion 564B and the stopped portion 556B, and a pair consisting of the positioning projection 562B and the positioning recess 558B define the second predetermined position. However, the present invention is not limited thereto. The second predetermined position may be defined by other means.

In the present modification, the first predetermined position is arranged to satisfy the condition 1 described in the first embodiment, and the second predetermined position is arranged to satisfy the condition 2 described in the first embodiment. Accordingly, the connector assembly 100 of the present modification also has an effect similar to that of the first embodiment.

(Second Embodiment)

Figure 43:
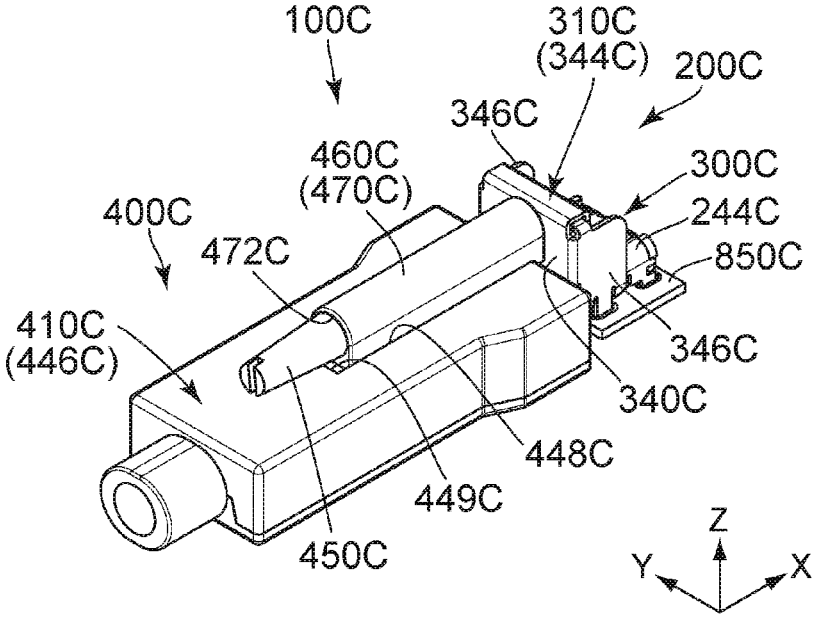
FIG. 43 is a top, perspective view showing a connector assembly which comprises a connector and a mating connector according to a second embodiment of the present invention. The illustrated connector and the illustrated mating connector are connected with each other.
Figure 44:
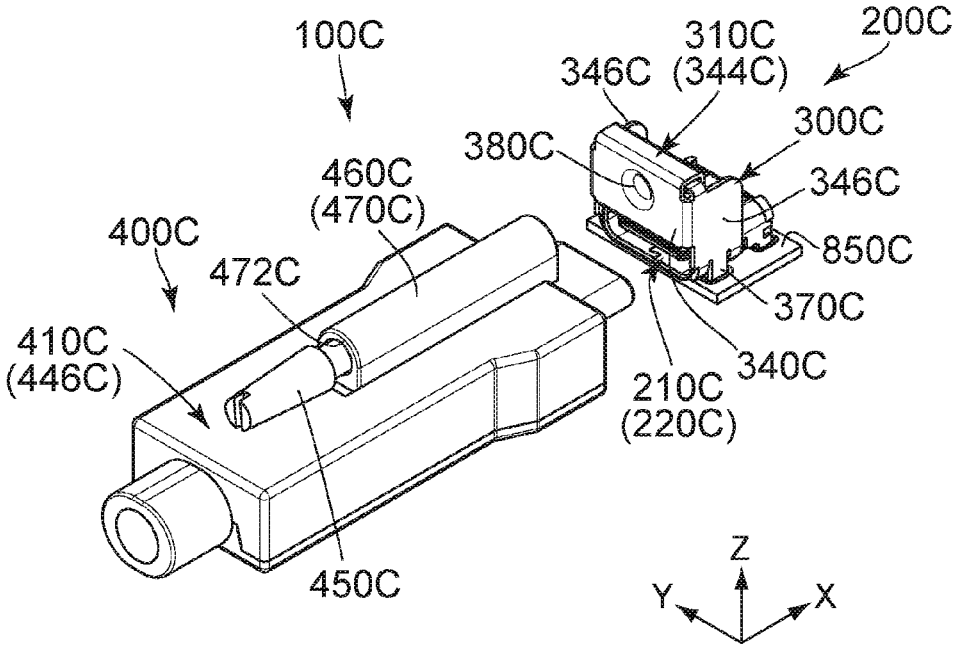
FIG. 44 is another top, perspective view showing the connector assembly of FIG. 43. The connector and the mating connector are not connected with each other.

As shown in FIGS. 43 and 44, a connector assembly 100C according to a second embodiment of the present invention comprises a connector 200C and a mating connector 400C. The connector 200C is a receptacle in accordance with the USB Type-C standard. When the connector 200C is used, the connector 200C is mounted on a circuit board 850C as a mount object in an up-down direction. The mating connector 400 is a plug in accordance with the USB Type-C standard. As described later, the mating connector 400C comprises a mating fitting portion and a male screw member 450C, and the mating fitting portion has mating contacts 440C. The mating connector 400C is connectable with the connector 200C along a first predetermined orientation in a predetermined direction perpendicular to the up-down direction. In addition, the mating connector 400C is removable from the connector 200C along a second predetermined orientation opposite to the first predetermined orientation in the predetermined direction. Also in the present embodiment, the up-down direction is the Z-direction. Specifically, the positive Z-direction is upward, and the negative Z-direction is downward. Furthermore, the predetermined direction is the X-direction. Specifically, in the present embodiment, the first predetermined orientation is the positive X-direction, and the second predetermined orientation is the negative X-direction. The positive X-direction is rearward of the connector 200C, and the negative X-direction is forward of the connector 200C. In other words, the first predetermined orientation is rearward of the connector 200C, and the second predetermined orientation is forward of the connector 200C.

Figure 47:
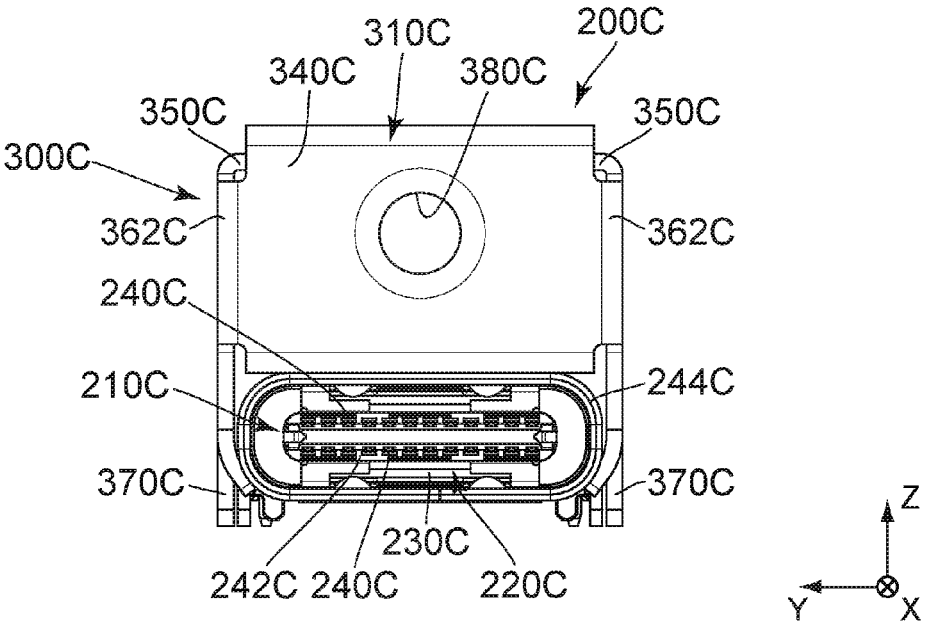
FIG. 47 is a front view showing the connector of FIG. 45.
Figure 49:
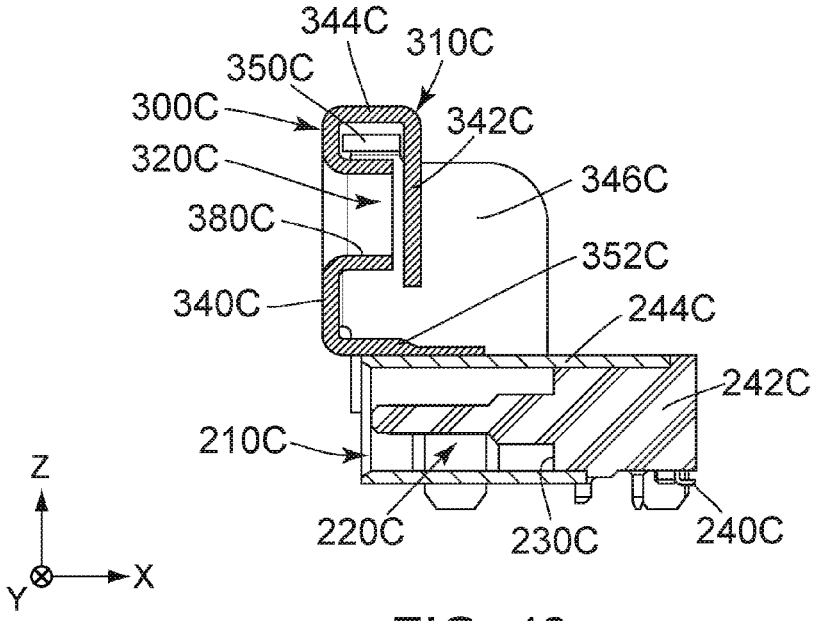
FIG. 49 is a cross-sectional view showing the connector of FIG. 45.
Figure 50:
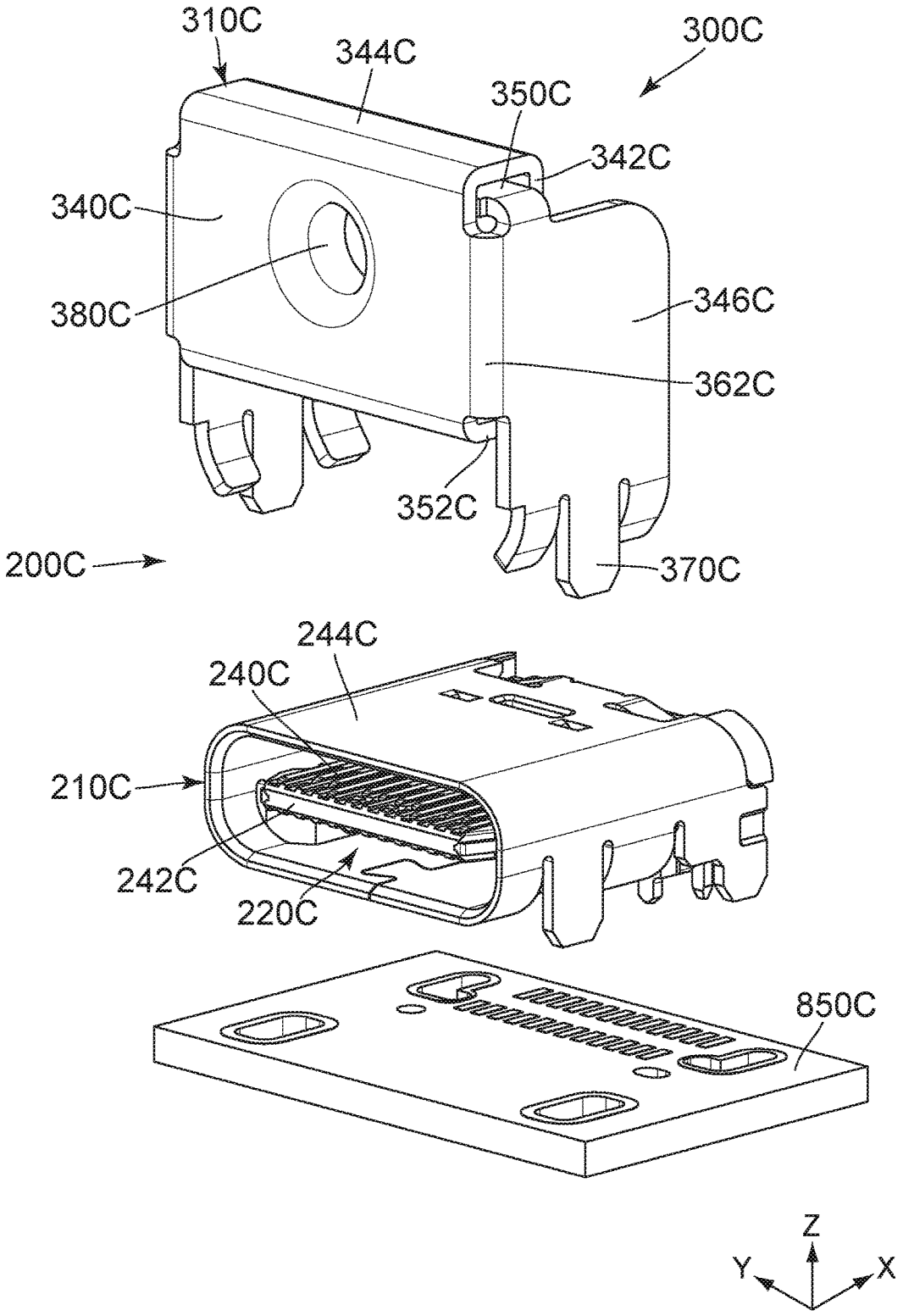
FIG. 50 is an exploded, perspective view showing the connector of FIG. 45.

As shown in FIGS. 47 and 50, the connector 200C comprises contacts 240C, a holding member 242C, a shell 244C and a screw fixing member 300C. The contacts 240C, the holding member 242C and the shell 244C are same as those of the aforementioned first embodiment and form a fitting portion 210C which is mateable with the mating fitting portion. In particular, as shown in FIG. 49, the receiving portion 220C has an inner wall 230C in the predetermined direction.

As shown in FIG. 50, the screw fixing member 300C of the present embodiment is distinct and separated from the shell 244C. The screw fixing member 300C of the present embodiment comprises a single screw end accommodation portion 310C. In other words, the screw end accommodation portion 310C of the present embodiment is formed as a part of the screw fixing member 300C. However, the present invention is not limited thereto. The screw end accommodation portion 310C may be formed as a part of the shell 244C. The screw end accommodation portion 310C is positioned above the fitting portion 210C in the up-down direction.

Figure 48:
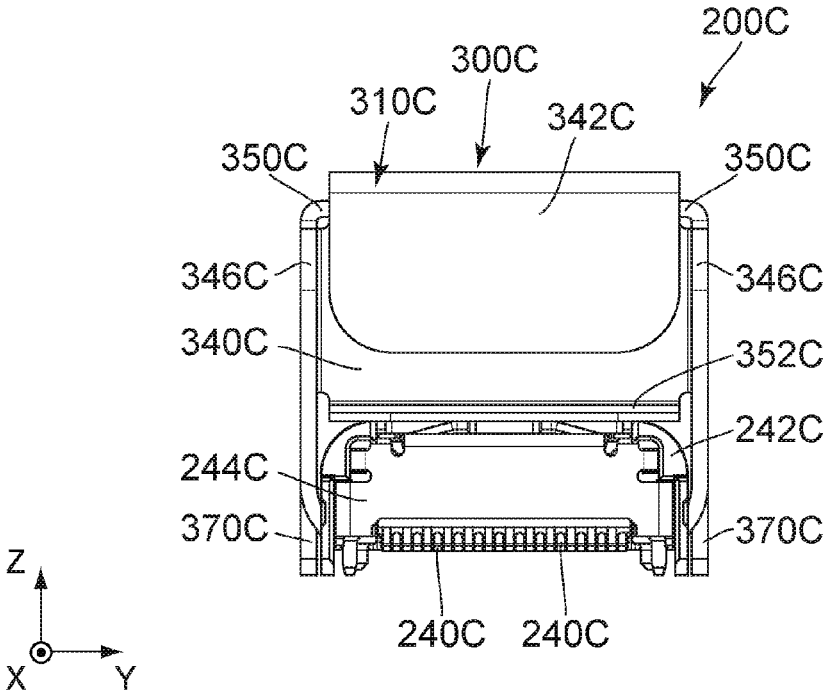
FIG. 48 is a rear view showing the connector of FIG. 45.

As understood from FIGS. 43 and 49, the screw end accommodation portion 310C defines an accommodation space 320C which accommodates an end of the male screw member 450C when the connector 200C is connected with the mating connector 400C. As understood from FIGS. 45 to 50, the screw end accommodation portion 310C has a front surface portion 340C, an upper surface portion 344C, a rear surface portion 342C, two outer surface portions 346C, two reinforcing portions 350C and a bottom surface portion 352C.

As understood from FIGS. 45, 47, 49 and 50, the front surface portion 340C is provided with a female screw portion 380C which is connectable with the male screw member 450C. The front surface portion 340C functions as a female screw seat when the connector 200C is connected with the mating connector 400C.

Figure 46:
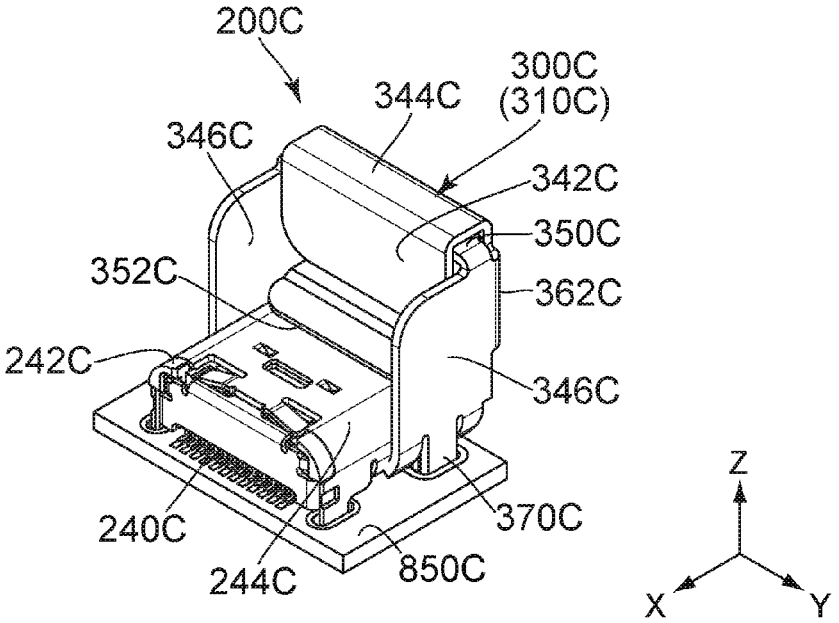
FIG. 46 is a rear, perspective view showing the connector of FIG. 45.

As understood from FIGS. 46, 48 and 49, the rear surface portion 342C faces the front surface portion 340C in the predetermined direction. In particular, as shown in FIG. 49, the accommodation space 320C is positioned between the front surface portion 340C and the rear surface portion 342C in the predetermined direction.

As shown in FIG. 49, the upper surface portion 344C is positioned above the accommodation space 320C in the up-down direction. The upper surface portion 344C connects the front surface portion 340C and the rear surface portion 342C with each other at their upper sides in the up-down direction.

Figure 45:
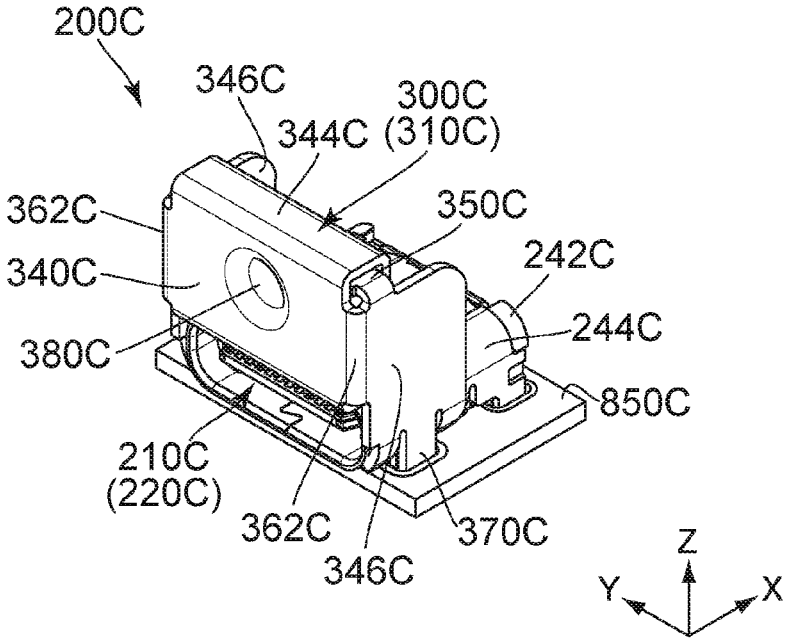
FIG. 45 is a front, perspective view showing the connector of FIG. 43.

As understood from FIGS. 45, 48 and 49, each of the outer surface portions 346C is positioned outward of the accommodation space 320C in a lateral direction and faces outward in a lateral direction. Also in the present embodiment, the lateral direction is the Y-direction. The outer surface portions 346*c* face each other in the lateral direction. As shown in FIGS. 45 and 47, each of the outer surface portions 346C is connected with the front surface portion 340C by a side front bent portion 362C. In the up-down direction, each of the side front bent portions 362C has a size same as a size of the front surface portion 340C. Accordingly, the side front bent portion 362C has a resistance to a force which rotates the outer surface portion 346C in a plane perpendicular to the lateral direction.

As shown in FIGS. 45 and 46, each of the outer surface portions 346C has a fixed portion 370C which is soldered to be fixed to the circuit board 850C when the connector 200C is mounted on the circuit board 850C. Each of the fixed portions 370C has a size in the predetermined direction and another size in the lateral direction. The size of the fixed portion 370C in the predetermined direction is greater than the size of the fixed portion 370C in the lateral direction. Since each of the outer surface portions 346C is fixed to the circuit board 850C through the aforementioned fixed portion 370C, each of the outer surface portions 346C has a resistance to a force along the predetermined direction.

As understood from FIGS. 45, 46, 48 to 50, the reinforcing portions 350C correspond to the outer surface portions 346C, respectively. Each of the reinforcing portions 350C extends inward in the lateral direction from the corresponding outer surface portion 346C. As shown in FIG. 49, each of the reinforcing portions 350C is positioned below the upper surface portion 344C in the up-down direction and is positioned between the front surface portion 340C and the rear surface portion 342C in the predetermined direction. The aforementioned structure enables the reinforcing portions 350C to reinforce the front surface portion 340C from a rear side of the front surface portion 340C.

As understood from FIGS. 46 and 49, the bottom surface portion 352C extends rearward in the predetermined direction from a lower end of the front surface portion 340C. The bottom surface portion 352C is connected with an upper part of the shell 244C. Specifically, the bottom surface portion 352C is fixed to the upper part of the shell 244C by laser welding.

As described above, the accommodation space 320C shown in FIG. 49 is surrounded by the screw end accommodation portion 310C. Accordingly, even if foreign bodies enter into the connector 200C from the female screw portion 380C under a state where the connector 200C is not connected with the mating connector 400C, the foreign bodies have high probability to stay in the accommodation space 320C. Thus, foreign bodies can be prevented from entering into an inside of a housing (not shown) of an electronic equipment (not shown) in which the connector 200C is installed.

Similar to the mating connector 400 of the first embodiment, the mating connector 400C of the present embodiment is connectable not only with the connector 200C of the present embodiment but also with the alternative connecting object 700. Detailed explanation about the alternative connecting object 700 is omitted.

Figure 51:
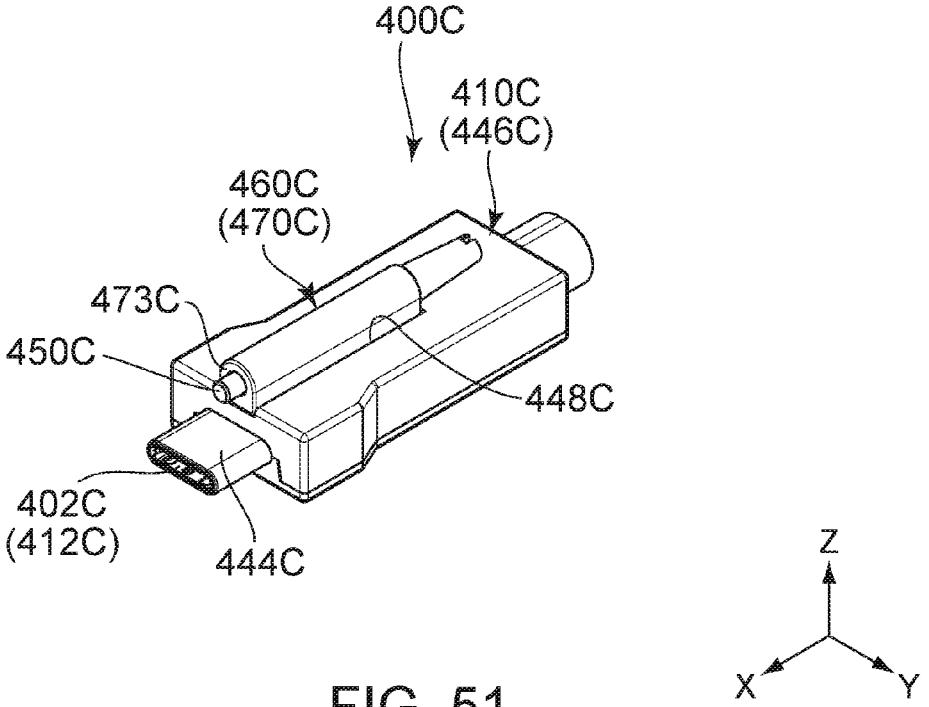
FIG. 51 is a top, perspective view showing the mating connector of FIG. 43.
Figure 52:
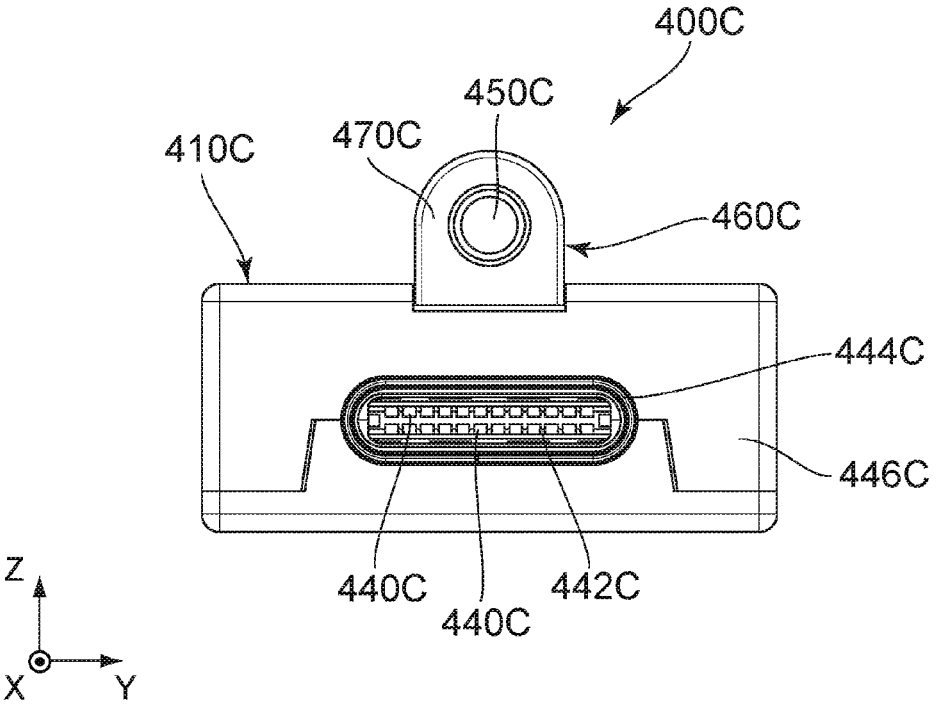
FIG. 52 is a front view showing the mating connector of FIG. 51.
Figure 53:
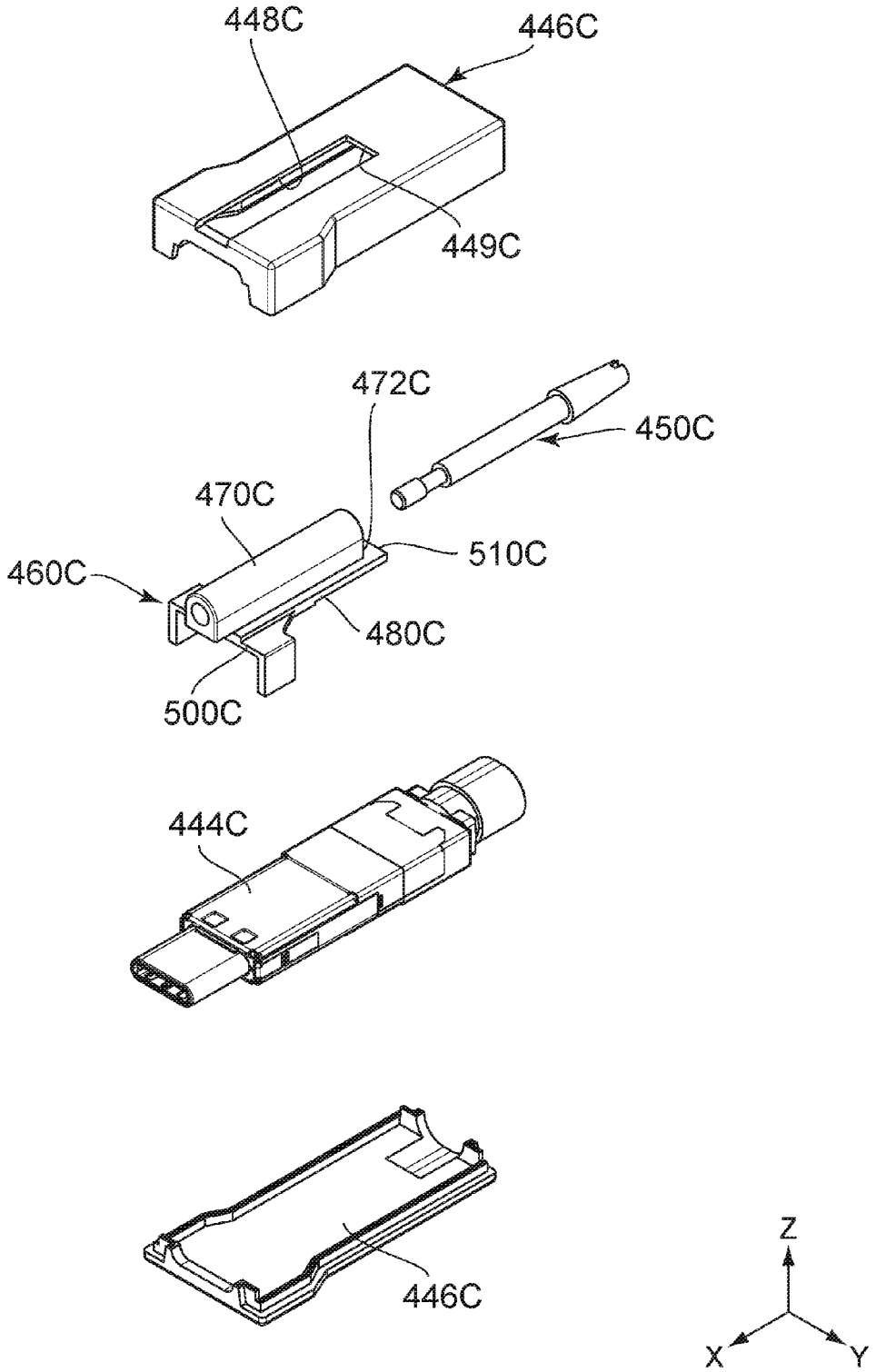
FIG. 53 is an exploded, perspective view showing the mating connector of FIG. 51.

As understood from FIGS. 51 to 53, the mating connector 400C of the present embodiment comprises a mating connector main 410C, a single male screw member 450C and a screw holding member 460C. The male screw member 450C is positioned above the mating connector main 410C in the up-down direction.

As shown in FIG. 52, the mating connector main 410C comprises mating contacts 440C, a mating holding member 442C, a mating shell 444C and a hood 446C similar to the first embodiment. Specifically, the mating holding member 442C holds the mating contacts 440C, and the mating shell 444C covers the mating holding member 442C. Explanation about the mating contacts 440C, the mating holding member 442C and the mating shell 444C is omitted.

As shown in FIG. 51, an end 412C of the mating connector main 410C forms an end portion 402C of the mating connector 400C in the first predetermined orientation. The mating connector main 410C is selectively mateable with any of the fitting portion 210C of FIG. 45 and the alternative fitting portion 730 along the predetermined direction. As understood from FIGS. 43 and 44, when the connector 200C is connected with the mating connector 400C, the mating connector main 410C is partially received in the receiving portion 220C of the fitting portion 210C.

Figure 54:
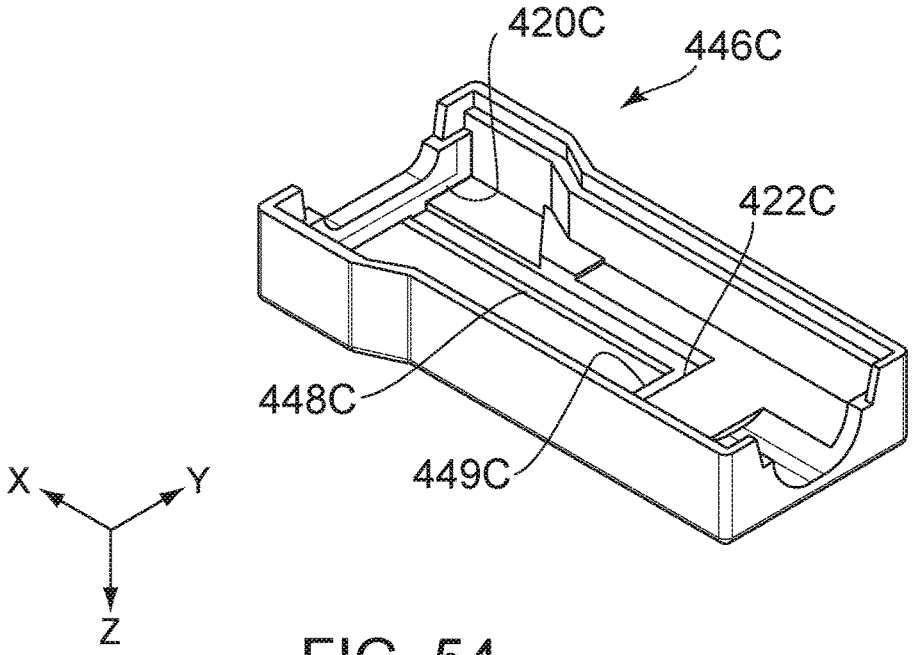
FIG. 54 is a bottom, perspective view showing an upper part of a hood which is included in the mating connector of FIG. 51.

As shown in FIG. 53, the illustrated hood 446C consists of two parts of an upper part and a lower part. The upper part of the hood 446C is formed with a slot 448C. The slot 448C has an edge portion 449C in the second predetermined orientation. As shown in FIG. 54, the upper part of the hood 446C is formed with first facing portion 420C which is positioned to extend over lateral sides of an end of the slot 448C in the first predetermined orientation. In addition, the upper part of the hood 446C is formed with a second facing portion 422C which is positioned in the vicinity of the edge portion 449C of the slot 448C. In other words, the first facing portion 420C is positioned beyond the second facing portion 422C in the first predetermined orientation, and the second facing portion 422C is positioned beyond the first facing portion 420C in the second predetermined orientation. Each of the first facing portion 420C and the second facing portion 422C of the present embodiment is provided inside the hood 446C. In other words, each of the first facing portion 420C and the second facing portion 422C of the present embodiment is provided inside the mating connector main 410C.

As understood from FIGS. 51 to 53, the screw holding member 460C of the present embodiment is attached to the mating connector main 410C so that the screw holding member 460C is partially accommodated in the mating connector main 410C. As understood from FIGS. 43, 44 and 51, the screw holding member 460C is relatively movable with respect to the mating connector main 410C along the predetermined direction between a first predetermined position and a second predetermined position. The first predetermined position is positioned beyond the second predetermined position in the first predetermined orientation, and the second predetermined position is positioned beyond the first predetermined position in the second predetermined orientation.

Figure 55:
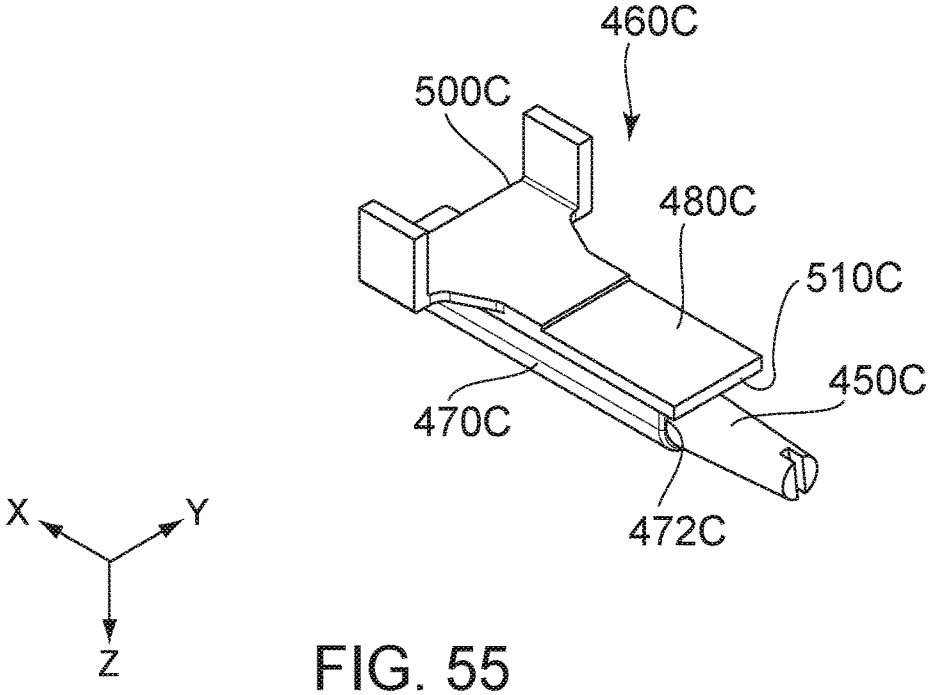
FIG. 55 is a bottom, perspective view showing a screw holding member which is included in the connector of FIG. 51.
Figure 56:
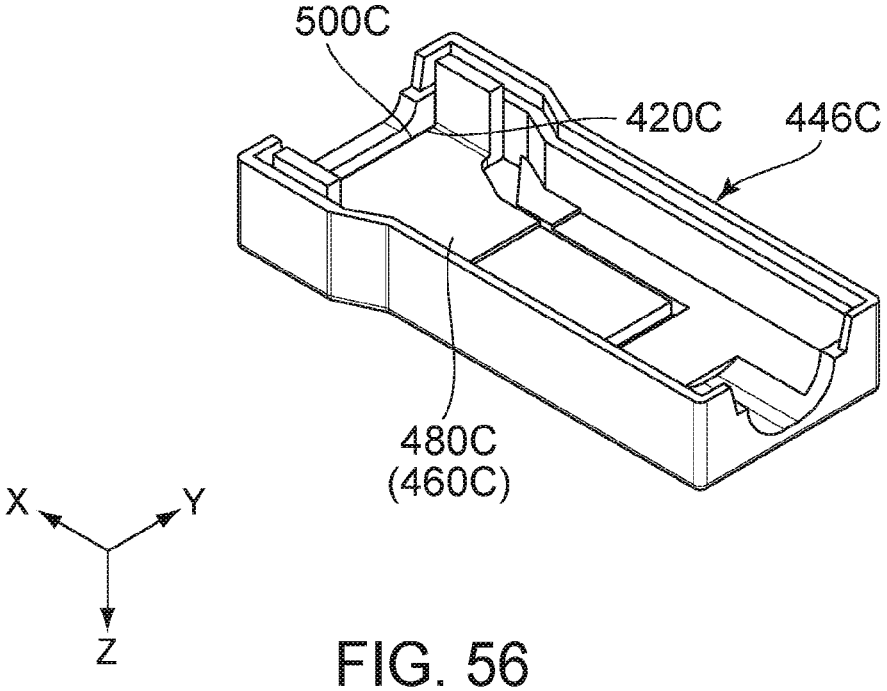
FIG. 56 is a bottom, perspective view showing the upper part of the hood of FIG. 54 and the screw holding member of FIG. 55.
Figure 57:
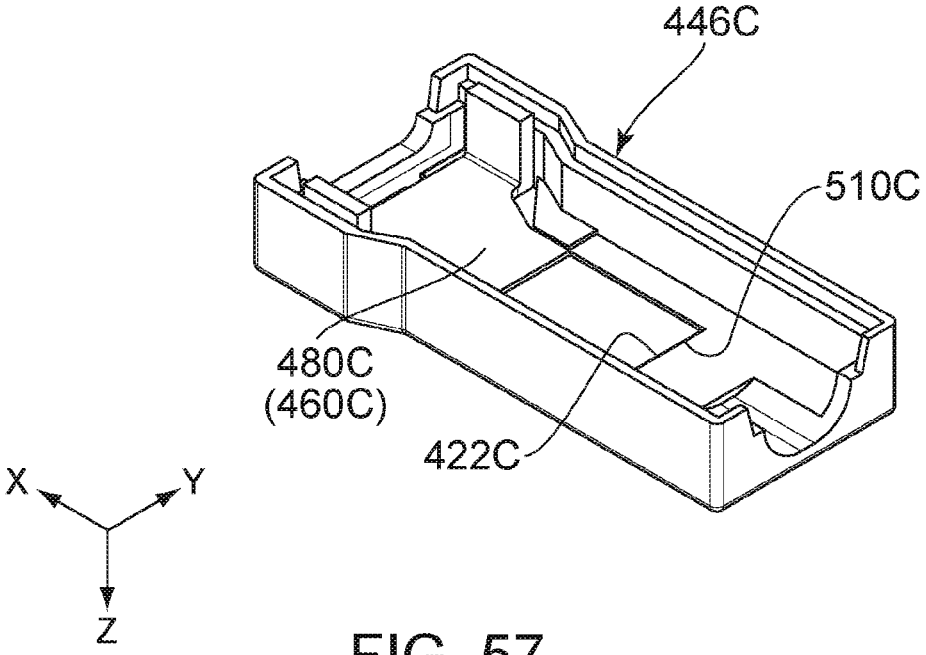
FIG. 57 is another bottom, perspective view showing the upper part of the hood of FIG. 54 and the screw holding member of FIG. 55.

As understood from FIGS. 53 and 55, in detail, the screw holding member 460C of the present embodiment has an upper accommodation portion 470C and a movable portion 480C. The movable portion 480C and the upper accommodation portion 470C of the present embodiment are formed integrally with each other. As shown in FIG. 51, the upper accommodation portion 470C is provided with a male screw seat 473C. As understood from FIGS. 43, 44 and 51, the male screw seat 473C is a surface which is brought into contact with the female screw seat when the male screw member 450C is connected with the female screw portion 380C. As shown in FIG. 51, the male screw seat 473C of the present embodiment is an end surface of the upper accommodation portion 470C which faces in the first predetermined orientation. As understood from FIGS. 51 and 53, the movable portion 480C is accommodated in the mating connector main 410C so as to be movable in the predetermined direction. As shown in FIGS. 53 and 55, the movable portion 480C is provided with a first abutment portion (abutment portion) 500C and a second abutment portion 510C. In the present embodiment, the first abutment portion 500C is an edge portion of the movable portion 480C in the first predetermined orientation, and the second abutment portion 510C is another edge portion of the movable portion 480C in the second predetermined orientation. As shown in FIGS. 56 and 57, the first abutment portion 500C is positioned beyond the second abutment portion 510C in the first predetermined orientation, and the second abutment portion 510C is positioned beyond the first abutment portion 500C in the second predetermined orientation. The first abutment portion 500C (abutment portion) faces the first facing portion 420C in the predetermine direction and is positioned beyond the first facing portion 420C in the second predetermined orientation. The second abutment portion 510C faces the second facing portion 422C in the predetermine direction and is positioned beyond the second facing portion 422C in the first predetermined orientation. Accordingly, the first facing portion 420C regulates a movement of the first abutment portion (abutment portion) 500C beyond the first facing portion 420C in the first predetermined orientation of the predetermined direction. Similarly, the second facing portion 422C regulates a movement of the second abutment portion 510C beyond the second facing portion 422C in the second predetermined orientation of the predetermined direction. As understood from above, the first abutment portion (abutment portion) 500C of the present embodiment functions as a regulating portion which corresponds to the first facing portion (regulated portion) 420C.

As understood from FIGS. 51 and 53, the upper accommodation portion 470C is provided on the movable portion 480C and is exposed outside the mating connector main 410C through the slot 448C. Accordingly, the upper accommodation portion 470C is positioned above the mating connector main 410C. The upper accommodation portion 470C partially accommodates the male screw member 450C. The upper accommodation portion 470C accommodates the male screw member 450C in a manner similar to a manner in which the screw accommodation member 470 of the aforementioned first embodiment accommodates the male screw member 450. As shown in FIGS. 53 and 55, the upper accommodation portion 470C has an end portion 472C in the second predetermined orientation. As understood from FIGS. 43 and 53, the edge portion 449C of the slot 448C faces the end portion 472C of the upper accommodation portion 470C in the predetermined direction and is positioned beyond the end portion 472C in the second predetermined orientation. Accordingly, the edge portion 449C of the slot 448C regulates a movement of the end portion 472C of the upper accommodation portion 470C beyond the edge portion 449C of the slot 448C in the second predetermined orientation.

As understood from FIG. 56, in the present modification, the first abutment portion (abutment portion) 500C abuts against the first facing portion 420C when the screw holding member 460C is positioned at the first predetermined position. In other words, the first abutment portion 500C and the first facing portion 420C define the first predetermined position. However, the present invention is not limited thereto. The first predetermined position may be defined by other means.

As understood from FIG. 57, in the present modification, the second abutment portion 510C abuts against the second facing portion 422C when the screw holding member 460C is positioned at the second predetermined position. At that time, as understood from FIGS. 43 and 51, the end portion 472C of the upper accommodation portion 470C abuts against the edge portion 449C of the slot 448C. In other words, as understood from FIGS. 43 and 57, a pair of the second abutment portion 510C and the second facing portion 422C and a pair of the end portion 472C of the upper accommodation portion 470C and the edge portion 449C of the slot 448C define the second predetermined position. However, the present invention is not limited thereto. The second predetermined position may be defined only by the pair of the second abutment portion 510C and the second facing portion 422C. In addition, the second predetermined position may be defined only by the pair of the end portion 472C of the upper accommodation portion 470C and the edge portion 449C of the slot 448C. Furthermore, the second predetermined position may be defined by other means.

In the present modification, the first predetermined position is arranged to satisfy the condition 1 described in the first embodiment, and the second predetermined position is arranged to satisfy the condition 2 described in the first embodiment. Accordingly, the connector assembly 100C of the present modification also has an effect similar to that of the first embodiment.

The structure of the mating connector 400C is not limited thereto. For example, the mating connector 400C can be modified as described below.

Figure 58:
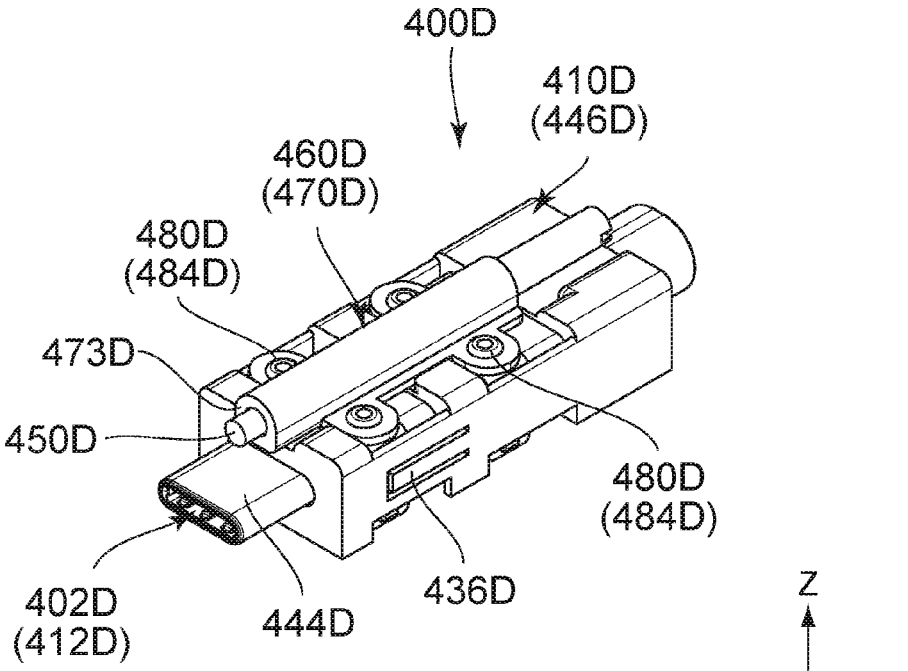
FIG. 58 is a top, perspective view showing a mating connector according to a third modification.

As shown in FIG. 58, a mating connector 400D according to a third modification comprises a mating connector main 410D, a single male screw member 450D and a screw holding member 460D. The male screw member 450D is positioned above the mating connector main 410D in the up-down direction.

Figure 59:
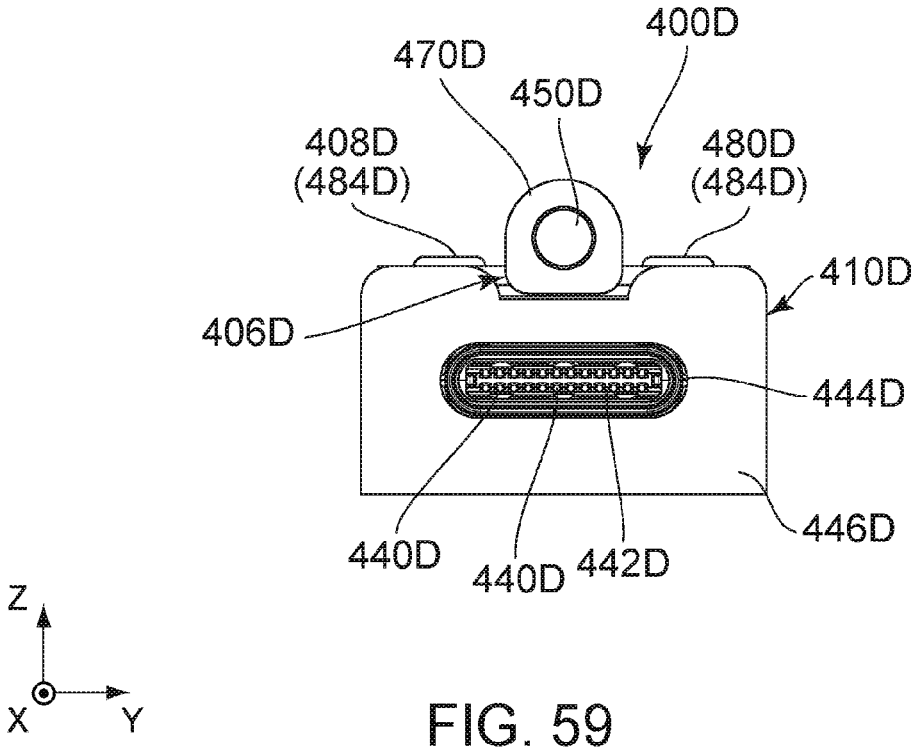
FIG. 59 is a front view showing the mating connector of FIG. 58.

As shown in FIG. 59, the mating connector main 410D comprises mating contacts 440D, a mating holding member 442D, a mating shell 444D and a hood 446D similar to the first embodiment. Specifically, the mating holding member 442D holds the mating contacts 440D, and the mating shell 444D covers the mating holding member 442D. Explanation about those components is omitted.

Figure 60:
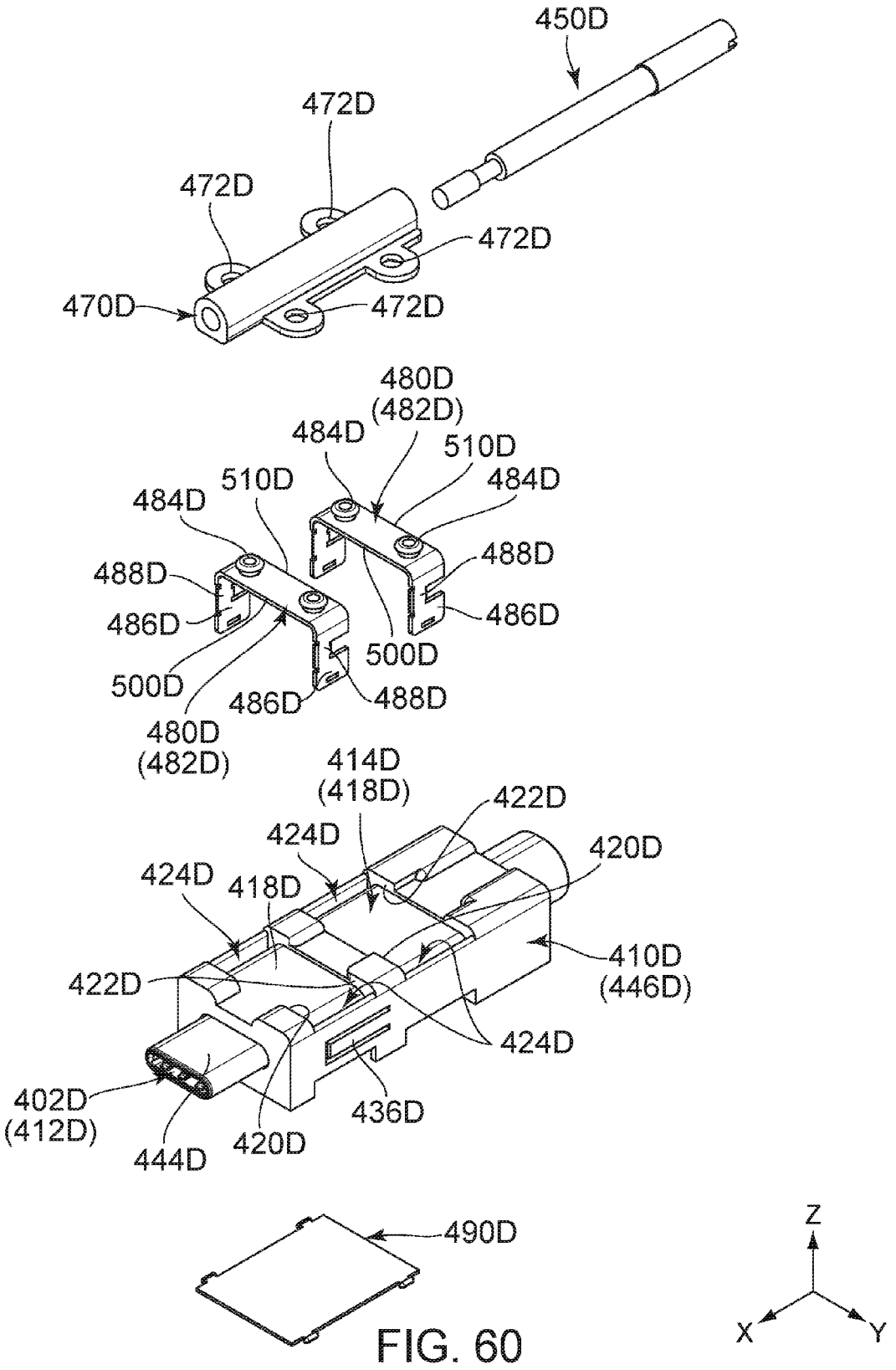
FIG. 60 is an exploded, perspective view showing the mating connector of FIG. 58.

As shown in FIG. 60, an upper surface 414D of the mating connector main 410D is provided with two slide surfaces 418D and two pairs each of which consists of a first facing portion 420D and a second facing portion 422D. The two slide surfaces 418D correspond to the two pairs, respectively, of the first facing portion 420D and the second facing portion 422D. In other words, the upper surface 414D is provided with two sets of the slide surface 418D, the first facing portion 420D and the second facing portion 422D. The first facing portion 420D is positioned beyond the second facing portion 422D in the first predetermined orientation, and the second facing portion 422D is positioned beyond the first facing portion 420D in the second predetermined orientation. However, the present invention is not limited thereto. The upper surface 414D of the mating connector main 410D may be provided only with the single slide surface 418D and a single pair of the first facing portion 420D and the second facing portion 422D. Each of the slide surfaces 418D is positioned between the first facing portion 420D and the second facing portion 422D of the corresponding pair in the predetermined direction. Each of the first facing portions 420D is a wall which is positioned at a side of the corresponding slide surface 418D in the first predetermined orientation and which stands in the up-down direction. Each of the second facing portions 422 is a wall which is positioned at another side of the corresponding slide surface 418 in the second predetermined orientation and which stands in the up-down direction. In the present modification, each of the slide surfaces 418D, the first facing portions 420D and the second facing portions 422D is formed on the hood 446D. Each of the first facing portions 420D functions as a regulated portion as described later.

Figure 62:
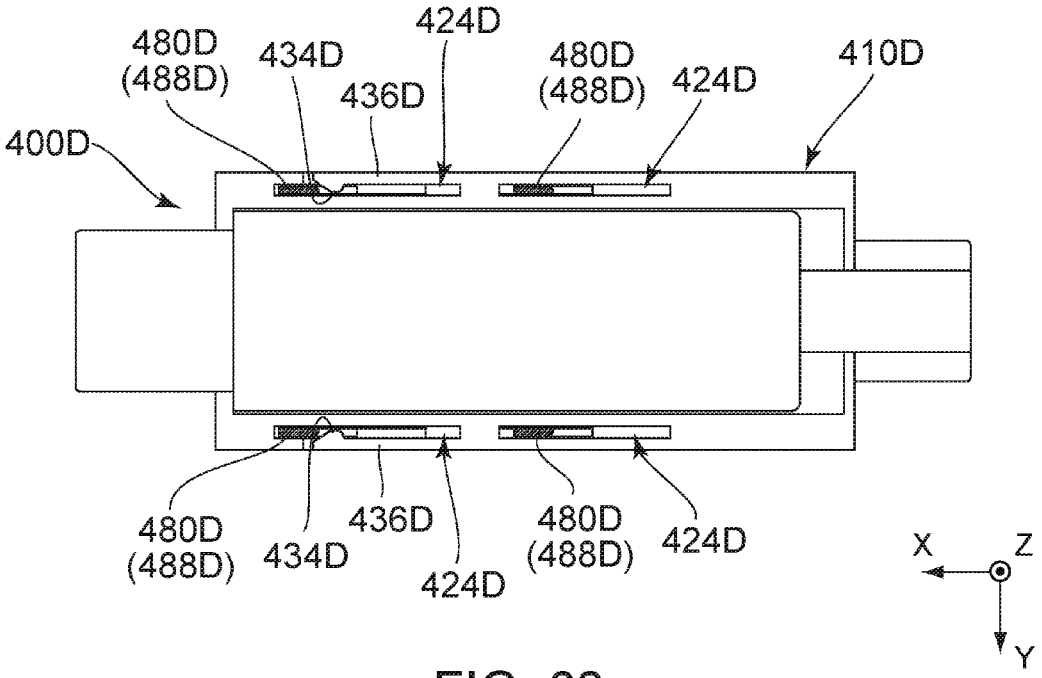
FIG. 62 is a view showing a positional relationship between each of positioning projections and each of positioned portions which are included in the mating connector of FIG. 58.
Figure 63:
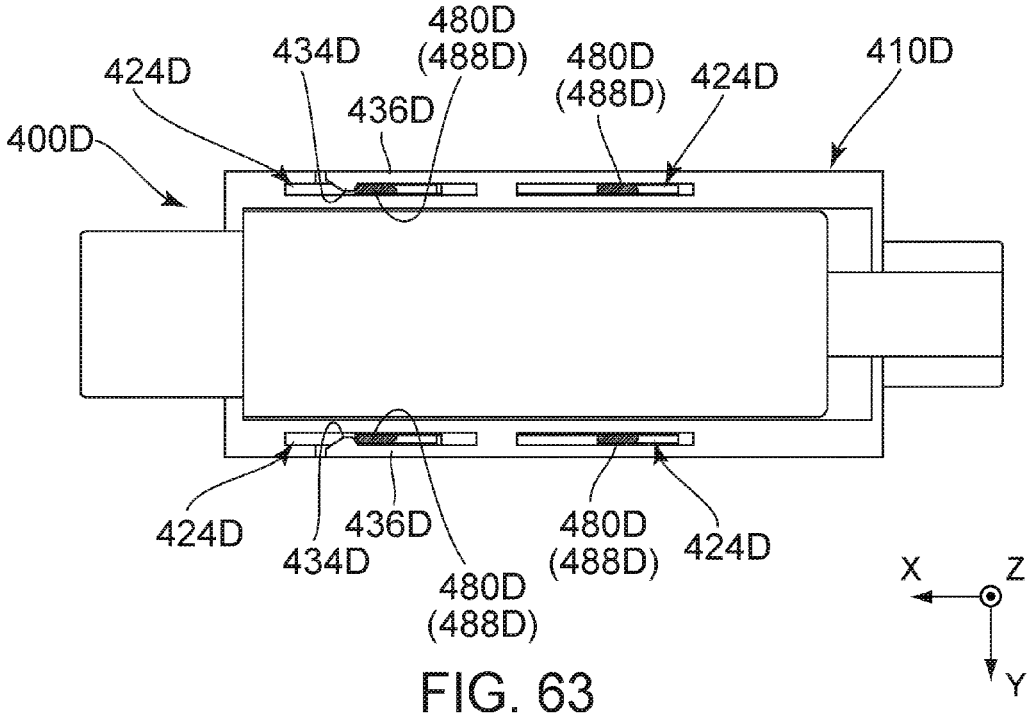
FIG. 63 is a view showing another positional relationship between each of the positioning projections and each of the positioned portions which are included in the mating connector of FIG. 58.

As understood from FIGS. 60, 62 and 63, the mating connector main 410D has two pairs, each of which consists of two ditches 424D, a pair of two spring portions 436D and a pair of two positioning projections 434D. Each of the ditches 424D extends in the predetermined direction. The two spring portions 436D correspond to the two positioning projections 434D, respectively. However, the present invention is not limited thereto. The mating connector main 410D may only have a single pair of the two ditches 424D, the pair of the two spring portions 436D and the pair of the two positioning projections 434D. The two spring portions 436D are provided in the two ditches 424D, respectively, which are positioned in the first predetermined orientation. Each of the spring portions 436D is resiliently deformable and supports the corresponding positioning projection 434D. Each of the positioning projections 434D projects into the corresponding ditch 424D in the lateral direction. Each of the positioning projections 434D is movable in the lateral direction by using resilience of the corresponding spring portion 436D. In the present modification, the ditches 424D and the positioning projections 434D are formed on the hood 446D.

Figure 61:
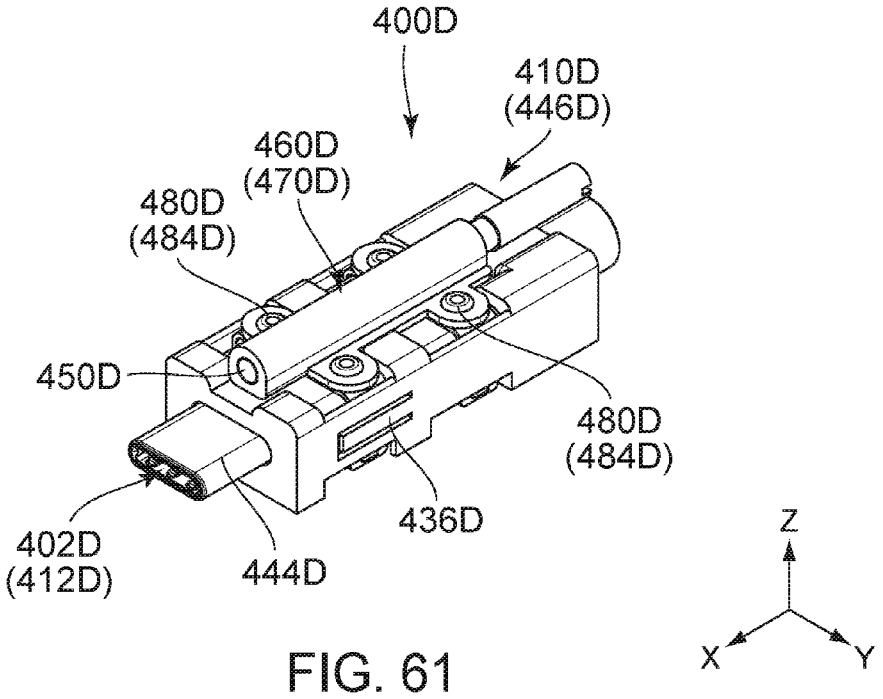
FIG. 61 is another top, perspective views showing the mating connector of FIG. 58.

As understood from FIGS. 58 and 61, the screw holding member 460D is attached to the mating connector main 410D and is relatively movable with respect to the mating connector main 410D along the predetermined direction between a first predetermined position and a second predetermined position. The first predetermined position is positioned beyond the second predetermined position in the first predetermined orientation, and the second predetermined position is positioned beyond the first predetermined position beyond the second predetermined orientation.

As shown in FIG. 60, in detail, the screw holding member 460D of the present modification comprises an upper accommodation member 470D, two movable members 480D and a lower plate 490D. As shown in FIG. 58, the upper accommodation member 470D is provided with a male screw seat 473D. As understood from FIGS. 43, 44 and 58, the male screw seat 473D is a surface which is brought into contact with the female screw seat when the male screw member 450D is connected with the female screw portion 380C. As shown in FIG. 58, the male screw seat 473D of the present embodiment is an end surface of the upper accommodation member 470D which faces in the first predetermined orientation. As shown in FIGS. 62 and 63, the movable members 480D correspond to the two pairs, respectively, of the aforementioned ditches 424D, and one of the movable members 480D corresponds to the pair of the positioning projections 434D. The screw holding member 460D may have the single movable member 480D. As understood from FIGS. 58 to 60, the upper accommodation member 470D is positioned above the mating connector main 410D and partially accommodates the male screw member 450D. The upper accommodation member 470D accommodates the male screw member 450D in a manner similar to a manner in which the screw accommodation member 470 of the aforementioned first embodiment accommodates the male screw member 450.

As understood from FIGS. 60, 62 and 63, each of the movable members 480D is held by the mating connector main 410D so as to be movable in the predetermined direction. As shown in FIG. 60, each of the movable members 480D has an upper portion 482D and side portions 486D. Specifically, the upper portion 482D is attached to the upper accommodation member 470D, and each of the side portions 486D extends downward in the up-down direction from the upper portion 482D. In the present modification, the upper portion 482D is formed with projections 484D, and the upper accommodation member 470D is formed with holes 472D. As understood from FIGS. 58 and 60, the projections 484D of the upper portion 482D of one of the movable members 480D are inserted into two of the holes 472D of the upper accommodation member 470D and are then crimped thereon. The projections 484D of the upper portion 482D of a remaining one of the movable members 480D are inserted into remaining two of the holes 472D of the upper accommodation member 470D and are then crimped thereon. Thus, the upper accommodation member 470D is fixed to the movable members 480D.

As understood from FIGS. 58, 60 and 61, the upper portions 482D of the movable members 480D are slidable on the slide surfaces 418D, respectively. As shown in FIG. 60, each of the movable members 480D has a first abutment portion (abutment portion) 500D and a second abutment portion 510D. In the present modification, the first abutment portion 500D is an edge portion of the upper portion 482D in the first predetermined orientation, and the second abutment portion 510D is an edge portion of the upper portion 482D in the second predetermined orientation. As shown in FIGS. 58, 60 and 61, the first abutment portion 500D is positioned beyond the second abutment portion 510D in the first predetermined orientation, and the second abutment portion 510D is positioned beyond the first abutment portion 500D in the second predetermined orientation. Each of the first abutment portions (abutment portion) 500D faces the corresponding first facing portion 420D in the predetermine direction and is positioned beyond the corresponding first facing portion 420D in the second predetermined orientation. Each of the second abutment portions 510D faces the corresponding second facing portion 422D in the predetermine direction and is positioned beyond the corresponding second facing portion 422D in the first predetermined orientation. Accordingly, each of the first facing portions 420D regulates a movement of the corresponding first abutment portion (abutment portion) 500D beyond the first facing portion 420D in the first predetermined orientation of the predetermined direction. Similarly, each of the second facing portions 422D regulates a movement of the corresponding second abutment portion 510D beyond the second facing portion 422D in the second predetermined orientation of the predetermined direction.

As understood from above, the first abutment portion (abutment portion) 500D of the present modification functions as a regulating portion which corresponds to the first facing portion (regulated portion) 420D. The regulating portion regulates a movement of the regulated portion beyond the regulating portion in the second predetermined orientation of the predetermined direction.

The side portions 486D of each of the movable members 480D are, at least in part, accommodated by the ditches 424D of the mating connector main 410D. A lower end of each of the side portions 486D projects downward of the mating connector main 410D, and the lower ends of the side portions 486D are coupled with each other by the lower plate 490D.

As shown in FIG. 60, each of the side portions 486D is provided with a positioned portion 488D. As understood from FIGS. 62 and 63, when the movable member 480D is moved along the predetermined direction, the positioned portions 488D ride over the positioning projections 434D which are supported by the spring portions 436D, respectively. The movable member 480D is positioned in the predetermined direction by positioning each of the positioned portions 488D beyond the corresponding positioning projection 434D in the first predetermined orientation or in the second predetermined orientation.

As understood from FIGS. 58, 60 and 62, in the present modification, when the screw holding member 460D is positioned at the first predetermined position, each of the first abutment portions (abutment portions) 500D abuts against the corresponding first facing portion 420D while each of the positioning projections 434D is positioned beyond the corresponding positioned portion 488D in the second predetermined orientation. In other words, pairs, each of which consists of the first abutment portion (abutment portion) 500D and the first facing portion 420D, and pairs each of which consists of the positioning projection 434D and the positioned portion 488D define the first predetermined position. However, the present invention is not limited thereto. The first predetermined position may be defined only by the pairs of the first abutment portion (abutment portion) 500D and the first facing portion 420D. In addition, the first predetermined position may be defined only by the pairs of the positioning projection 434D and the positioned portion 488D. Furthermore, the first predetermined position may be defined by other means.

As understood from FIGS. 60, 61 and 63, in the present modification, when the screw holding member 460D is positioned at the second predetermined position, each of the second abutment portions 510D abuts against the corresponding second facing portion 422D while each of the positioning projections 434D is positioned beyond the corresponding positioned portion 488D in the first predetermined orientation. In other words, the pairs of the second abutment portion 510D and the second facing portion 422D and the pairs of the positioning projection 434D and the positioned portion 488D define the second predetermined position. However, the present invention is not limited thereto. The second predetermined position may be defined only by the pairs of the second abutment portion 510D and the second facing portion 422D. In addition, the second predetermined position may be defined only by the pairs of the positioning projection 434D and the positioned portion 488D. Furthermore, the second predetermined position may be defined by other means.

In the present modification, the first predetermined position is arranged to satisfy the condition 1 described in the first embodiment, and the second predetermined position is arranged to satisfy the condition 2 described in the first embodiment. Accordingly, the connector assembly 100C of the present modification also has an effect similar to that of the first embodiment.

(Third Embodiment)

Figure 64:
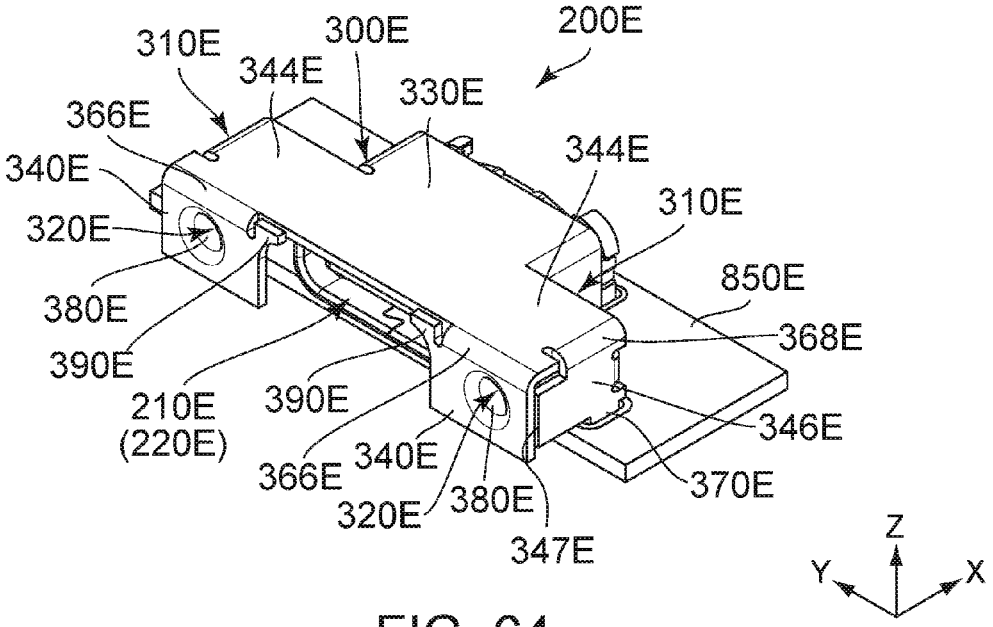
FIG. 64 is a top, perspective view showing a connector according to a third embodiment of the present invention.

Referring to FIG. 64, a connector 200E of a connector assembly according to a third embodiment of the present invention is a modification of the connector 200 of the first embodiment of FIG. 3 as described above. Specifically, similar to the connector 200 of the first embodiment, the connector 200E is connectable with the mating connector 400 along a predetermined direction. Specifically, when the connector 200E is used, the connector 200E is mounted on a circuit board 850E as a mount object in an up-down direction. Accordingly, explanation about the mating connector 400 and its modifications is omitted. Also in the present embodiment, the up-down direction is the Z-direction. Specifically, the positive Z-direction is upward, the negative Z-direction is downward. Furthermore, the predetermined direction is the X-direction. The positive X-direction is rearward of the connector 200E, and the negative X-direction is forward of the connector 200E.

Figure 65:
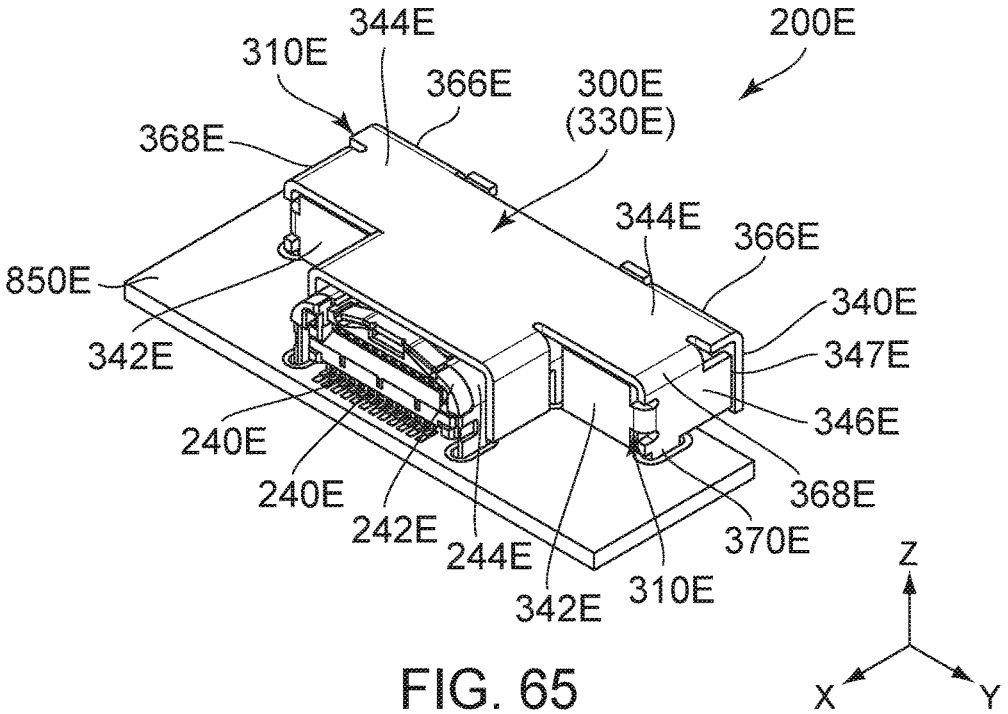
FIG. 65 is another top, perspective view showing the connector of FIG. 64.
Figure 66:
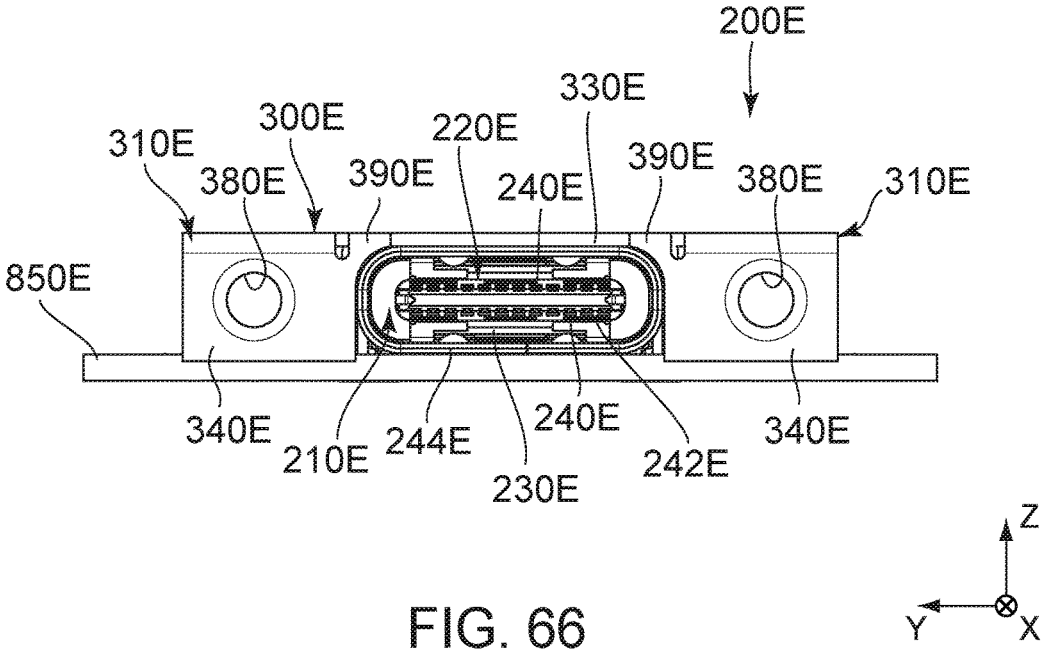
FIG. 66 is a front view showing the connector of FIG. 64.
Figure 67:
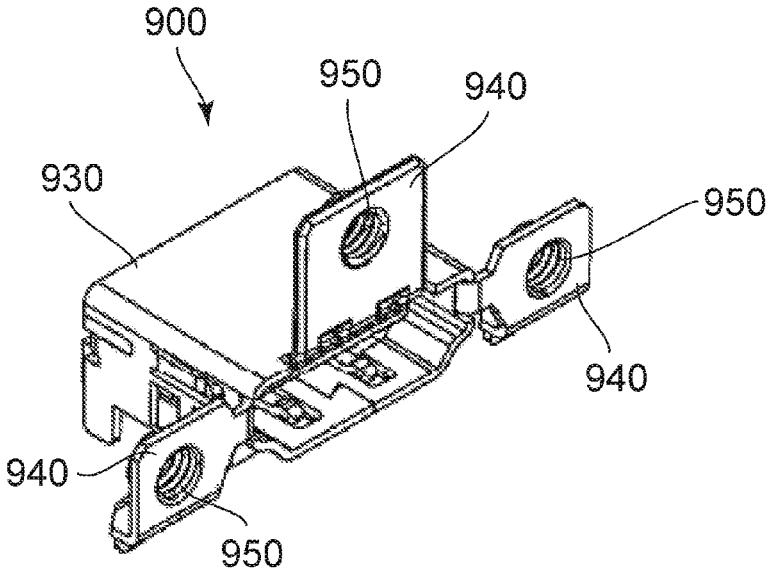
FIG. 67 PRIOR ART
FIG. 67 is a front, perspective view showing a receptacle of Patent Document 1.
Figure 68:
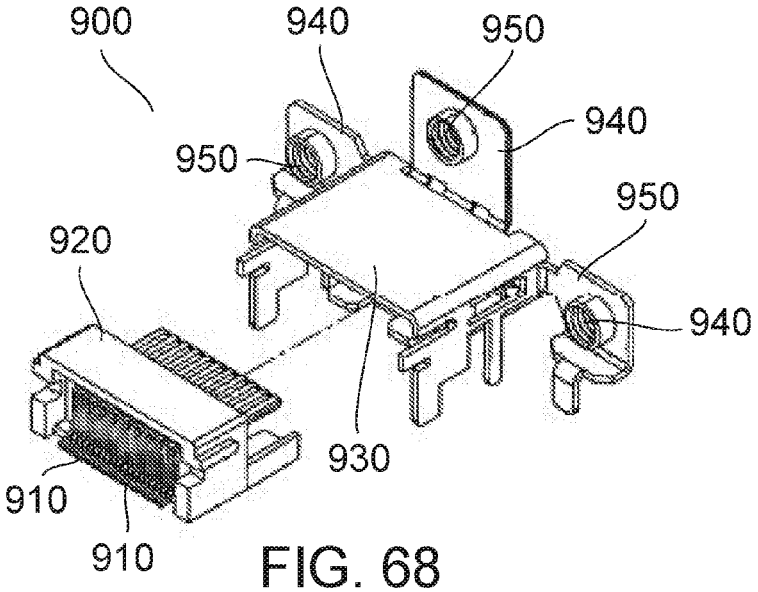
FIG. 68 PRIOR ART
FIG. 68 is an exploded, rear, perspective view showing the receptacle of FIG. 66.

As understood from FIGS. 64 to 66, the connector 200E comprises contacts 240E, a holding member 242E, a shell 244E and a screw fixing member 300E. The contacts 240E, the holding member 242E and the shell 244E are same as those of the aforementioned first embodiment and form a fitting portion 210E which is mateable with the mating fitting portion.

The screw fixing member 300E of the present embodiment is distinct and separated from the shell 244E. The screw fixing member 300E comprises two screw end accommodation portions 310E and a coupling portion 330E. In other words, each of the screw end accommodation portions 310E of the present embodiment is formed as a part of the screw fixing member 300E. However, the present invention is not limited thereto. Each of the screw end accommodation portions 310E may be formed as a part of the shell 244E. The aforementioned fitting portion 210E is positioned between the two screw end accommodation portions 310E in a lateral direction. Also in the present embodiment, the lateral direction is the Y-direction.

As understood from FIGS. 1, 3 and 64, the screw end accommodation portions 310E define accommodation spaces 320E which accommodate ends of the male screw members 450, respectively, when the connector 200E is connected with the mating connector 400. In other words, the connector 200E of the present embodiment defines the accommodation spaces 320E each similar to the accommodation space 320 of FIG. 8. As understood from FIGS. 64 and 65, each of the screw end accommodation portions 310E has a front surface portion 340E, an upper surface portion 344E, a rear surface portion 342E, an outer surface portion 346E, an upper front bent portion 366E and an upper outside bent portion 368E.

The front surface portion 340E is provided with a female screw portion 380E which is connectable with the male screw member 450. As understood from FIGS. 1, 3 and 64, the front surface portion 340E functions as a female screw seat when the connector 200E is connected with the mating connector 400. As shown in FIG. 66, the front surface portion 340E of the present embodiment is formed with a projection portion 390E. The projection portion 390E projects inward in the lateral direction. The projection portion 390E has a shape which corresponds to a shape of an opening, or a roughly elliptical shape, of the shell 244E. The projection portion 390E coves a gap which might be formed between the shell 244E and the front surface portion 340E.

As understood from FIG. 65, the rear surface portion 342E faces the front surface portion 340E in the predetermined direction. As understood from FIGS. 8 and 65, the accommodation space 320E is positioned between the front surface portion 340E and the rear surface portion 342E in the predetermined direction.

As understood from FIGS. 8 and 64, the upper surface portion 344E is positioned above the accommodation space 320E in the up-down direction. As shown in FIG. 64, the upper surface portion 344E is connected with the front surface portion 340E by the upper front bent portion 366E.

As understood from FIGS. 8, 64 and 65, the outer surface portion 346E is positioned outward of the accommodation space 320E in the lateral direction and faces outward in the lateral direction. As shown in FIGS. 64 and 65, the outer surface portion 346E is connected with the upper surface portion 344E by the upper outside bent portion 368E. A front edge 347E of the outer surface portion 346E faces the front surface portion 340E in the predetermined direction and is positioned slightly away from the front surface portion 340E. Accordingly, when a force is applied to the front surface portion 340E, the outer surface portion 346E can receive the force. In other words, the outer surface portion 346E reinforces the front surface portion 340E.

In addition, the outer surface portion 346E is provided with a fixed portion 370E which is soldered to be fixed to the circuit board 850E when the connector 200E is mounted on the circuit board 850E. Accordingly, the outer surface portion 346E is fixed to the circuit board 850E by the fixed portion 370E. Thus, the front surface portion 340E is rigidly reinforced by the outer surface portion 346E.

Each of the fixed portions 370E has a size in the predetermined direction and another size in the lateral direction. In particular, the size of the fixed portion 370E in the predetermined direction is greater than the size of the fixed portion 370E in the lateral direction. Since the outer surface portion 346E is fixed to the circuit board 850E through the aforementioned fixed portion 370E, the outer surface portion 346E has a resistance to a force along the predetermined direction. Accordingly, the front surface portion 340E is more rigidly reinforced by the outer surface portion 346E.

As shown in FIGS. 64 and 65, the coupling portion 330E is positioned above the shell 244E in the up-down direction and couples the screw end accommodation portions 310E with each other in the lateral direction. Specifically, the coupling portion 330E of the present embodiment couples the upper surface portions 344E with each other.

As understood from FIGS. 8 and 64, the accommodation space 320E is surrounded by the screw end accommodation portion 310E except for its lower part and its inside part in the lateral direction. As understood from FIGS. 8, 64 and 66, the shell 244E is positioned inward beyond the accommodation space 320E in the lateral direction. In addition, under a state where the connector 200E is mounted on the circuit board 850E, the circuit board 850E is partially positioned below each of the accommodation spaces 320E. Accordingly, even if foreign bodies enter into the connector 200E from the female screw portions 380E under a state where the connector 200E is not connected with the mating connector 400, the foreign bodies have high probability to stay in the accommodation spaces 320E. Thus, foreign bodies can be prevented from entering into an inside of a housing (not shown) of an electronic equipment (not shown) in which the connector 200E is installed.

While the present invention has been described with specific embodiments, the present invention is not limited to the aforementioned embodiments. For example, although the screw holding member 460, 460A, 460B, 460C, 460D is relatively movable along the predetermined direction with respect to the mating connector main 410, 410A, 410B, 410C, 410D, the screw holding member 460, 460A, 460B, 460C, 460D may be fixed to the mating connector main 410, 410A, 4108, 410C, 410D.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on a mount object in an up-down direction and connectable with a mating connector along a predetermined direction perpendicular to the up-down direction, the mating connector including a mating fitting portion and two male screw members, the mating fitting portion having a mating contact, and the male screw members having ends in the predetermined direction, the connector comprising:

a fitting portion; and two screw end accommodation portions;

wherein:

the fitting portion is mateable with the mating fitting portion;

the fitting portion has a contact which is brought into contact with the mating contact when the fitting portion is mated with the mating fitting portion;

each of the screw end accommodation portions defines an accommodation space which is configured to accommodate the end of one of the male screw members when the connector is connected with the mating connector;

each of the screw end accommodation portions has at least a front surface portion, an upper surface portion, a rear surface portion and an outer surface portion;

the front surface portion is provided with a female screw portion which is connectable with one of the male screw members;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the fitting portion is positioned between the two screw end accommodation portions in the lateral direction;

each of the screw end accommodation portions has a rear upper bent portion which connects the upper surface portion with the rear surface portion;

the upper surface portion has a front edge in the predetermined direction;

in the predetermined direction, the front edge of the upper surface portion faces the front surface portion and is positioned away from the front surface portion; and the rear surface portion has a fixed portion which is fixed to the mount object when the connector is mounted on the mount object.

2. The connector as recited in claim 1, wherein:

each of the screw end accommodation portions has a front outside bent portion which connects the front surface portion with the outer surface portion; and in the up-down direction, the front outside bent portion has a size same as one of a size of the front surface portion and a size of the outer surface portion.

3. A connector mountable on a mount object in an up-down direction and connectable with a mating connector along a predetermined direction perpendicular to the up-down direction, the mating connector including a mating fitting portion and two male screw members, the mating fitting portion having a mating contact, and the male screw members having ends in the predetermined direction, the connector comprising:

a fitting portion; and two screw end accommodation portions;

wherein:

the fitting portion is mateable with the mating fitting portion;

the fitting portion has a contact which is brought into contact with the mating contact when the fitting portion is mated with the mating fitting portion;

each of the screw end accommodation portions defines an accommodation space which is configured to accommodate the end of one of the male screw members when the connector is connected with the mating connector;

each of the screw end accommodation portions has at least a front surface portion, an upper surface portion, a rear surface portion and an outer surface portion;

the front surface portion is provided with a female screw portion which is connectable with one of the male screw members;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the fitting portion is positioned between the two screw end accommodation portions in the lateral direction;

each of the screw end accommodation portions has an inner surface portion and a front inside bent portion;

the inner surface portion faces the outer surface portion in the lateral direction; and the front inside bent portion connects the inner surface portion with the front surface portion.

4. A connector mountable on a mount object in an up-down direction and connectable with a mating connector along a predetermined direction perpendicular to the up-down direction, the mating connector including a mating fitting portion and two male screw members, the mating fitting portion haying a mating contact, and the male screw members having ends in the predetermined direction, the connector comprising:

a fitting portion; and two screw end accommodation portions;

wherein:

the fitting portion is mateable with the mating fitting portion;

the fitting portion has a contact which is brought into contact with the mating contact when the fitting portion is mated with the mating fitting portion;

each of the screw end accommodation portions defines an accommodation space which is configured to accommodate the end of one of the male screw members when the connector is connected with the mating connector;

each of the screw end accommodation portions has at least a front surface portion, an upper surface portion, a rear surface portion and an outer surface portion;

the front surface portion is provided with a female screw portion which is connectable with one of the male screw members;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the fitting portion is positioned between the two screw end accommodation portions in the lateral direction;

the outer surface portion has a front edge in the predetermined direction;

in the predetermined direction, the front edge of the outer surface portion of each of the screw end accommodation portions faces the front surface portion and is positioned away from the front surface portion; and the outer surface portion has a fixed portion which is fixed to the mount object when the connector is mounted on the mount object.

5. The connector as recited in claim 4, wherein:

each of the screw end accommodation portions has an upper front bent portion and an upper outside bent portion;

the upper front bent portion connects the front surface portion with the upper surface portion; and the upper outside bent portion connects the upper surface portion with the outer surface portion.

6. The connector as recited in claim 1, wherein:

each of the fixed portions has a size in the predetermined direction and another size in the lateral direction; and the size of the fixed portion in the predetermined direction is greater than the size of the fixed portion in the lateral direction.

7. A connector mountable on a mount object in an up-down direction and connectable with a mating connector along a predetermined direction perpendicular to the up-down direction, the mating connector including a mating fitting portion and two male screw members, the mating fitting portion haying a mating contact, and the male screw members having ends in the predetermined direction, the connector comprising:

a fitting portion;

two screw end accommodation portions;

a holding member;

a shell; and a screw fixing member;

wherein:

the fitting portion is mateable with the mating fitting portion;

the fitting portion has a contact which is brought into contact with the mating contact when the fitting portion is mated with the mating fitting portion;

each of the screw end accommodation portions defines an accommodation space which is configured to accommodate the end of one of the male screw members when the connector is connected with the mating connector;

each of the screw end accommodation portions has at least a front surface portion, an upper surface portion, a rear surface portion and an outer surface portion;

the front surface portion is provided with a female screw portion which is connectable with one of the male screw members;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the fitting portion is positioned between the two screw end accommodation portions in the lateral direction;

the holding member holds the contact;

the shell surrounds the holding member in a direction perpendicular to the predetermined direction;

the screw fixing member is distinct and separated from the shell;

each of the screw end accommodation portions is formed as a part of the screw fixing member;

the screw fixing member comprises a coupling portion;

the coupling portion is positioned above the shell in the up-down direction; and the coupling portion couples the screw end accommodation portions with each other in the lateral direction.

8. A connector mountable on a mount object in an up-down direction and connectable with a mating connector along a predetermined direction perpendicular to the up-down direction, the mating connector including a mating fitting portion and a male screw member, the mating fitting portion having a mating contact, and the male screw member having an end in the predetermined direction, the connector comprising:

a fitting portion; and a screw end accommodation portion;

wherein:

the fitting portion is mateable with the mating fitting portion;

the fitting portion has a contact which is brought into contact with the mating contact when the fitting portion is mated with the mating fitting portion;

the screw end accommodation portion defines an accommodation space which accommodates the end of the male screw member when the connector is connected with the mating connector;

the screw end accommodation portion has at least a front surface portion, an upper surface portion, a rear surface portion and an outer surface portion;

the front surface portion is provided with a female screw portion which is connectable with the male screw member;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the screw end accommodation portion is positioned above the fitting portion in the up-down direction;

the screw end accommodation portion has two of the outer surface portions;

the screw end accommodation portion has two reinforcing portions which correspond to the outer surface portions, respectively;

each of the reinforcing portions extends inward in the lateral direction from the corresponding outer surface portion;

each of the reinforcing portions is positioned below the upper surface portion in the up-down direction; and each of the reinforcing portions is positioned between the front surface portion and the rear surface portion in the predetermined direction.

9. The connector as recited in claim 8, wherein:

the screw end accommodation portion has two side front bent portions;

the side front bent portions correspond to the outer surface portions, respectively; and each of the side front bent portions connects the corresponding outer surface portion and the front surface portion with each other.

10. The connector as recited in claim 8, wherein each of the outer surface portions has a fixed portion which is fixed to the mount object when the connector is mounted on the mount object.

11. The connector as recited in claim 10, wherein:

each of the fixed portions has a size in the predetermined direction and another size in the lateral direction; and the size of the fixed portion in the predetermined direction is greater than the size of the fixed portion in the lateral direction.

12. A connector mountable on a mount object in an up-down direction and connectable with a mating connector along a predetermined direction perpendicular to the up-down direction, the mating connector including a mating fitting portion and a male screw member, the mating fitting portion having a mating contact, and the male screw member having an end in the predetermined direction, the connector comprising:

a fitting portion;

a screw end accommodation portion;

a holding member;

a shell; and a screw fixing member;

wherein:

the fitting portion is mateable with the mating fitting portion;

the fitting portion has a contact which is brought into contact with the mating contact when the fitting portion is mated with the mating fitting portion;

the screw end accommodation portion defines an accommodation space which accommodates the end of the male screw member when the connector is connected with the mating connector;

the screw end accommodation portion has at least a front surface portion, an upper surface portion, a rear surface portion and an outer surface portion;

the front surface portion is provided with a female screw portion which is connectable with the male screw member;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the screw end accommodation portion is positioned above the fitting portion in the up-down direction;

the screw end accommodation portion has two of the outer surface portions;

the holding member holds the contact;

the shell surrounds the holding member in a direction perpendicular to the predetermined direction;

the screw fixing member is distinct and separated from the shell;

the screw end accommodation portion is formed as a part of the screw fixing member;

the front surface portion has a lower end in the up-down direction;

the screw fixing member has a bottom surface portion which extends rearward in the predetermined direction from the lower end of the front surface portion; and the bottom surface portion is connected with an upper part of the shell.

13. A connector assembly comprising:

a connector; and a mating connector;

wherein:

the connector is mountable on a mount object in an up-down direction and connectable with the mating connector along a predetermined direction perpendicular to the up-down direction;

the mating connector comprises a mating fitting portion and a male screw member;

the mating fitting portion has a mating contact;

the connector comprises a fitting portion and a screw end accommodation portion;

the fitting portion is mateable with the mating fitting portion;

the fitting portion has a contact which is brought into contact with the mating contact when the fitting portion is mated with the mating fitting portion;

the male screw member has an end in the predetermined direction;

the screw end accommodation portion defines an accommodation space which accommodates the end of the male screw member when the connector is connected with the mating connector;

the screw end accommodation portion has at least a front surface portion, an upper surface portion, a rear surface portion and an outer surface portion;

the front surface portion is provided with a female screw portion which is connectable with the male screw member;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the front surface portion of the screw end accommodation portion functions as a female screw seat;

in the predetermined direction, the mating connector is connectable with the connector along a first predetermined orientation and is removable from the connector along a second predetermined orientation opposite to the first predetermined orientation;

the mating connector comprises a mating connector main, the male screw member and a screw holding member;

the mating connector main is mateable with the fitting portion along the first predetermined orientation;

the mating connector main has the mating contact which is brought into contact with the contact when the connector and the mating connector are connected with each other;

the screw holding member holds the male screw member;

the screw holding member has a male screw seat which is brought into contact with the female screw seat when the male screw member is connected with the female screw portion;

the male screw seat faces in the first predetermined orientation;

the screw holding member is attached to the mating connector main; and the screw holding member is relatively movable with respect to the mating connector main in the predetermined direction.

14. The connector assembly as recited in claim 13, wherein the male screw member is relatively movable with respect to the screw holding member in the predetermined direction.

15. The connector assembly as recited in claim 14, wherein:

the screw holding member is provided with an accommodation portion and a projection;

the accommodation portion extends in the predetermined direction;

the projection projects into the accommodation portion in a plane perpendicular to the predetermined direction;

the male screw member is formed with a recess which is recessed in a direction perpendicular to the predetermined direction; and the male screw member is partially accommodated in the accommodation portion while the projection is accommodated in the recess.

16. The connector assembly as recited in claim 13, wherein:

the mating connector main has an end in the first predetermined orientation;

the screw holding member is movable between a first predetermined position and a second predetermined position along the predetermined direction;

the first predetermined position is positioned beyond the second predetermined position in the first predetermined orientation while the second predetermined position is positioned beyond the first predetermined position in the second predetermined orientation;

the fitting portion has a receiving portion which has an inner wall in the predetermined direction;

when the mating connector is connected with the connector, the mating connector main is partially received in the receiving portion of the fitting portion; and when the screw holding member is positioned at the first predetermined position, the end of the mating connector main faces the inner wall of the fitting portion but does not reach the inner wall under a state where the male screw member is connected with the female screw portion and where the male screw seat is brought into contact with the female screw seat.

17. The connector assembly as recited in claim 16, wherein:

the mating connector main is to be connected with a cable which extends in the second predetermined orientation;

the mating connector main is provided with a regulated portion;

the screw holding member is provided with a regulating portion;

the regulating portion is arranged to be positioned beyond the regulated portion in the second predetermined orientation of the predetermined direction;

the regulating portion faces the regulated portion in the predetermined direction; and the regulating portion regulates a movement of the regulated portion beyond the regulating portion in the second predetermined orientation.

18. The connector assembly as recited in claim 17, wherein the regulating portion and the regulated portion define the first predetermined position of the screw holding member.

19. A connector assembly comprising:

a connector; and a mating connector;

wherein:

the connector is mountable on a mount object in an up-down direction and connectable with the mating connector along a predetermined direction perpendicular to the up-down direction;

the mating connector comprises a mating fitting portion and two male screw members;

the mating fitting portion has a mating contact;

the connector comprises a fitting portion and two screw end accommodation portions;

the fitting portion is mateable with the mating fitting portion;

the fitting portion has a contact which is brought into contact with the mating contact when the fitting portion is mated with the mating fitting portion;

the male screw members have ends in the predetermined direction;

each of the screw end accommodation portions defines an accommodation space which accommodates the end of one of the male screw members when the connector is connected with the mating connector;

each of the screw end accommodation portions has at least a front surface portion, an upper surface portion, a rear surface portion and an outer surface portion;

the front surface portion is provided with a female screw portion which is connectable with one of the male screw members;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction;

the fitting portion is positioned between the two screw end accommodation portions in the lateral direction;

the front surface portion of each of the screw end accommodation portions functions as a female screw seat;

in the predetermined direction, the mating connector is connectable with the connector along a first predetermined orientation and is removable from the connector along a second predetermined orientation opposite to the first predetermined orientation;

the mating connector comprises a mating connector main, the two male screw members and a screw holding member;

the mating connector main is positioned between the two male screw members in the lateral direction;

the mating connector main is mateable with the fitting portion along the first predetermined orientation;

the mating connector main has the mating contact which is brought into contact with the contact when the connector and the mating connector are connected with each other;

the screw holding member holds the male screw members;

the screw holding member has two male screw seats which are brought into contact with the female screw seats when the male screw members are connected with the female screw portions, respectively;

each of the male screw seats faces in the first predetermined orientation;

the screw holding member is attached to the mating connector main; and the screw holding member is relatively movable with respect to the mating connector main in the predetermined direction.

20. The connector assembly as recited in claim 19, wherein each of the male screw members is relatively movable with respect to the screw holding member in the predetermined direction.

21. The connector assembly as recited in claim 19, wherein:

the screw holding member comprises two screw accommodation members, an upper movable member and a lower movable member;

the screw accommodation members partially accommodate the male screw members, respectively;

each of the upper movable member and the lower movable member couples the screw accommodation members with each other in the lateral direction;

the upper movable member and the lower movable member sandwich the mating connector main in the up-down direction;

the mating connector main has an upper surface and a lower surface in the up-down direction;

the upper movable member is movable on the upper surface of the mating connector main in the predetermined direction; and the lower movable member is movable on the lower surface of the mating connector main in the predetermined direction.

22. The connector assembly as recited in claim 21, wherein:

at least one of the upper movable member and the lower movable member has an abutment portion which faces in the first predetermined orientation;

at least one of the upper surface and the lower surface of the mating connector main is provided with a facing portion which faces in the second predetermined orientation; and the facing portion faces the abutment portion in the predetermined direction and regulates a movement of the abutment portion beyond the facing portion in the first predetermined orientation.

23. The connector assembly as recited in claim 21, wherein:

at least one of the upper movable member and the lower movable member has a positioning projection which projects inward in the up-down direction;

at least one of the upper surface and the lower surface of the mating connector main is provided with a first recess and a second recess which are positioned away from each other in the predetermined direction; and the positioning projection is accommodated in one of the first recess and the second recess so that the screw holding member is relatively positioned with respect to the mating connector main in the predetermined direction.

24. The connector assembly as recited in claim 19, wherein:

the screw holding member is formed with two side accommodation portions and a center accommodation portion;

each of the side accommodation portions and the center accommodation portion pierces the screw holding member in the predetermined direction;

the side accommodation portions partially accommodate the male screw members, respectively;

the center accommodation portion is positioned between the side accommodation portions in the lateral direction; and the center accommodation portion partially accommodates the mating connector main so as to be movable in the predetermined direction.

25. The connector assembly as recited in claim 24, wherein:

the center accommodation portion is provided with an abutment portion which faces in the first predetermined orientation;

the mating connector main is provided with a facing portion which faces in the second predetermined orientation; and the facing portion faces the abutment portion in the predetermined direction and regulates a movement of the abutment portion beyond the facing portion in the first predetermined orientation.

26. The connector assembly as recited in claim 24, wherein:

the screw holding member is provided with two projecting portions and two abutment portions;

the projecting portions are positioned away from each other in the lateral direction;

parts of the side accommodation portions are positioned in the projecting portions, respectively;

each of the projecting portions has an end in the second predetermined orientation;

the abutment portions correspond to the projecting portions, respectively;

each of the abutment portions is positioned around the end of the corresponding projecting portion;

each of the projecting portions has another end in the first predetermined orientation;

the another ends of the projecting portions function as the male screw seats, respectively;

the mating connector main is provided with two facing wall portions;

the facing wall portions are positioned away from each other in the lateral direction;

each of the facing wall portions is formed with a through hole which pierces the facing wall portion in the predetermined direction;

the projecting portions are able to project in the first predetermined orientation through the through holes, respectively, by a relative movement of the screw holding member with respect to the mating connector main;

the abutment portions face the facing wall portions, respectively, in the predetermined direction;

each of the abutment portions is positioned beyond the corresponding facing wall portion in the second predetermined orientation; and a maximum amount of projection of each of the projecting portions from the corresponding facing wall portion is defined by the corresponding abutment portion abutting against the corresponding facing wall portion.

27. The connector assembly as recited in claim 24, wherein:

the screw holding member has a positioning projection which projects inward of the center accommodation portion in the up-down direction;

the mating connector main is provided with a positioning recess which accommodates the positioning projection; and the positioning recess regulates a movement of the positioning projection beyond the positioning recess in the second predetermined orientation.

28. The connector assembly as recited in claim 24, wherein:

the mating connector main is formed with an operation portion;

the operation portion is formed with a stopped portion;

the screw holding portion is provided with a stopping portion and a slot;

the slot extends from the stopping portion in the second predetermined orientation;

the slot partially accommodates the operation portion;

under a state where the operation portion is not operated, the stopped portion is positioned beyond the stopping portion in the first predetermined orientation to regulate a movement of the screw holding member in the first predetermined orientation; and when the operation portion is operated so that the stopped portion is moved in the up-down direction, the stopping portion is released from the stopped portion so that the screw holding member is movable in the first predetermined orientation.

29. The connector assembly as recited in claim 24, wherein:

the screw holding member has a positioning projection which projects inward of the center accommodation portion in the up-down direction;

the mating connector main is provided with a first recess and a second recess;

each of the first recess and the second recess is recessed inward in the up-down direction;

the first recess and the second recess are positioned away from each other in the predetermined direction; and the positioning projection is accommodated in one of the first recess and the second recess so that the screw holding member is relatively positioned with respect to the mating connector main in the predetermined direction.

30. A connector assembly comprising:

a connector; and a mating connector;

wherein:

the connector is mountable on a mount object in an up-down direction and connectable with the mating connector along a predetermined direction perpendicular to the up-down direction;

the mating connector comprises a mating fitting portion and a male screw member;

the mating fitting portion has a mating contact;

the connector comprises a fitting portion and a screw end accommodation portion;

the fitting portion is mateable with the mating fitting portion;

the fitting portion has a contact which is brought into contact with the mating contact when the fitting portion is mated with the mating fitting portion;

the male screw member has an end in the predetermined direction;

the screw end accommodation portion defines an accommodation space which accommodates the end of the male screw member when the connector is connected with the mating connector;

the screw end accommodation portion has at least a front surface portion, an upper surface portion, a rear surface portion and an outer surface portion;

the front surface portion is provided with a female screw portion which is connectable with the male screw member;

the rear surface portion faces the front surface portion in the predetermined direction;

the accommodation space is positioned between the front surface portion and the rear surface portion in the predetermined direction;

the upper surface portion faces an upper side of the accommodation space in the up-down direction;

the outer surface portion faces outward in a lateral direction perpendicular to both the predetermined direction and the up-down direction the screw end accommodation portion is positioned above the fitting portion in the up-down direction;

the screw end accommodation portion has two of the outer surface portions;

the front surface portion of the screw end accommodation portion functions as a female screw seat;

in the predetermined direction, the mating connector is connectable with the connector along a first predetermined orientation and is removable from the connector along a second predetermined orientation opposite to the first predetermined orientation;

the mating connector comprises a mating connector main, a single male screw member and a screw holding member;

the male screw member is positioned above the mating connector main in the up-down direction;

the mating connector main is mateable with the fitting portion along the first predetermined orientation;

the mating connector main has the mating contact which is brought into contact with the contact when the connector and the mating connector are connected with each other;

the screw holding member holds the male screw member;

the screw holding member has a male screw seat which is brought into contact with the female screw seat when the male screw member is connected with the female screw portion;

the male screw seat faces in the first predetermined orientation;

the screw holding member is attached to the mating connector main; and the screw holding member is relatively movable with respect to the mating connector main in the predetermined direction.

31. The connector assembly as recited in claim 30, wherein the male screw member is relatively movable with respect to the screw holding member in the predetermined direction.

32. The connector assembly as recited in claim 30, wherein:

the screw holding member comprises an upper accommodation member and a movable member;

the movable member is held by the mating connector main so as to be movable in the predetermined direction; and the upper accommodation member is attached to the movable member and partially accommodates the male screw member.

33. The connector assembly as recited in claim 32, wherein:

the mating connector main has a ditch and a positioning projection;

the ditch extends in the predetermined direction;

the positioning projection projects into the ditch in the lateral direction;

the movable member has an upper portion and a side portion;

the upper accommodation member is attached to the upper portion;

the side portion extends downward in the up-down direction from the upper portion;

the side portion is, at least in part, accommodated by the ditch;

the side portion is provided with a positioned portion;

when the movable member is moved along the predetermined direction, the positioned portion rides over the positioning projection; and the movable member is positioned in the predetermined direction by positioning the positioned portion beyond the positioning projection in the first predetermined orientation or in the second predetermined orientation.

34. The connector assembly as recited in claim 33, wherein:

the upper portion of the movable member has an abutment portion which faces in the first predetermined orientation;

the mating connector main is provided with a facing portion which faces in the second predetermined orientation; and the facing portion faces the abutment portion in the predetermined direction and regulates a movement of the abutment portion beyond the facing portion in the first predetermined orientation.

35. The connector assembly as recited in claim 30, wherein:

the mating connector main is formed with a slot;

the screw holding member has a movable portion and an upper accommodation portion;

the movable portion is accommodated in the mating connector main so as to be movable in the predetermine direction;

the upper accommodation portion is provided on the movable portion and is exposed outside the mating connector main through the slot; and the upper accommodation portion partially accommodates the male screw member.

36. The connector assembly as recited in claim 35, wherein:

an inside of the mating connector main is provided with a facing portion which faces in the second predetermined orientation;

the movable portion has an abutment portion which faces in the first predetermined orientation; and the facing portion faces the abutment portion in the predetermined direction and regulates a movement of the abutment portion beyond the facing portion in the first predetermined orientation.

37. The connector assembly as recited in claim 35, wherein:

the slot has an edge portion which faces in the first predetermined orientation;

the upper accommodation portion has an end portion in the second predetermined orientation; and the edge portion of the slot faces the end portion of the upper accommodation portion in the predetermined direction and regulates a movement of the end portion beyond the edge portion in the second predetermined orientation.

* * * * *